US009552909B2

(12) United States Patent
Bourns et al.

(10) Patent No.: US 9,552,909 B2
(45) Date of Patent: Jan. 24, 2017

(54) CONDUCTIVE POLYMER ELECTRONIC DEVICES WITH SURFACE MOUNTABLE CONFIGURATION AND METHODS FOR MANUFACTURING SAME

(71) Applicant: BOURNS, INC., Riverside, CA (US)

(72) Inventors: Gordon L. Bourns, Riverside, CA (US); Stelar Chu, Ping-Cheng (TW); Daniel E. Grindell, Calimesa, CA (US); David Huang, Ping-Cheng (TW); John Kelly, County Cork (IE); Erik Meijer, Riverside, CA (US)

(73) Assignee: BOURNS, INC., Riverside, CA (US)

( * ) Notice: Subject to any disclaimer, the term of this patent is extended or adjusted under 35 U.S.C. 154(b) by 608 days.

(21) Appl. No.: 14/034,092

(22) Filed: Sep. 23, 2013

(65) Prior Publication Data

US 2014/0077923 A1 Mar. 20, 2014

Related U.S. Application Data

(63) Continuation of application No. 12/294,675, filed as application No. PCT/US2007/066729 on Apr. 16, 2007, now Pat. No. 8,542,086.

(Continued)

(51) Int. Cl.

*H01C 7/18* (2006.01)
*H01C 1/14* (2006.01)

(Continued)

(52) U.S. Cl.

CPC ..... *H01C 7/18* (2013.01); *H01C 1/1406* (2013.01); *H01C 1/1413* (2013.01); *H01C 7/021* (2013.01);

(Continued)

(58) Field of Classification Search

CPC ..... H01C 7/18

See application file for complete search history.

(56) References Cited

U.S. PATENT DOCUMENTS 4,311,768 A 1/1982 Berdan et al.
5,454,929 A 10/1995 Kinghorn (Continued)

FOREIGN PATENT DOCUMENTS

JP H10510683 10/1998
JP 11288803 10/1999

(Continued)

OTHER PUBLICATIONS

Extended European Search Report from European Patent Office on co-pending EP application (07760729.9) dated Feb. 5, 2015.

(Continued)

*Primary Examiner* — James Harvey

(74) *Attorney, Agent, or Firm* — Klein, O'Neill & Singh, LLP

(57) ABSTRACT

Surface-mountable devices include a conductive polymer layer between first and second electrodes, on which are disposed first and second insulation layers, respectively, with first and second planar terminals on the second insulation layer. A first cross-conductor connects the second electrode to the first terminal, and is separated from the first electrode by a portion of the first insulation layer. A second cross-conductor connects the first electrode to the second terminal, and is separated from the second electrode by a portion of the second insulation layer. At least one cross-conductor may include a beveled portion through the first insulation layer. Alternatively, at least one cross-conductor may contact an anchor pad on the first insulation layer, the anchor pad having a small area relative to the areas of the terminals. Enhanced adhesion between the (Continued)

cross-conductor(s) and the first insulation layer is provided, while allowing thermal expansion without excessive stress.

16 Claims, 23 Drawing Sheets

Related U.S. Application Data

(60) Provisional application No. 60/744,897, filed on Apr. 14, 2006.

(51) Int. Cl.

| | |
|---|---|
| ***H01C 17/02*** | (2006.01) |
| ***H01C 7/02*** | (2006.01) |
| ***H01C 7/04*** | (2006.01) |
| *H01C 7/00* | (2006.01) |
| *H01C 1/016* | (2006.01) |

(52) U.S. Cl.

CPC ..... *H01C 7/041* (2013.01); *H01C 17/02* (2013.01); *H01C 1/016* (2013.01); *H01C 7/005* (2013.01); *H01C 7/028* (2013.01); *H01C 7/049* (2013.01); *Y10T 29/49165* (2015.01)

(56) References Cited

U.S. PATENT DOCUMENTS

| | | | | |
|---|---|---|---|---|
| 5,493,266 | A * | 2/1996 | Sasaki | H01C 1/1406 29/612 |
| 5,851,894 | A | 12/1998 | Ramm | |
| 5,852,397 | A | 12/1998 | Chan et al. | |
| 5,884,391 | A | 3/1999 | McGuire et al. | |
| 5,976,420 | A * | 11/1999 | Nakamura | H01C 7/18 252/516 |
| 6,307,160 | B1 | 10/2001 | Mei et al. | |
| 6,377,467 | B1 | 4/2002 | Chu et al. | |
| 6,838,972 | B1 | 1/2005 | Minervini et al. | |
| 7,932,806 | B2 | 4/2011 | Sato et al. | |
| 7,932,807 | B2 | 4/2011 | Sato et al. | |
| 2001/0002873 | A1* | 6/2001 | Tanaka | H01C 1/14 361/306.3 |
| 2002/0046861 | A1* | 4/2002 | Yokoyama | H01C 1/148 174/565 |
| 2002/0089054 | A1 | 7/2002 | Fukasawa et al. | |
| 2005/0039949 | A1 | 2/2005 | Kosowsky | |
| 2006/0132277 | A1* | 6/2006 | Hetherton | H01C 1/1406 336/232 |
| 2006/0176675 | A1 | 8/2006 | Bourns et al. | |
| 2006/0215342 | A1* | 9/2006 | Montoya | H01C 1/148 361/103 |
| 2008/0062614 | A1* | 3/2008 | Goia | H01C 7/18 361/311 |
| 2009/0021340 | A1* | 1/2009 | Koyama | H01C 7/18 338/20 |
| 2009/0212883 | A1 | 8/2009 | Albrecher et al. | |
| 2011/0175700 | A1 | 7/2011 | Bourns et al. | |
| 2012/0043854 | A1 | 2/2012 | Otsuka et al. | |
| 2014/0035718 | A1* | 2/2014 | Tseng | H01C 7/02 338/22 R |

FOREIGN PATENT DOCUMENTS

| | | |
|---|---|---|
| JP | 2001237106 | 8/2001 |
| JP | 2003282306 | 10/2003 |
| JP | 2003297604 | 10/2003 |
| JP | 2004165343 | 6/2004 |
| JP | 2006279045 | 10/2006 |
| WO | WO 03/050827 | 6/2003 |

OTHER PUBLICATIONS

Office Action on corresponding foreign application (JP Application No. 2013-154774) from the Japanese Patent Office dated Feb. 4, 2014.

* cited by examiner

CONDUCTIVE POLYMER ELECTRONIC DEVICES WITH SURFACE MOUNTABLE CONFIGURATION AND METHODS FOR MANUFACTURING SAME

CROSS REFERENCE TO RELATED APPLICATIONS

This application is a continuation of U.S. patent application Ser. No. 12/294,675, filed on Mar. 31, 2011, which is a national phase filing, under 35 U.S.C. §371(c), of International Application No. PCT/US2007/066729, filed Apr. 16, 2007, which claims the benefit, under 35 U.S.C. §119(e), of Provisional Application No. 60/744,897, filed on Apr. 14, 2006, the disclosure of which is incorporated herein by reference.

FEDERALLY SPONSORED RESEARCH OR DEVELOPMENT

Not Applicable

BACKGROUND OF THE INVENTION

This disclosure relates to the field of conductive polymer electronic components and devices. In particular, it relates to resistive devices comprising a layer of thermally-sensitive resistive material, such as a conductive polymer, that is laminated between a pair of planar electrodes, wherein the device has a surface-mountable configuration.

Conductive polymer thermally-sensitive resistive devices have become commonplace on electronic circuits. These include devices that exhibit a positive temperature coefficient of resistivity (PTC) and a negative temperature coefficient of resistivity (NTC). In particular, resistive devices comprising a conductive polymer resistive material exhibiting a positive temperature coefficient of resistivity (PTC) have found widespread uses as over-current protection devices or "self-resettable fuses," due to their ability to undergo a rapid and drastic (at least three or four orders of magnitude) increase in resistance in response to an over-current situation.

It is a common design goal for electronic components to reduce the surface area or "footprint" that they occupy on a circuit board, so that circuit boards can be made as small as possible, and so that component density on a circuit board of a specific area can be increased. One way of achieving a compact geometry, while also achieving economies in manufacturing costs, is to configure the components to be "surface-mountable" on a circuit board. A surface-mountable component is flush-mounted on conductive terminal pads on the board, without the need for sockets or through-board pins.

Various surface-mountable configurations have been devised for conductive polymer thermal-resistive devices, particularly PTC devices. There are several design criteria in making surface-mountable conductive polymer PTC devices, besides the criterion of having a small footprint. For example, the design of the devices must lend itself to low manufacturing costs. Furthermore, the design must provide for integrity of the connections between the metallic elements (electrodes and terminals) and the non-metallic (polymer) element(s). In many cases, the design is a compromise among these various criteria.

One problem with surface-mountable conductive polymer devices is that the metal elements tend to impose a physical constraint on the thermal expansion of the polymeric element(s) when they experience an over-current situation. Conductive polymer PTC elements are typically formed from an organic polymer, such as polyethylene, into which is mixed conductive particles, such as carbon black or metallic particles. The conductivity (or, conversely, the resistivity) of the composition is determined, in substantial part, by the average spacing between the conductive particles. The drastic and sudden increase in resistivity of a conductive polymer element in a PTC device upon experiencing an over-current condition is due to a thermally-induced expansion of the polymer element, which increases the average spacing between the conductive particles within the polymeric material. To the extent that the metallic elements of such a device impose physical constraints on the expansion of the conductive polymer element(s), the functionality of the device may be impaired, especially after repeated over-current "trippings." For example, "repeatability" (the characteristic of the device to exhibit substantially the same operational parameters) may degrade over a multitude of duty cycles (over-current tripping and subsequent resetting upon removal of the overvoltage), due to a kind of stress-induced "hysteresis" effect.

In particular, typical prior art conductive polymer PTC devices tend to exhibit poor resistance stability as a function of the number of duty cycles. This means that the normal (non-over-current condition) resistance in many prior art conductive polymer PTC devices tends to increase markedly after as few as 40-50 duty cycles. Furthermore, to the extent that the metal elements allow at least some degree of polymeric expansion, the metal elements are subject to mechanical stresses that may compromise the physical integrity of the device over repeated duty cycles.

Thus, there has been a long-felt, but as yet unsatisfied, need for a surface-mountable conductive polymer resistive device, particularly a PTC device, that is economical to manufacture, that has a small circuit board footprint, and that allows adequate thermal expansion of the polymer element without subjecting the metal elements to undue stress.

SUMMARY OF THE INVENTION

In one embodiment, a surface-mountable conductive polymer electronic device comprises at least one active layer of a conductive polymer material; an upper electrode abutting an upper surface of the active layer; a lower electrode abutting a lower surface of the active layer; an upper insulation layer abutting an upper surface of the upper electrode; a lower insulation layer abutting a lower surface of the lower electrode; first and second terminals abutting a lower surface of the lower insulation layer; a first cross-conductor adjacent a first end of the device; and a second cross-conductor adjacent a second, opposite, end of the device. The first cross-conductor connects the lower electrode and the first terminal, and a portion of the upper insulation layer separates the first cross-conductor from the upper electrode. The second cross-conductor connects the upper electrode and the second terminal, and a portion of the lower insulation layer separates the second cross-conductor from the lower electrode.

In another embodiment, a surface-mountable conductive polymer electronic device comprises at least a first active layer of a conductive polymer material; a first electrode abutting an upper surface of the first active layer; a second electrode abutting a lower surface of the first active layer; an upper insulation layer abutting an upper surface of the first electrode; at least a second active layer of a conductive polymer material positioned beneath the first active layer; a third electrode abutting an upper surface of the second active layer; a fourth electrode abutting a lower surface of the second active layer; a lower insulation layer abutting a lower surface of the fourth electrode; an intermediate insulation layer sandwiched between and abutting the second and third electrodes; first and second terminals abutting a lower surface of the lower insulation layer; a first cross-conductor adjacent a first end of the device; and a second cross-conductor adjacent a second, opposite, end of the device. The first cross-conductor connects the second and third electrodes and the first terminal. A portion of the upper insulation layer separates the first cross-conductor from the first electrode, and a portion of the lower insulation layer separates the first cross-conductor from the fourth electrode. The second cross-conductor connects the first and fourth electrodes and the second terminal. Portions of the intermediate insulation layer separate the second cross-conductor from the second and third electrodes.

In a further embodiment, a surface-mountable conductive polymer electronic device comprises at least a first active layer of a conductive polymer material; a first electrode abutting an upper surface of the first active layer; a second electrode abutting a lower surface of the first active layer; an upper insulation layer abutting an upper surface of the first electrode; at least a second active layer of a conductive polymer material positioned beneath the first active layer; a third electrode abutting an upper surface of the second active layer; a fourth electrode abutting a lower surface of the second active layer; a lower insulation layer abutting a lower surface of the fourth electrode; an intermediate insulation layer sandwiched between and abutting the second and third electrodes; first and second terminals abutting a lower surface of the lower insulation layer; a first cross-conductor adjacent a first end of the device; and a second cross-conductor adjacent a second, opposite, end of the device. The first cross-conductor connects the second and fourth electrodes and the first terminal. A portion of the upper insulation layer separates the first cross-conductor from the first electrode, and a portion of the intermediate insulation layer separates the first cross-conductor from the third electrode. The second cross-conductor connects the first and third electrodes and the second terminal. A portion of the lower insulation layer separates the second cross-conductor from the fourth electrode, and a portion of the intermediate insulation layer separates the second cross-conductor from the second electrode.

In still another embodiment, a surface-mountable conductive polymer electronic device comprises at least a first active layer of a conductive polymer material; a first electrode abutting an upper surface of the first active layer; a second electrode abutting a lower surface of the first active layer; an upper insulation layer abutting an upper surface of the first electrode; at least a second active layer of a conductive polymer material positioned beneath the first active layer; a third electrode abutting an upper surface of the second active layer; a fourth electrode abutting a lower surface of the second active layer; a first intermediate insulation layer sandwiched between and abutting the second and third electrodes; at least a third active layer of a conductive polymer material positioned beneath the second active layer; a fifth electrode abutting an upper surface of the second active layer; a sixth electrode abutting a lower surface of the second active layer; a second intermediate insulation layer sandwiched between and abutting the fourth and fifth electrodes; a lower insulation layer abutting a lower surface of the sixth electrode; first and second terminals abutting a lower surface of the lower insulation layer; a first cross-conductor adjacent a first end of the device; and a second cross-conductor adjacent a second, opposite, end of the device. The first cross-conductor connects the second, third and sixth electrodes and the first terminal. A portion of the upper insulation layer separates the first cross-conductor from the first electrode, and portions of the second intermediate insulation layer separate the first cross-conductor from the fourth and fifth electrodes. The second cross-conductor connects the first, fourth and fifth electrodes and the second terminal, and portions of the first intermediate insulation layer separate the second cross-conductor from the second and third electrodes.

In a still further embodiment, a surface-mountable conductive polymer electronic device comprises a conductive polymer active layer laminated between an upper electrode and a lower electrode; an upper insulation layer applied on the upper electrode and a lower insulation layer applied on the lower electrode; first and second planar conductive terminals formed on the lower insulation layer; a first cross-conductor connecting the lower electrode and the first terminal, and separated from the upper electrode by a portion of the upper insulation layer; and a second cross-conductor connecting the upper electrode and the second terminal, and separated from the lower electrode by a portion of the lower insulation layer. The invention also encompasses a multi-active layer device that comprises two or more single active layer devices, as defined above, arranged in a vertically-stacked configuration and electrically connected in parallel.

In another aspect of this disclosure, a first embodiment of a method of producing a surface-mountable conductive polymer electronic device comprises the steps of: providing a conductive polymer substrate; laminating the polymer substrate between upper and lower metal layers; masking and etching the upper and lower metal layers to form, respectively, upper and lower electrodes; forming upper and lower insulation layers on the upper and lower electrodes, respectively; applying upper and lower metallization layers to the upper and lower insulation layers, respectively; forming through-hole vias in the device to provide for cross-conductors; plating the upper metallization layer, the lower metallization layer and the vias to form the cross-conductors; masking the vias and masking and etching the lower metallization layer to form first and second planar, surface-mount terminal pads; plating exposed metal areas of the device; and singulating the device from a laminated structure along grid lines.

Another embodiment of a method of producing a surface-mountable conductive polymer electronic device comprises the steps of: providing a conductive polymer substrate; laminating the polymer substrate between upper and lower metal layers; masking and etching the upper and lower metal layers to form, respectively, upper and lower electrodes; forming upper and lower insulation layers on the upper and lower electrodes, respectively; applying upper and lower metallization layers to the upper and lower insulation layers, respectively; forming through-hole vias in the device to provide for cross-conductors; plating the upper metallization layer, the lower metallization layer and the vias to form the cross-conductors; photo-resist masking portions of the lower metallization layer, leaving unmasked portions of the lower metallization layer, photo-resist masking all of the upper metallization layer, and leaving the plated vias unmasked; electroplate depositing an over-plate layer or layers on the unmasked portions of the lower metallization layer and on the vias; removing the photo-resist masking from the masked portions of the lower metallization layer and the upper metallization layer; etching through the previously masked portions on the lower metallization layer to the lower insulation layer to form first and second planar, surface-mount terminal pads, and etching through the upper metallization layer; and singulating the device from a laminated structure along grid lines.

Another embodiment of a method of producing a surface-mountable conductive polymer electronic device comprises the steps of: providing a conductive polymer substrate; laminating the polymer substrate between upper and lower metal layers; masking and etching the upper and lower metal layers to form, respectively, upper and lower electrodes; forming upper and lower insulation layers on the upper and lower electrodes, respectively; applying upper and lower metallization layers to the upper and lower insulation layers, respectively; forming through-hole vias in the device to provide for cross-conductors; plating the upper metallization layer, the lower metallization layer and the vias to form the cross-conductors; photo-resist masking portions of the lower metallization layer, leaving unmasked portions of the lower metallization layer, photo-resist masking portions of the upper metallization layer, leaving unmasked portions of the upper metallization layer, and leaving the vias unmasked; electroplate depositing an over-plate layer or layers on the unmasked portions of the lower metallization layer, on the unmasked portions of the upper metallization layer, and on the vias; removing the photo-resist masking from the masked portions of the lower metallization layer and the upper metallization layer; etching through the previously masked portions on the lower metallization layer to the lower insulation layer to form first and second planar, surface-mount terminal pads, and etching through the previously masked portions on the upper metallization layer to the upper insulation layer to form an anchor pad; and singulating the device from a laminated structure along grid lines.

Another embodiment of a method of producing a surface-mountable conductive polymer electronic device, comprises the steps of laminating a conductive polymer substrate between upper and lower metal foil layers; removing a portion of the upper and lower foil layers to form upper and lower electrodes; applying an upper and a lower insulation layer on the upper and lower electrodes, respectively, applying a bottom metallization layer on the bottom insulation layer; forming an array of through-hole vias; plating the vias so as to form a first cross-conductor connecting the upper electrode to the bottom metallization layer and a second cross-conductor connecting the lower electrode to the bottom metallization layer; and removing part of the bottom metallization layer to form a pair of surface mount terminals, each connected to one of the upper and lower electrodes by one of the cross-conductors and isolated by a portion of one of the insulation layers from the other of the upper and lower electrodes.

DETAILED DESCRIPTION OF THE PREFERRED EMBODIMENTS

As used herein, the terms "invention" and "present invention" are to be understood as encompassing the invention described herein in its various embodiments and aspects, as well as any equivalents that may suggest themselves to those skilled in the pertinent arts.

Figure 1A:
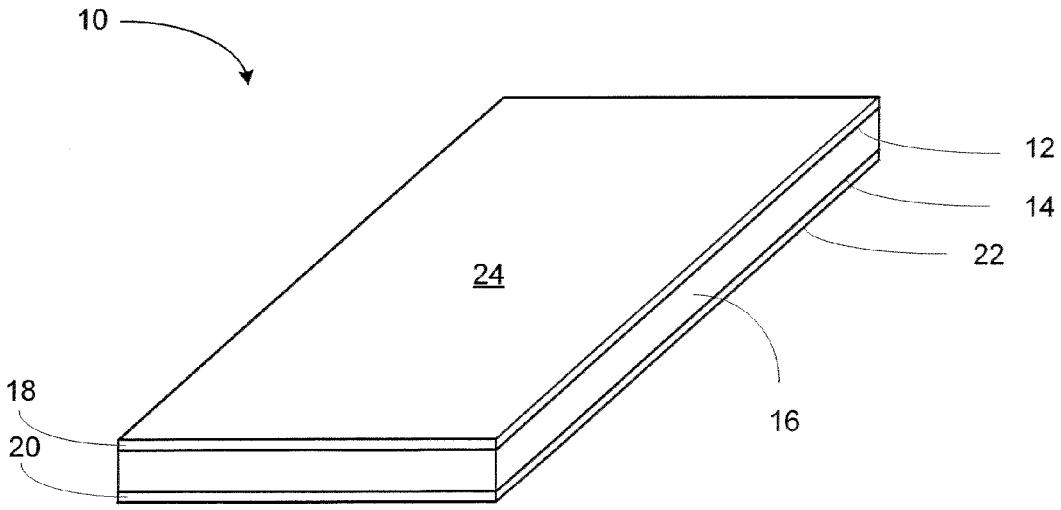
FIG. 1A is a perspective view of a laminated structure or sheet comprising a layer of conductive polymer material laminated between upper and lower laminar metal layers.

The various embodiments of the present invention are made with one or more laminated sheet structures, of the type shown in FIG. 1A. As shown, a laminated sheet structure 10 comprises a layer of a polymeric active material 16 laminated between an upper laminar metal layer 12 and a lower laminar metal layer 14. The polymeric layer 16 may be a conductive polymer, such as a polymer that exhibits a positive temperature coefficient of resistivity, or it may be a polymeric dielectric material, or a ferromagnetic polymer. Various types of suitable conductive polymer PTC materials are well-known in the art, some of which may include one or more of an anti-oxidant, a cross-linking agent, a coupling agent and a stabilizer.

The metal layers 12, 14 are preferably made of conductive metal foil, and more preferably a nickel-plated copper foil that is nodularized (by conventional techniques) on the surface that is placed against the polymeric layer. In a specific example embodiment, the metal layers 12, 14 are of nodularized nickel-plated copper foil having a thickness of about 18 microns. The lamination may be performed by any suitable lamination process known in the art, an example of which is described in International Patent Publication No. WO 97/06660, the disclosure of which is incorporated herein by reference.

As an alternative to laminating a layer of polymeric material between upper and lower foil sheets, it may be advantageous, for certain applications, to metallize directly the upper and lower surfaces of a sheet of polymeric material. The metallization may be accomplished by a metal plating process, vapor deposition, screen-printing, or any other suitable process that may suggest itself to those skilled in the pertinent arts. The preferred embodiments of the present invention, however, use the laminated structure described above, and the ensuing description will be based on the use of the lamination process.

Figure 1B:
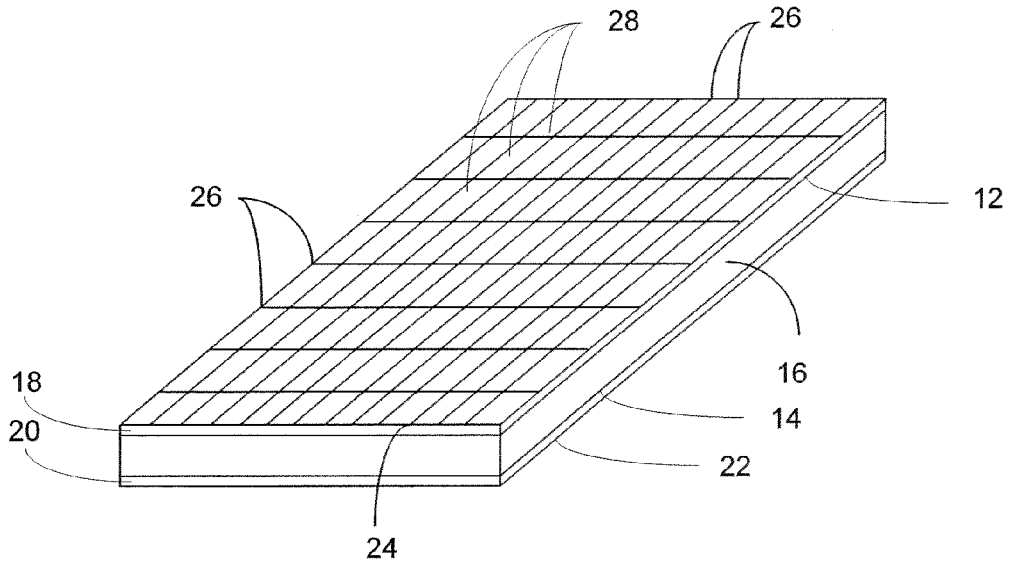
FIG. 1B is a perspective view of the laminated structure of FIG. 1A, showing a grid of singulation lines.
Figure 2D:
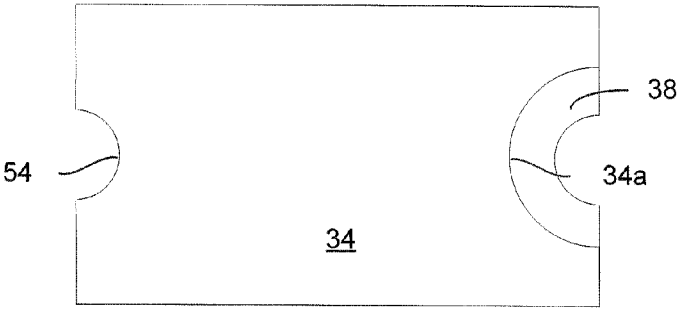
FIG. 2D is a cross-sectional view taken along line 2D-2D of FIG. 2B.
Figure 2E:
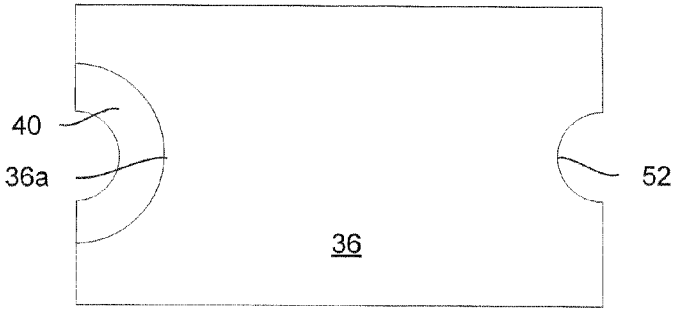
FIG. 2E is a cross-sectional view taken along line 2E-2E of FIG. 2B.
Figure 2A:
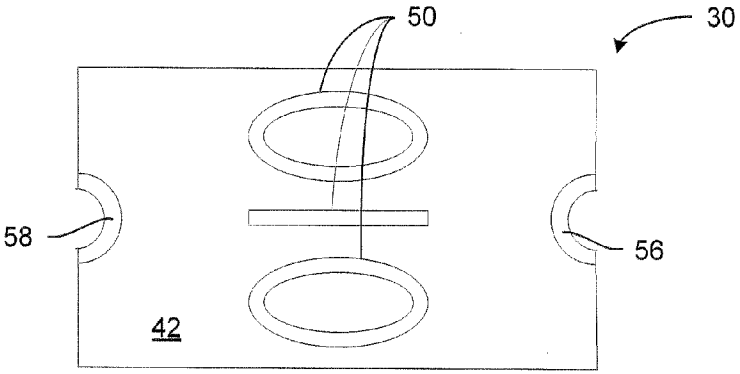
FIGS. 2A, 2B, and 2C are a top plan view, a cross-sectional view, and a bottom plan view, respectively, of a single active layer conductive polymer device in accordance with a first embodiment of the present invention.
Figure 2B:
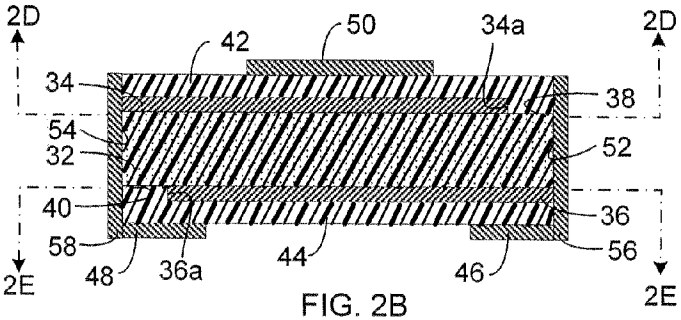
Figure 2C:
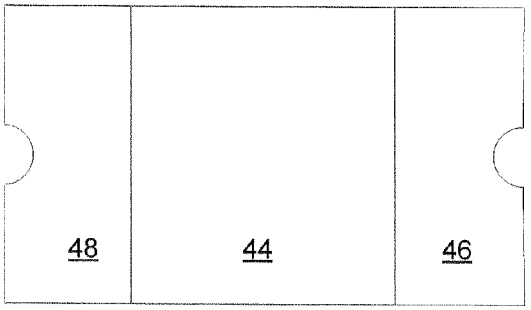

As will be described below, the upper and lower metal layers 12, 14 are photo-resist masked and etched to form electrodes (not shown in FIGS. 1A and 1B). Once the electrodes are formed, upper and lower insulation layers 18, 20 are applied to the upper and lower electrodes. A bottom metallization layer 22 (preferably copper) is applied to the lower insulation layer 20, and a top metallization layer 24 (also, preferably, copper) may optionally be applied to the upper insulation layer 18. The metallization layers 22, 24 are preferably in the form of copper foils, but they may also be applied by plating, vapor deposition, screen printing, or any other suitable process. In example embodiments of the invention, the metallization layers are made of copper foil of about 18 microns in thickness. The insulation layers and the metallization layer or layers may be applied in separate steps. Alternatively, the lower insulation layer 20 and the bottom metallization layer 22 may be applied together as a pre-formed laminate, as may be the upper insulation 18 layer and the top metallization layer 24 (if present).

As will be explained in detail below, an array of through-hole vias (not shown in FIGS. 1A and 1B) is formed through the laminated structure 10 at appropriate locations. After electrolytically copper plating the exposed metal surfaces (the bottom metallization layer 22, the top metallization layer, if present, and the internal surfaces of the vias), the bottom metallization layer 22 is photo-resist masked and etched to form surface-mount terminals (not shown in FIGS. 1A and 1B), and the optional top metallization layer 24, if present, is photo-resist masked and etched to form anchor pads and (optionally) identifying indicia (not shown in FIGS. 1A and 1B). Finally, the remaining exposed metal surfaces (the terminals, the anchor pads and indicia, if present, and the internal surfaces of the vias) are plated with one or more solderable metals, such as nickel followed by gold, nickel followed by tin, or tin only. Alternatively, the plating with solderable metals may be performed immediately after the copper plating step, and before the etching of the metallization layer(s). As will be seen, the metallized vias form cross-conductors connecting each of the electrodes with one of the terminals.

The laminated sheet structure 10 is typically sized to provide a matrix comprising a multitude of electronic devices. Thus, as shown in FIG. 1B, the sheet 10 may advantageously be provided with a grid of singulation lines 26 that are formed in or on the top-most and bottom-most surface of the structure 10, and that define the perimeters of a plurality of devices 28. The singulation lines 26 may be formed by conventional photo-resist masking and etching techniques, and they are preferably of sufficient width to provide a small space or "isolation barrier" that is formed along the edges of each device 28 after singulation by a singulation device (not shown). The isolation barrier minimizes the probability of a short occurring between adjacent conductive elements (electrodes or terminals, as will be described) for which electrical isolation is desired. Alternatively, the singulation lines 26 may be "virtual" lines that form a virtual reference grid stored in the memory of a computerized singulation device, or that is otherwise created by the singulation device.

The devices described below are advantageously mass-produced while interconnected in a matrix provided by a single laminated sheet structure 10 (for a single active layer device), or in a matrix formed by the lamination of two or more sheet structures into a multi-layer laminated structure (for a device having two or more active layers). The matrix is then singulated (e.g., along the lines 26) to form individual devices. The discussion below will be set forth with reference to the illustration of a single device, but it is to be understood that the process steps described below are performed on a matrix of such devices while they are interconnected in such a matrix. Thus, each step is performed simultaneously at a plurality of pre-defined locations on the matrix. As a final step in the manufacturing processes described below, the individual devices are separated from the matrix (singulated) by cutting, breaking, or dicing the matrix along the singulation lines 26, or along a grid of separation lines defined by the singulation apparatus (if the singulation lines are not pre-formed).

FIGS. 2A, 2B, 2C, 2D, and 2E illustrate a conductive polymer device 30, in accordance with a first embodiment of the present invention. The device 30 includes a single active layer 32 of conductive polymer material, laminated between an upper metal foil electrode 34 and a lower foil electrode 36. First and second pluralities of through-hole via locations are defined in the sheet structure 10 (FIG. 1A). Each via location in the first plurality is separated from a corresponding via location in the second plurality by a pre-defined distance that corresponds to the length of a single device 30. An arcuate area of the upper electrode 34 adjacent each of the first via locations is removed (e.g., by conventional photo-resist masking and etching) to create an upper isolation area 38 at a first end of the upper electrode 34. Similarly, an arcuate area of the lower electrode 36 adjacent each of the second via locations is removed to create a lower isolation area 40 at the opposite end of the second electrode 36.

An upper insulation layer 42, which may be of prepreg, an insulative polymer, or an epoxy, is applied to the exposed surface of the upper electrode 34, and a lower insulation layer 44, of similar material, is applied to the exposed surface of the lower electrode 36. The upper insulation layer 42 fills the upper isolation area 38, while the lower insulation layer 44 fills the lower isolation area 40. A bottom metallization layer, preferably a metal foil, (such as, for example, a copper foil) is applied to the exposed surface of the lower insulation layer. First and second surface mount terminals 46, 48, will be formed from the bottom metallization layer, as will be described below. Similarly, a top metallization layer, preferably a metal foil (such as, for example, a copper foil), may optionally be applied to the upper insulation layer 42 to form identification indicia 50, as also described below. The top metallization layer (if present) and the upper insulation layer 42 may be pre-formed and applied as a laminate, or they may be applied separately in sequence. Likewise, the bottom metallization layer and the bottom insulation layer 44 may be applied either together as a pre-formed laminate, or separately in sequence. In either case, the result is a laminated structure comprising a single active polymer layer 32, an upper electrode 34, a lower electrode 36, a top insulation layer 42, a bottom insulation layer 44, a bottom metallization layer, and (optionally) a top metallization layer.

A first through-hole via 52 is formed through the entire thickness of the above-described laminated structure (e.g. by mechanical or laser drilling) at each of the first plurality of via locations, and a second through-hole via 54 is similarly (and, preferably, simultaneously) formed through the entire thickness of the laminated structure at each of the second plurality of via locations. Thus, each device 30 has a first through-hole via 52 at a first end, and a second through-hole via 54 at the opposite end. At this point, the top and bottom surfaces of the structure and the inside surfaces of the through-hole vias 52, 54 are plated with one or more layers of conductive metal, thereby forming a first set of electrically conductive interconnections or "cross-conductors" 56 within each of the first set of vias 52, and a second set of cross-conductors 58 within each of the second set of vias 54. The metallization may be by any suitable process, and in a preferred embodiment, comprises at least an electroplated copper layer. Each of the first set of cross-conductors 56 establishes physical and electrical contact with the lower electrode 36, and the bottom metallization layer, and, if present, the top metallization layer, while being electrically isolated from the upper electrode 34 by the upper isolation area 38. Similarly, each of the second set of cross-conductors 58 establishes physical and electrical contact with the upper electrode 34 and the top and bottom metallization layers, while being electrically isolated from the lower electrode 36 by the lower isolation area 40.

The bottom metallization layer is formed into first and second planar surface-mount terminals 46, 48 by removing the central portion of the bottom metallization layer by any conventional technique, preferably by photo-resist masking and etching. This process leaves a planar metallized first surface-mount terminal 46 and a planar metallized second surface-mount terminal 48 on the bottom surface of the device 30, separated from each other by an exposed portion of the lower insulation layer 44. The first terminal 46 is in electrical contact with the lower electrode 36 through the first cross-conductor 56, while the second terminal 48 is in electrical contact with the upper electrode 34 through the second cross-conductor 58. If a top metallization layer has been applied, as mentioned above, the photo-resist masking and etching process may be employed to remove all of the top metallization layer except for those portions that represent the indicia 50. The exposed metal areas, particularly the terminals 46, 48 and the cross-conductors 56, 58 (and the indicia 50, if present), may advantageously be over-plated with one or more solderable metal layers, such as, for example, electroless-plated nickel followed by immersion-plated gold (a process known as Electroless Nickel/Immersion Gold plating, or "ENIG" plating). Alternatively, a single electroless-plated layer of tin may be applied.

Alternatively, as will be discussed below, the over-plating with solderable metals may be performed immediately after the copper-plating, and before the formation of the surface-mount terminals (and the optional indicia). In that case, the over-plating is preferably electroplated nickel followed by electroplated gold or tin. Alternatively, only an electroplated layer of tin may be applied.

Figure 3A:
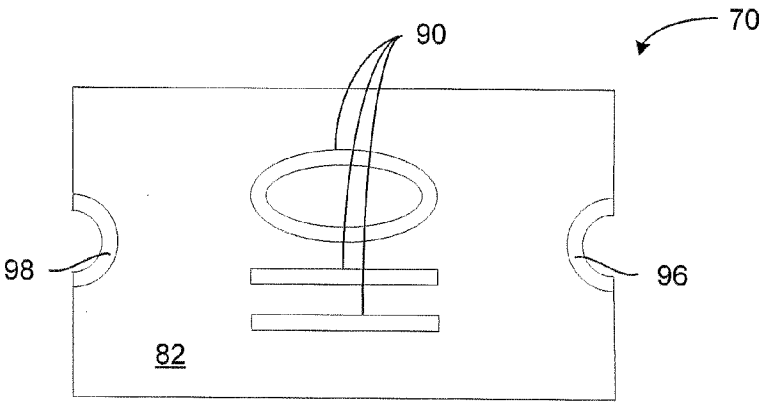
FIGS. 3A, 3B, and 3C are a top plan view, a cross-sectional view, and a bottom plan view, respectively, of a dual active layer conductive polymer device in accordance with the first embodiment of the present invention.
Figure 3C:
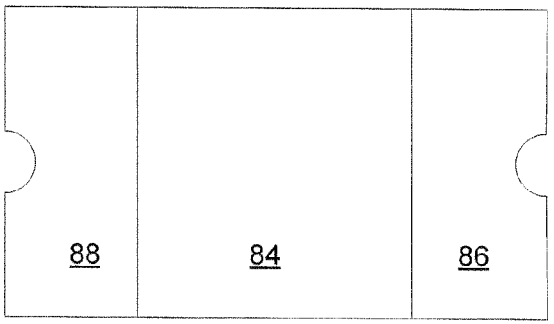
Figure 3B:
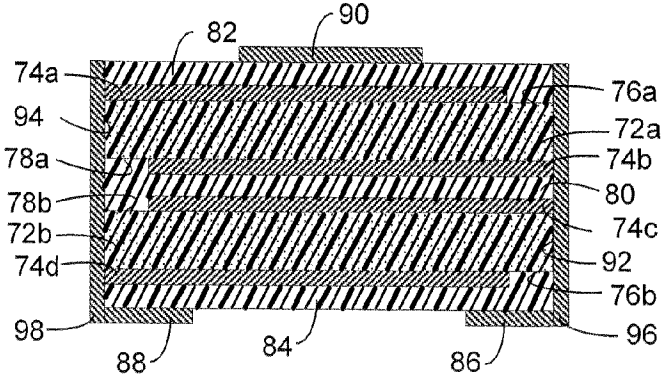

FIGS. 3A, 3B, and 3C illustrate a multiple active layer device 70 that is a variant of the embodiment of FIGS. 2A-2E, wherein the multiple active layer device 70 comprises at least a first active layer 72*a* and a second active layer 72*b*, of conductive polymer material, connected in parallel, and arranged in a vertically-stacked configuration with a single pair of surface-mount terminals. The first active layer 72*a* is laminated between first and second metal foil electrodes 74*a*, 74*b* in a first laminated sheet structure, and the second active layer 72*b* is laminated between third and fourth metal foil electrodes 74*c*, 74*d* in a second laminated sheet structure, each of the sheet structures being of the type described above and shown in FIGS. 1A and 1B. The first and second pluralities of via locations are defined as described above. An arcuate area of the first and fourth electrodes 74*a*, 74*d* adjacent each of the first via locations is removed (e.g., by conventional photo-resist masking and etching) to create an upper isolation area 76*a* and a lower isolation area 76*b* at a first end of the first and fourth electrodes 74*a*, 74*d*. Similarly, an arcuate area of the second and third electrodes 74*b*, 74*c* adjacent each of the second via locations is removed to create intermediate isolation areas 78*a*, 78*b* at the opposite ends of the second and third electrodes 74*c*, 74*d*. The first and second laminated sheet structures are then laminated together into a multiple active layer laminated structure by an intermediate insulative layer 80 (prepreg, polymer, or epoxy), so that the upper and lower isolation areas 76*a*, 76*b* are aligned at a first end of the structure, and the intermediate isolation areas 78*a*, 78*b* are aligned at the opposite end of the structure. The intermediate isolation areas 78*a*, 78*b* are filled by the intermediate insulative layer 80. Alternatively, the second and third electrodes 74*b*, 74*c* may be soldered together, without the use of the intermediate insulative layer 80. Insulative material would then be screen printed so as to fill in the intermediate isolation areas 78*a*, 78*b*. The soldering of the electrodes together could lead to improved conduction of heat out of the active elements, resulting in faster electrical response to increases and decreases in device temperature.

A top insulation layer 82, which may be of prepreg, an insulative polymer, or an epoxy, is applied to the exposed surface of the first electrode 74*a*, and a bottom insulation layer 84, of similar material, is applied to the exposed surface of the fourth electrode 74*d*. The top insulation layer 82 fills the upper isolation area 76*a*, while the bottom insulation layer 84 fills the lower isolation area 76*b*. A bottom metallization layer, preferably a copper foil, is applied to the exposed surface of the bottom insulation layer to form first and second surface mount terminals or terminal pads 86, 88, as will be described below. Similarly, a top metallization layer, preferably a copper foil, may optionally be applied to the top insulation layer 82 to form identification indicia 90, as also described below. The top metallization layer (if present) and the top insulation layer 82 may be pre-formed and applied as a laminate, or they may be applied separately in sequence. Likewise, the bottom metallization layer and the bottom insulation layer 84 may be applied either together as a pre-formed laminate, or separately in sequence. In either case, the result is a multiple active layer laminated structure comprising first and second active polymer layers 72*a*, 72*b*, a first or upper electrode 74*a*, intermediate second and third electrodes 74*b*, 74*c*, a fourth or lower electrode 74*d*, an intermediate insulation layer 80, a top insulation layer 82, a bottom insulation layer 84, a bottom metallization layer, and (optionally) a top metallization layer.

A first through-hole via 92 is formed through the entire thickness of the above-described multiple active layer laminated structure (e.g. by mechanical or laser drilling) at each of the first plurality of via locations, and a second through-hole via 94 is similarly (and, preferably, simultaneously) formed through the entire thickness of the structure at each of the second plurality of via locations. Thus, each device 70 has a first through-hole via 92 at a first end, and a second through-hole via 94 at the opposite end. At this point, the top and bottom surfaces of the structure and the inside surfaces of the through-hole vias 92, 94 are plated with one or more layers of conductive metal, preferably copper, thereby forming a first set of cross-conductors 96 within each of the first set of vias 92, and a second set of cross-conductors 98 within each of the second set of vias 94. Each of the first set of cross-conductors 96 establishes physical and electrical contact with the second and third (intermediate) electrodes 74*b*, 74*c* and the top and bottom metallization layers, while being electrically isolated from the first (upper) electrode 74*a* by the upper isolation area 76*a*, and from the fourth (lower) electrode by the lower isolation layer 76*b*. Similarly, each of the second set of cross-conductors 98 establishes physical and electrical contact with the first (upper) electrode 74*a* and the fourth (lower) electrode 74*d* and the top and bottom metallization layers, while being electrically isolated from the second and third (intermediate) electrodes 74*b*, 74*c* by the intermediate isolation areas 78*a*, 78*b*.

The bottom metallization layer is formed into first and second terminals or terminal pads 86, 88 by removing the central portion of the bottom metallization layer by any conventional technique, preferably by photo-resist masking and etching. This process leaves a planar metallized first surface-mount terminal 86 and a planar metallized second surface-mount terminal 88 on the bottom surface device 70, separated from each other by an exposed portion of the bottom insulation layer 84. The first terminal 86 is in electrical contact with the second and third (intermediate) electrodes 74*b*, 74*c* through the first cross-conductor 96, while the second terminal 88 is in electrical contact with the first (upper) electrode 74*a* and the fourth (lower) electrode 74*d* through the second cross-conductor 98. If a top metallization layer has been applied, as mentioned above, the masking and photo-etching process may be employed to remove all of the top metallization layer except for those portions that represent the indicia 90. The exposed metal areas, particularly the terminals 86, 88 and the cross-conductors 96, 98 (and the optional indicia 90, if present), may advantageously be over-plated with one or more solderable metal layers, such as, for example, nickel and gold ENIG plating, or just electroless tin plating. Alternatively, as mentioned above, the overplating can be performed immediately after the copper plating with electroplated nickel followed by electroplated gold or tin, or just electroplated tin.

Figure 4A:
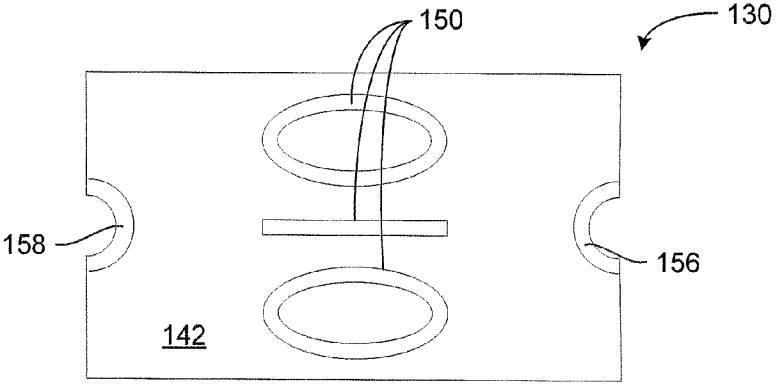
FIGS. 4A, 4B, and 4C are a top plan view, a cross-sectional view, and a bottom plan view, respectively, of a single active layer conductive polymer device in accordance with a second embodiment of the present invention.
Figure 4C:
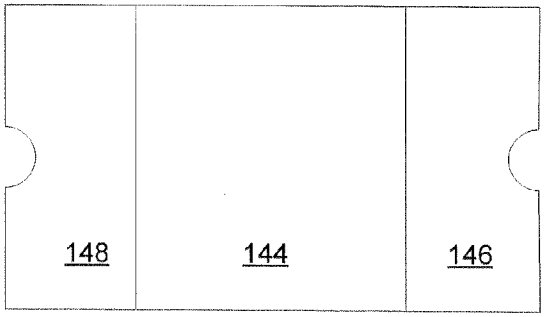
Figure 4B:
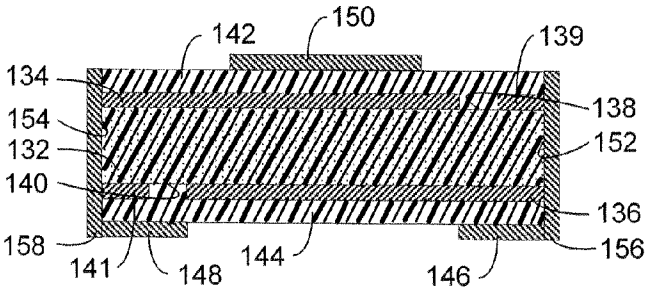

FIGS. 4A, 4B, and 4C illustrate a conductive polymer device 130, in accordance with a second embodiment of the invention. The device 130 includes a single active layer 132 of conductive polymer material, laminated between an upper metal foil electrode 134 and a lower foil electrode 136. The device 130 is similar to the device 30, described above and illustrated in FIGS. 2A through, 2E, except that the upper electrode 134 is formed (by photo-resist masking and etching) with an upper isolation area 138 in the form of a narrow lateral band or strip that is spaced from a first end of the device 130 by a narrow upper residual foil area 139. Similarly, the lower electrode 136 is likewise formed with a lower isolation area 140 in the form of a narrow lateral band or strip that is spaced from the second end of the device 130 by a narrow lower residual foil area 141. A top insulation layer 142 is applied or formed over the upper electrode 134 and the upper residual foil area 139, filling in the upper isolation area 138. Likewise, a bottom insulation layer 144 is applied or formed over the lower electrode 136 and the lower residual foil area 141, filling in the lower isolation area 140. A bottom metallization layer, preferably a copper foil, is applied to the exposed surface of the bottom insulation layer 144 to form first and second surface mount terminals or terminal pads 146, 148, as will be described below. Similarly, a top metallization layer, preferably a copper foil, may optionally be applied to the top insulation layer 142 to form identification indicia 150, as also described below. The top metallization layer (if present) and the top insulation layer 142 may be pre-formed and applied as a laminate, or they may be applied separately in sequence. Likewise, the bottom metallization layer and the bottom insulation layer 144 may be applied either together as a pre-formed laminate, or separately in sequence. In either case, the result is a laminated structure comprising a single active polymer layer 132, an upper electrode 134, a lower electrode 136, a top insulation layer 142, a bottom insulation layer 144, a bottom metallization layer, and (optionally) a top metallization layer.

The first and second pluralities of via locations are defined as described above. A first through-hole via 152 is formed through the entire thickness of the above-described laminated structure (e.g. by mechanical or laser drilling) at each of the first plurality of via locations, and a second through-hole via 154 is similarly (and, preferably, simultaneously) formed through the entire thickness of the multi-layer structure at each of the second plurality of via locations. Thus, each device 130 has a first through-hole via 152 at a first end, and a second through-hole via 154 at the opposite end. At this point, the top and bottom surfaces of the structure and the inside surfaces of the through-hole vias 152, 154 are plated with one or more layers of conductive metal, preferably copper, thereby forming a first set of cross-conductors 156 within each of the first set of vias 152, and a second set of cross-conductors 158 within each of the second set of vias 154. Each of the first set of cross-conductors 156 establishes physical and electrical contact with the lower electrode 136 and the top and bottom metallization layers, while being electrically isolated from the upper electrode 134 by the upper isolation area 138. Similarly, each of the second set of cross-conductors 158 establishes physical and electrical contact with the upper electrode 134 and the top and bottom metallization layers, while being electrically isolated from the lower electrode 136 by the lower isolation area 140.

The bottom metallization layer is formed into first and second terminals 146, 148 by removing the central portion of the bottom metallization layer by any conventional technique, preferably by photo-masking and etching. This process leaves a planar metallized first surface-mount terminal 146 and a planar metallized second surface-mount terminal 148 on the bottom surface device 130, separated from each other by an exposed portion of the bottom insulation layer 144. The first terminal 146 is in electrical contact with the lower electrode 136 through the first cross-conductor 156, while the second terminal 148 is in electrical contact with the upper electrode 134 through the second cross-conductor 158. If a top metallization layer has been applied, as mentioned above, the masking and etching process may be employed to remove all of the top metallization layer except for those portions that represent the indicia 150. The exposed metal areas, particularly the terminals 146, 148 and the cross-conductors 156, 158, may advantageously be overplated with one or more solderable metal layers, such as, for example, the nickel and gold ENIG plating, as described above, or just electroless-plated tin. Alternatively, the overplating can be electroplated nickel and gold, electroplated nickel and tin, or just electroplated tin, performed immediately after the copper plating step.

Figure 5A:
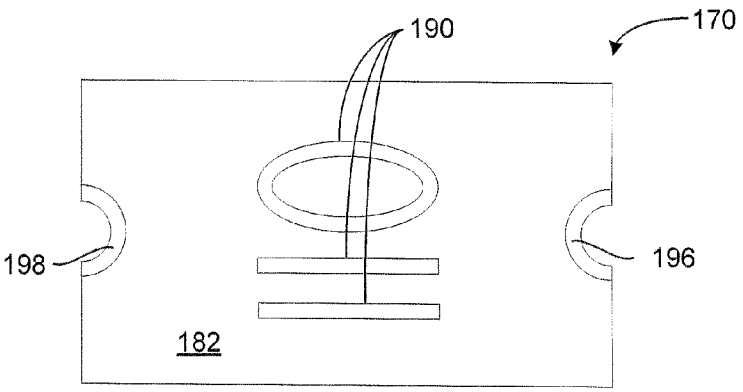
FIGS. 5A, 5B, and 5C are a top plan view, a cross-sectional view, and a bottom plan view, respectively, of a dual active layer conductive polymer device in accordance with the second embodiment of the present invention.
Figure 5C:
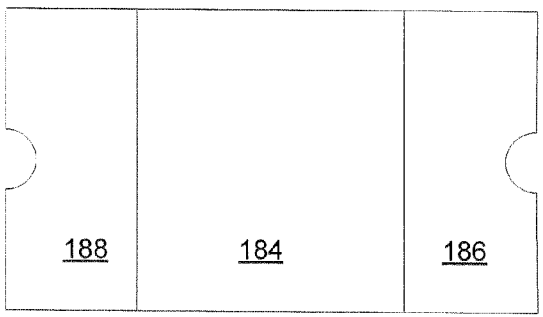
Figure 5B:
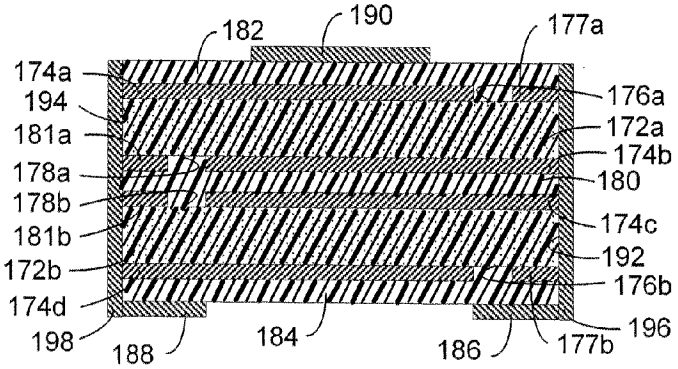

FIGS. 5A, 5B, and 5C illustrate a multiple active layer device 170 that is a variant of the embodiment of FIGS. 4A-4C, wherein the multiple active layer device 170 comprises at least a first active layer 172*a* and a second active layer 172*b*, of conductive polymer material, connected in parallel, and arranged in a vertically-stacked configuration with a single pair of surface-mount terminals. The first active layer 172*a* is laminated between first and second metal foil electrodes 174*a*, 174*b* in a first laminated sheet structure, and the second active layer 172*b* is laminated between third and fourth metal foil electrodes 174*c*, 174*d* in a second laminated sheet structure, each of the sheet structures being of the type described above and shown in FIGS. 1A and 1B. The first and second pluralities of via locations are defined as described above. The first or upper electrode 174*a* is formed (by photo-resist masking and etching) with an upper isolation area 176*a* in the form of a narrow lateral band or strip that is spaced from a first end of the device 170 by a narrow upper residual foil area 177*a*. Similarly, the fourth or lower electrode 174*d* is likewise formed with a lower isolation area 176*b* in the form of a narrow lateral band or strip that is spaced from the first end of the device 170 by a narrow lower residual foil area 177*b*. The second and third (intermediate) electrodes 174*b*, 174*c* are similarly formed with intermediate isolation areas 178*a*, 178*b* in the form of lateral bands or strips that are spaced from the second end of the device 170 by narrow intermediate residual foil areas 181*a*, 181*b*. The first and second laminated sheet structures are then laminated together into a multiple active layer laminated structure by an intermediate insulative layer 180 (prepreg, polymer, or epoxy), so that the upper and lower isolation areas 176*a*, 176*b* are aligned at a first end of the structure, and the intermediate isolation areas 178*a*, 178*b* are aligned at the opposite end of the structure. The intermediate isolation areas 178*a*, 178*b* are filled by the intermediate insulative layer 180.

A top insulation layer 182, which may be of prepreg, an insulative polymer, or an epoxy, is applied to the exposed surfaces of the first electrode 174*a* and the upper residual foil area 177*a*, and a bottom insulation layer 184, of similar material, is applied to the exposed surfaces of the fourth electrode 174*d* and the lower residual foil area 177*b*. The top insulation layer 182 fills the upper isolation area 176*a*, while the bottom insulation layer 184 fills the lower isolation area 176*b*. A bottom metallization layer, preferably a copper foil, is applied to the exposed surface of the bottom insulation layer to form first and second surface mount terminals 186, 188, as will be described below. Similarly, a top metallization layer, preferably a copper foil, may optionally be applied to the top insulation layer 182 to form identification indicia 190, as also described below. The top metallization layer (if present) and the top insulation layer 182 may be pre-formed and applied as a laminate, or they may be applied separately in sequence. Likewise, the bottom metallization layer and the bottom insulation layer 184 may be applied either together as a pre-formed laminate, or separately in sequence. In either case, the result is a multiple active layer laminated structure comprising first and second active polymer layers 172*a*, 172*b*, a first or upper electrode 174*a*, intermediate second and third electrodes 174*b*, 174*c*, a fourth or lower electrode 174*d*, an intermediate insulation layer 180, a top insulation layer 182, a bottom insulation layer 184, a bottom metallization layer, and (optionally) a top metallization layer.

A first through-hole via 192 is formed through the entire thickness of the above-described multiple active layer laminated structure (e.g. by mechanical or laser drilling) at each of the first plurality of via locations, and a second through-hole via 194 is similarly (and, preferably, simultaneously) formed through the entire thickness of the structure at each of the second plurality of via locations. Thus, each device 170 has a first through-hole via 192 at a first end, and a second through-hole via 194 at the opposite end. At this point, the top and bottom surfaces of the structure and the inside surfaces of the through-hole vias 192, 194 are plated with one or more layers of conductive metal, preferably copper, thereby forming a first set of cross-conductors 196 within each of the first set of vias 192, and a second set of cross-conductors 198 within each of the second set of vias 194. Each of the first set of cross-conductors 196 establishes physical and electrical contact with the second and third (intermediate) electrodes 174*b*, 174*c* and the top and bottom metallization layers, while being electrically isolated from the first (upper) electrode 174*a* by the upper isolation area 176*a*, and from the fourth (lower) electrode by the lower isolation layer 176*b*. Similarly, each of the second set of cross-conductors 198 establishes physical and electrical contact with the first (upper) electrode 174*a* and the fourth (lower) electrode 174*d* and the top and bottom metallization layers, while being electrically isolated from the second and third (intermediate) electrodes 174*b*, 174*c* by the intermediate isolation areas 178*a*, 178*b*.

The bottom metallization layer is formed into first and second terminals 186, 188 by removing the central portion of the bottom metallization layer by any conventional technique, preferably by photo-resist masking and etching. This process leaves a planar metallized first surface-mount terminal 186 and a planar metallized second surface-mount terminal 188 on the bottom surface of the device 170, separated from each other by an exposed portion of the bottom insulation layer 184. The first terminal 186 is in electrical contact with the second and third (intermediate) electrodes 174*b*, 174*c* through the first cross-conductor 196, while the second terminal 188 is in electrical contact with the first (upper) electrode 174*a* and the fourth (lower) electrode 174*d* through the second cross-conductor 198. If a top metallization layer has been applied, as mentioned above, the masking and photo-etching process may be employed to remove all of the top metallization layer except for those portions that represent the indicia 190. The exposed metal areas, particularly the terminals 186, 188 and the cross-conductors 196, 198, (and the indicia 190, if present) may advantageously be over-plated with one or more solderable metal layers, such as, for example, the nickel and gold ENIG plating, or just electroless-plated tin, as described above. Alternatively, the over-plating may electroplated nickel and hold, electroplated nickel and tin, or just electroplated tin, performed immediately after the copper plating step.

Figure 6A:
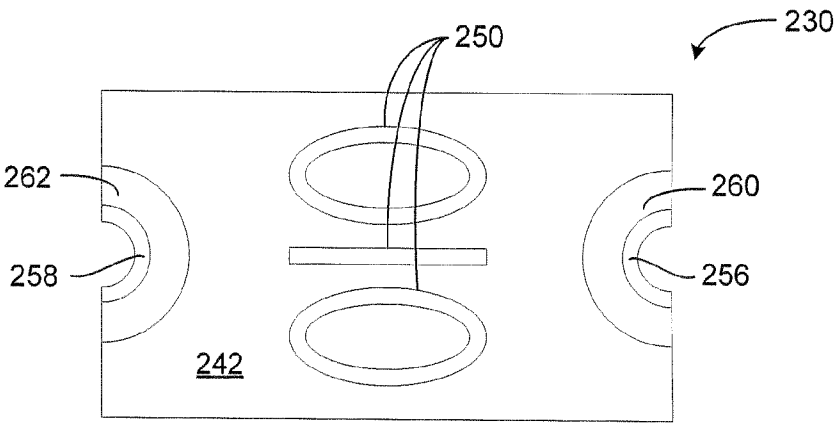
FIGS. 6A, 6B, and 6C are a top plan view, a cross-sectional view, and a bottom plan view, respectively, of a single active layer conductive polymer device in accordance with a third embodiment of the present invention.
Figure 6C:
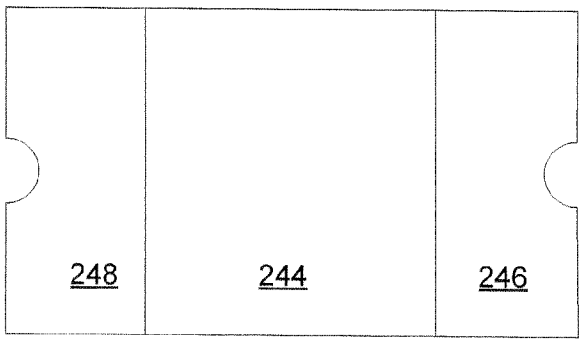
Figure 6B:
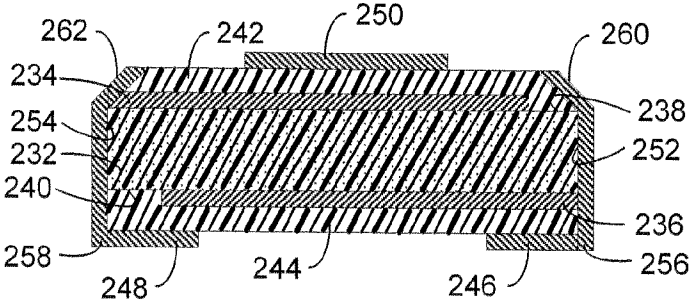

FIGS. 6A, 6B, and 6C illustrate a conductive polymer device 230, in accordance with a third embodiment of the present invention. The device 230 includes a single active layer 232 of conductive polymer material, laminated between an upper metal foil electrode 234 and a lower foil electrode 236. This embodiment differs from the first embodiment described above and illustrated in FIGS. 2A-2C principally in that the vias in the laminated sheet structures are formed with a funnel-shaped upper opening, yielding a chamfered upper entry surface for the cross-conductors at each end of the device, as explained below. In terms of structure, the device 230 includes an arcuate upper isolation area 238 between the upper electrode 234 and a first end of the device 230, adjacent a first through-hole via 252. The device also includes an arcuate lower isolation area 240 between the lower electrode 236 and the opposite end of the device 230, adjacent a second through-hole via 254. A top insulation layer 242 is formed or applied on the exposed surface of the upper electrode 234, filling in the upper isolation area 238, and a bottom insulation layer 244 is similarly formed or applied on the exposed surface of the lower electrode 236, filling in the lower isolation area 240. A bottom metallization layer, preferably a copper foil, is applied to the exposed surface of the bottom insulation layer 244 to form first and second surface mount terminals 246, 248, as will be described below. Similarly, a top metallization layer, preferably a copper foil, may optionally be applied to the top insulation layer 242 to form identification indicia 250, as also described below. The top metallization layer (if present) and the top insulation layer 242 may be pre-formed and applied as a laminate, or they may be applied separately in sequence. Likewise, the bottom metallization layer and the bottom insulation layer 234 may be applied either together as a pre-formed laminate, or separately in sequence. In either case, the result is a laminated structure comprising a single active polymer layer 232, an upper electrode 234, a lower electrode 236, a top insulation layer 242, a bottom insulation layer 244, a bottom metallization layer, and (optionally) a top metallization layer.

A first through-hole via 252 is formed through the entire thickness of the above-described laminated structure (e.g. by mechanical or laser drilling) at each of the first plurality of via locations, and a second through-hole via 254 is similarly (and, preferably, simultaneously) formed through the entire thickness of the laminated structure at each of the second plurality of via locations. Thus, each device 230 has a first through-hole via 252 at a first end, and a second through-hole via 254 at the opposite end. At this point, the top entrance or opening of each of the vias 252, 254 is chamfered or beveled by any suitable method or mechanism known in the art, such as, for example, a drill with a conical drill bit (not shown), to form a chamfered or beveled first entry hole 260 for the first via 252, and a similar chamfered or beveled second entry hole 262 for the second via 254. The first entry hole 260 extends through the upper insulation layer 242 and the first isolation area 238, leaving a portion of the first isolation area 238 to separate the first entry hole 260 from a first end of the upper electrode 234, while the second entry hole 262 extends through the upper insulation layer 242 to the second via 254 either adjacent to or through the opposite end of the upper electrode 234. Although it is preferred to drill the vias 252, 254 first, and then to form the chamfered or beveled entry holes 260, 262, the chamfered or beveled entry holes 260, 262 may be formed at the predefined via locations before the vias 252, 254 are drilled.

The top and bottom surfaces of the structure and the inside surfaces of the through-hole vias 252, 254, including their respective entry holes 260, 262, are plated with one or more layers of conductive metal, preferably copper, thereby forming a first set of cross-conductors 256 within each of the first set of vias 252 and first chamfered or beveled entry hole 260, and a second set of cross-conductors 258 within each of the second set of vias 254 and second chamfered or beveled entry hole 262. Each of the first set of cross-conductors 256 establishes physical and electrical contact with the lower electrode 236 and the top and bottom metallization layers, while being electrically isolated from the upper electrode 234 by the upper isolation area 238. Similarly, each of the second set of cross-conductors 258 establishes physical and electrical contact with the upper electrode 234 and the top and bottom metallization layers, while being electrically isolated from the lower electrode 236 by the lower isolation area 240. Each of the copper-plated first vias 252 provides a first cross-conductor 256 with a sloped shoulder provided by a first chamfered entry hole 260. Likewise, each of the copper-plated second vias 254 provides a second cross-conductor 258 with a sloped shoulder provided by a second chamfered entry hole 262. The sloped shoulders of the cross-conductors 256, 258 establish a more intimate and secure contact with the top insulation layer 242 than that established by a cross-conductor formed through a straight via, such as that shown in FIGS. 2A-2C, for example The bottom metallization layer is formed into first and second terminals 246, 248 by removing the central portion of the bottom metallization layer by any conventional technique, preferably by photo-resist masking and etching. This process leaves a planar metallized first surface-mount terminal 246 and a planar metallized second surface-mount terminal 248 on the bottom surface device 230, separated from each other by an exposed portion of the bottom insulation layer 234. The first terminal 246 is in electrical contact with the lower electrode 236 through the first cross-conductor 256, while the second terminal 248 is in electrical contact with the upper electrode 234 through the second cross-conductor 258. If a top metallization layer has been applied, as mentioned above, the photo-resist masking and etching process may be employed to remove the entire top metallization layer except for those portions that represent the indicia 250. The exposed metal areas, particularly the terminals 246, 248 and the cross-conductors 256, 258 (and the indicia 250, if present), may advantageously be over-plated with one or more solderable metal layers, such as, for example, the nickel and gold ENIG plating, described above, or just electroless-plated tin. Alternatively, the over-plating may be electroplated nickel and gold, electroplated nickel and tin, or just electroplated tin, performed immediately after the copper plating step.

Figure 7A:
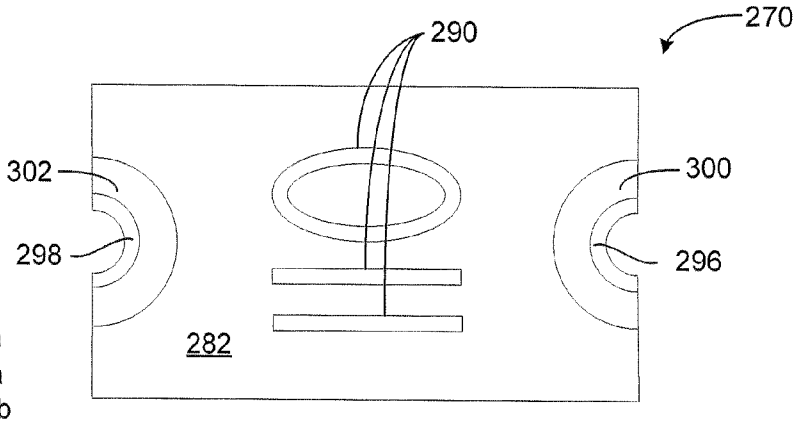
FIGS. 7A, 7B, and 7C are a top plan view, a cross-sectional view, and a bottom plan view, respectively, of a dual active layer conductive polymer device, in accordance with the third embodiment of the present invention.
Figure 7C:
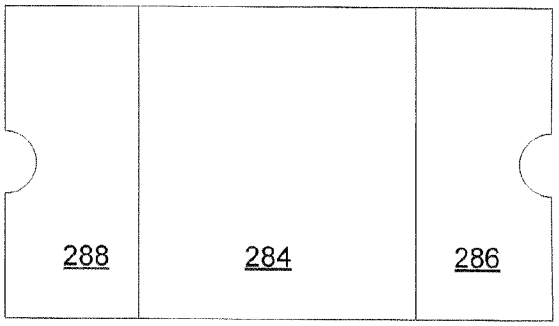
Figure 7B:
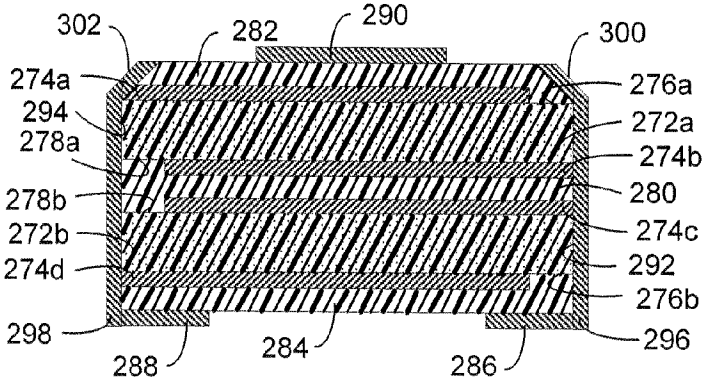

FIGS. 7A, 7B, and 7C illustrate a multiple active layer device 270 that is a variant of the third embodiment of FIGS. 6A-6C, wherein the multiple active layer device 270 comprises at least a first active layer 272*a* and a second active layer 272*b*, of conductive polymer material, connected in parallel, and arranged in a vertically-stacked configuration with only a single pair of surface-mount terminals. The first active layer 272*a* is laminated between first and second metal foil electrodes 274*a*, 274*b* in a first laminated sheet structure, and the second active layer 276*b* is laminated between fifth and fourth metal foil electrodes 274*c*, 274*d* in a second laminated sheet structure, each of the sheet structures being of the type described above and shown in FIGS. 1A and 1B. The first and second pluralities of via locations are defined as described above. The first or upper electrode 274*a* is formed (by photo-resist masking and etching) with an arcuate upper isolation area 276*a* between the first electrode 274*a* and a first end of the device 270, adjacent to a first through-hole via 292. Similarly, the fourth or lower electrode 274*d* is likewise formed with an arcuate lower isolation area 276*b* between the fourth electrode 274*d* and the first end of the device 270, adjacent to the first through-hole via 292. The second and third (intermediate) electrodes 274*b*, 274*c* are similarly formed with intermediate arcuate isolation areas 278*a*, 278*b* between the intermediate electrodes 274*b*, 274*c* and the second end of the device 270, adjacent to the second through-hole via 294. The first and second laminated sheet structures are then laminated together into a multiple active layer laminated structure by an intermediate insulative layer 280 (prepreg, polymer, or epoxy), so that the upper and lower isolation areas 276*a*, 276*b* are aligned at a first end of the structure, and the intermediate isolation areas 278*a*, 278*b* are aligned at the opposite end of the structure. The intermediate isolation areas 278*a*, 278*b* are filled by the intermediate insulative layer 280.

A top insulation layer 282, which may be of prepreg, an insulative polymer, or an epoxy, is applied to the exposed surface of the first electrode 274*a*, and a bottom insulation layer 284, of similar material, is applied to the exposed surface of the fourth electrode 274*d*. The top insulation layer 282 fills the upper isolation area 276*a*, while the bottom insulation layer 284 fills the lower isolation area 276*b*. A bottom metallization layer, preferably a copper foil, is applied to the exposed surface of the bottom insulation layer to form first and second surface mount terminals 286, 288, as will be described below. Similarly, a top metallization layer, preferably a copper foil, may optionally be applied to the top insulation layer 282 to form identification indicia 290, as also described below. The top metallization layer (if present) and the top insulation layer 282 may be pre-formed and applied as a laminate, or they may be applied separately in sequence. Likewise, the bottom metallization layer and the bottom insulation layer 284 may be applied either together as a pre-formed laminate, or separately in sequence. In this embodiment (as in the other multiple active layer embodiments described herein), the lamination of the first and second laminated sheet structures together with the intermediate insulative layer 280 may be performed simultaneously with one or more of the top insulating layer 282 and the top metallization layer and the bottom insulation layer 284 and the bottom metallization layer. In any case, the result is a multiple active layer laminated structure comprising first and second active polymer layers 272*a*, 272*b*, a first or upper electrode 274*a*, intermediate second and third electrodes 274*b*, 274*c*, a fourth or lower electrode 274*d*, an intermediate insulation layer 280, a top insulation layer 282, a bottom insulation layer 284, a bottom metallization layer, and (optionally) a top metallization layer.

A first through-hole via 292 is formed through the entire thickness of the above-described multiple active layer laminated structure (e.g. by mechanical or laser drilling) at each of the first plurality of via locations, and a second through-hole via 294 is similarly (and, preferably, simultaneously) formed through the entire thickness of the structure at each of the second plurality of via locations. Thus, each device 270 has a first through-hole via 292 at a first end, and a second through-hole via 294 at the opposite end. At this point, the top entrance or opening of each of the vias 292, 294 is chamfered by a drill using a conical drill bit (not shown) to form a chamfered or beveled first entry hole 300 for the first via 292, and a similar chamfered or beveled second entry hole 302 for the second via 294. The removal of the insulating material at the openings or entries of the vias 292, 294 may be accomplished by any suitable mechanical or chemical mechanism or process that may suggest itself to those skilled in the pertinent arts. The first entry hole 300 extends through the upper insulation layer 282 and the first isolation area 276*a*, leaving a portion of the first isolation area 276*a* to separate the first entry hole 300 from a first end of the upper electrode 274*a*, while the second entry hole 302 extends through the upper insulation layer 282 to the second via 294 adjacent to or through the opposite end of the first or upper electrode 274*a*. Although it is preferred to drill the vias 292, 294 first, and then to form the chamfered or beveled entry holes 300, 302, the entry holes 300, 302 may be formed at the pre-defined via locations before the vias 292, 294 are drilled. Furthermore, in some applications, it may be advantageous to form only a singled chamfered or beveled entry hole in each device, i.e., either the first entry hole 300 or the second entry hole 302.

The top and bottom surfaces of the structure and the inside surfaces of the through-hole vias 292, 294 and the chamfered entry holes 300, 302 are plated with one or more layers of conductive metal, preferably copper, thereby forming a first set of cross-conductors 296 within each of the first set of vias 292, and a second set of cross-conductors 298 within each of the second set of vias 294. Each of the first set of cross-conductors 296 establishes physical and electrical contact with the second and third (intermediate) electrodes 274*b*, 274*c* and the top and bottom metallization layers, while being electrically isolated from the first (upper) electrode 274*a* by the upper isolation area 276*a*, and from the fourth (lower) electrode 274*d* by the lower isolation layer 276*b*. Similarly, each of the second set of cross-conductors 298 establishes physical and electrical contact with the first (upper) electrode 274*a* and the fourth (lower) electrode 274*d* and the top and bottom metallization layers, while being electrically isolated from the second and third (intermediate) electrodes 274*b*, 274*c* by the intermediate isolation areas 278*a*, 278*b*.

Each of the copper-plated first vias 292 provides a first cross-conductor 296 with a sloped shoulder provided by a first chamfered entry hole 300. Likewise, each of the copper-plated second vias 294 provides a second cross-conductor 298 with a sloped shoulder provided by a second chamfered entry hole 302. The sloped shoulders of the cross-conductors 296, 298 establish a more intimate and secure contact with the top insulation layer 282 than that established by a cross-conductor formed through a straight via, such as that shown in FIGS. 3A-3C, for example.

The bottom metallization layer is formed into first and second terminals 286, 288 by removing the central portion of the bottom metallization layer by any conventional technique, preferably by photo-resist masking and etching. This process leaves a planar metallized first surface-mount terminal 286 and a planar metallized second surface-mount terminal 288 on the bottom surface of the device 270, separated from each other by an exposed portion of the bottom insulation layer 284. The first terminal 286 is in electrical contact with the second and third (intermediate) electrodes 274*b*, 274*c* through the first cross-conductor 296, while the second terminal 288 is in electrical contact with the first (upper) electrode 274*a* and the fourth (lower) electrode 274*d* through the second cross-conductor 298. If a top metallization layer has been applied, as mentioned above, the masking and photo-etching process may be employed to remove the entire top metallization layer except for those portions that represent the indicia 290. The exposed metal areas, particularly the terminals 286, 288 and the cross-conductors 296, 298 (and the indicia 290, if present), may advantageously be over-plated with one or more solderable metal layers, such as, for example, the nickel and gold ENIG plating, or just electroless-plated tin. Alternatively, the over-plating may be electroplated nickel and gold, electroplated nickel and tin, or just electroplated tin, applied immediately after the copper plating step.

Figure 8A:
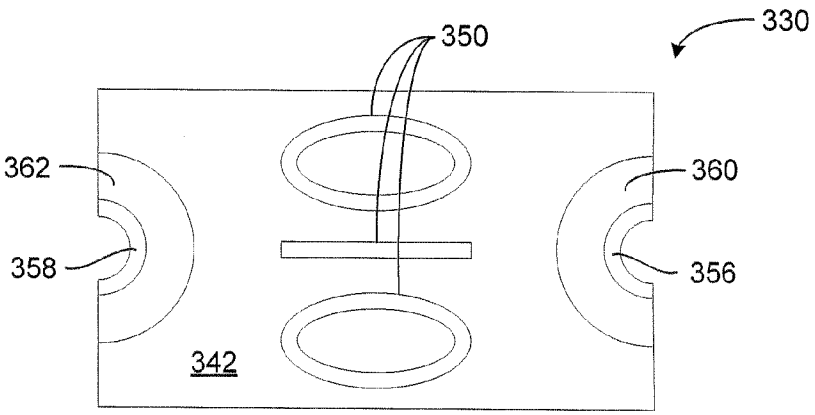
FIGS. 8A, 8B, and 8C are a top plan view, a cross-sectional view, and a bottom plan view, respectively, of a single active layer conductive polymer device in accordance with a fourth embodiment of the present invention.
Figure 8C:
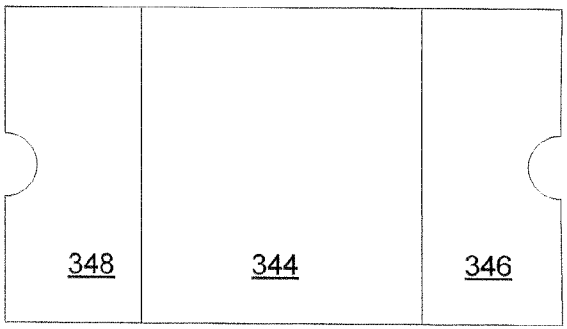
Figure 8B:
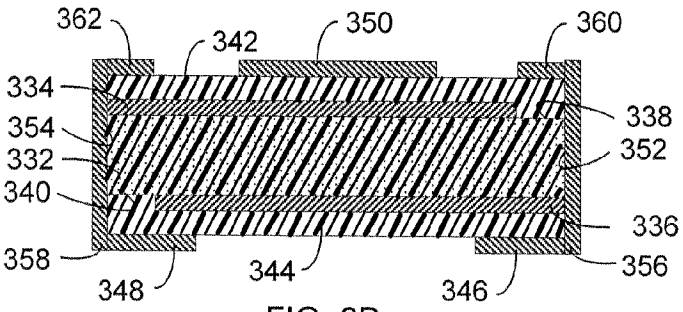

FIGS. 8A, 8B, and 8C illustrate a conductive polymer device 330, in accordance with a fourth embodiment of the present invention. The device 330 includes a single active layer 332 of conductive polymer material, laminated between an upper metal foil electrode 334 and a lower foil electrode 336. First and second pluralities of through-hole via locations are defined in the sheet structure 10 (FIG. 1A). Each via location in the first plurality is separated from a corresponding via location in the second plurality by a pre-defined distance that corresponds to the length of a single device 330. An arcuate area of the upper electrode 334 adjacent each of the first via locations is removed (e.g., by conventional photo-resist masking and etching) to create an upper isolation area 338 at a first end of the upper electrode 334. Similarly, an arcuate area of the lower electrode 336 adjacent each of the second via locations is removed to create a lower isolation area 340 at the opposite end of the second electrode 336.

A top insulation layer 342, which may be of prepreg, an insulative polymer, or an epoxy, is applied to the exposed surface of the upper electrode 334, and a bottom insulation layer 344, of similar material, is applied to the exposed surface of the lower electrode 336. The top insulation layer 342 fills the upper isolation area 338, while the bottom insulation layer 344 fills the lower isolation area 340. A bottom metallization layer, preferably a copper foil, is applied to the exposed surface of the bottom insulation layer to form first and second surface mount terminals 346, 348, as will be described below. Similarly, a top metallization layer, preferably a copper foil, is applied to the top insulation layer 342 to form first and second anchor pads 360, 362, and (optionally) identification indicia 350, as discussed below. The top metallization layer and the top insulation layer 342 may be pre-formed and applied as a laminate, or they may be applied separately in sequence. Likewise, the bottom metallization layer and the bottom insulation layer 344 may be applied either together as a pre-formed laminate, or separately in sequence. In either case, the result is a laminated structure comprising a single active polymer layer 332, an upper electrode 334, a lower electrode 336, a top insulation layer 342, a bottom insulation layer 344, a bottom metallization layer, and a top metallization layer.

A first through-hole via 352 is formed through the entire thickness of the above-described laminated structure (e.g. by mechanical or laser drilling) at each of the first plurality of via locations, and a second through-hole via 354 is similarly (and, preferably, simultaneously) formed through the entire thickness of the laminated structure at each of the second plurality of via locations. Thus, each device 330 has a first through-hole via 352 at a first end, and a second through-hole via 354 at the opposite end.

At this point, the top and bottom surfaces of the structure and the inside surfaces of the through-hole vias 352, 354 are plated with one or more layers of conductive metal, preferably copper, thereby forming a first set of cross-conductors 356 within each of the first set of vias 352, and a second set of cross-conductors 358 within each of the second set of vias 354. A photo-resist masking and etching process is employed to form one or both of the first and second anchor pads 360, 362 and the optional indicia 350 from the top metallization layer, and to form the planar terminals 346, 348, from the bottom metallization layer. The masking and etching process may be employed either before or after the vias 352, 354 are formed and plated. Each of the first set of cross-conductors 356 establishes physical and electrical contact with the lower electrode 336 and the first terminal 346, while being electrically isolated from the upper electrode 334 by the upper isolation area 338. Each of the first cross-conductors 356 also is physically connected to a first anchor pad 360, which serves, along with the first terminal 346, as an anchor point for the first cross-conductor 356. Similarly, each of the second set of cross-conductors 358 establishes physical and electrical contact with the upper electrode 334 and the second terminal 348, while being electrically isolated from the lower electrode 336 by the lower isolation area 340. Each of the second cross-conductors 358 also is physically connected to a second anchor pad 362, which serves, along with the second terminal 348, as an anchor point for the second cross-conductor 358. The exposed metal areas, particularly the terminals 346, 348, the cross-conductors 356, 358, and, optionally, the anchor pads 360, 362, and the optional indicia 350 (if present) may advantageously be over-plated with one or more solderable metal layers, such as, for example, the nickel and gold ENIG plating, or just electroless-plated tin. Alternatively, the over-plating may be electroplated nickel and gold, electroplated nickel and tin, or just electroplated tin, applied immediately after the copper plating step.

It will be appreciated that the physical continuity of the cross-conductors 356 and 358 with the anchor pads 360, 362, respectively, provides added structural integrity to the device, while the anchor pads 360, 362 themselves, occupying relatively little surface area, do not impose a significant restraint on the thermal expansion of the polymer layer 332.

Figure 9A:
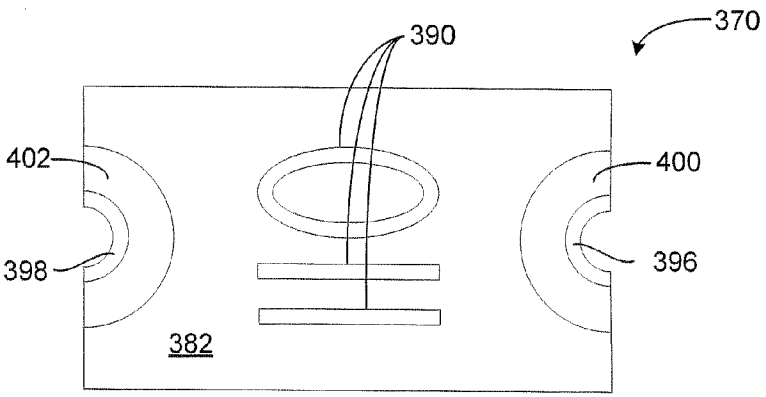
FIGS. 9A, 9B, and 9C are a top plan view, a cross-sectional view, and a bottom plan view, respectively, of a dual active layer conductive polymer device, in accordance with the fourth embodiment of the present invention.
Figure 9C:
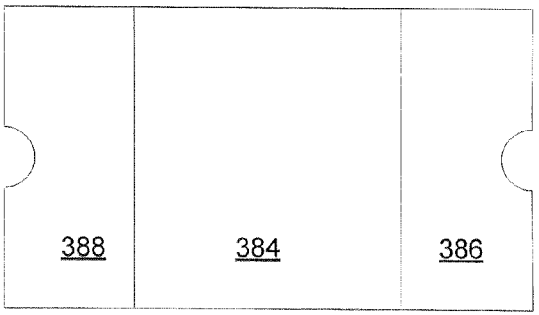
Figure 9B:
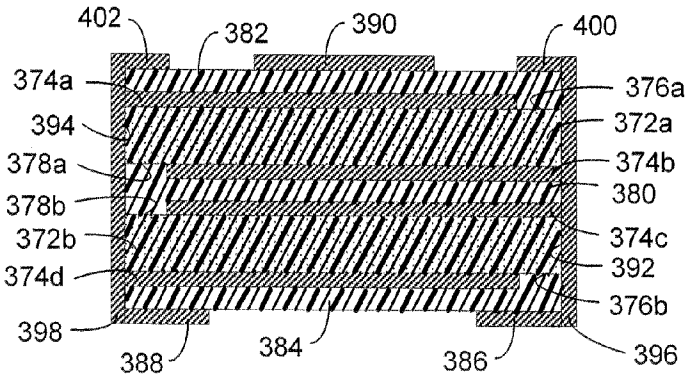

FIGS. 9A, 9B, and 9C illustrate a multiple active layer device 370 that is a variant of the embodiment of FIGS. 8A-8C, wherein the multiple active layer device 370 comprises at least a first active layer 372*a* and a second active layer 372*b*, of conductive polymer material, connected in parallel, and arranged in a vertically-stacked configuration using only a single pair of surface-mount terminals. The first active layer 372*a* is laminated between first and second metal foil electrodes 374*a*, 374*b* in a first laminated sheet structure, and the second active layer 372*b* is laminated between third and fourth metal foil electrodes 374*c*, 374*d* in a second laminated sheet structure, each of the sheet structures being of the type described above and shown in FIGS. 1A and 1B. The first and second pluralities of via locations are defined as described above. An arcuate area of the first and fourth electrode 374*a*, 374*d* adjacent each of the first via locations is removed (e.g., by conventional photo-resist masking and etching) to create an upper isolation area 376*a* and a lower isolation area 376*b* at a first end of the first and fourth electrodes 374*a*, 374*d*. Similarly, an arcuate area of the second and third electrodes 374*b*, 374*c* adjacent each of the second via locations is removed to create intermediate isolation areas 378*a*, 378*b* at the opposite ends of the second and third electrodes 374*b*, 374*c*. The first and second laminated sheet structures are then laminated together into a multiple active layer laminated structure by an intermediate insulative layer 380 (prepreg, polymer, or epoxy), so that the upper and lower isolation areas 376*a*, 376*b* are aligned at a first end of the structure, and the intermediate isolation areas 378*a*, 378*b* are aligned at the opposite end of the structure. The intermediate isolation areas 378*a*, 378*b* are filled by the intermediate insulative layer 380.

A top insulation layer 382, which may be of prepreg, an insulative polymer, or an epoxy, is applied to the exposed surface of the first electrode 374*a*, and a bottom insulation layer 384, of similar material, is applied to the exposed surface of the fourth electrode 374*d*. The top insulation layer 382 fills the upper isolation area 376*a*, while the bottom insulation layer 384 fills the lower isolation area 376*b*. A bottom metallization layer, preferably a copper foil, is applied to the exposed surface of the bottom insulation layer to form first and second surface mount terminals 386, 388, as will be described below. Similarly, a top metallization layer, preferably a copper foil, is applied to the top insulation layer 382 to form first and second anchor pads 400, 402, and (optionally) identification indicia 390, as also described below. The top metallization layer and the top insulation layer 382 may be pre-formed and applied as a laminate, or they may be applied separately in sequence. Likewise, the bottom metallization layer and the bottom insulation layer 384 may be applied either together as a pre-formed laminate, or separately in sequence. In either case, the result is a multiple active layer laminated structure comprising first and second active polymer layers 372*a*, 372*b*, a first or upper electrode 374*a*, intermediate second and third electrodes 374*b*, 374*c*, a fourth or lower electrode 374*d*, an intermediate insulation layer 380, a top insulation layer 382, a bottom insulation layer 384, a bottom metallization layer, and a top metallization layer.

A first through-hole via 392 is formed through the entire thickness of the above-described multiple active layer laminated structure (e.g. by mechanical or laser drilling) at each of the first plurality of via locations, and a second through-hole via 394 is similarly (and, preferably, simultaneously) formed through the entire thickness of the structure at each of the second plurality of via locations. Thus, each device 370 has a first through-hole via 392 at a first end, and a second through-hole via 394 at the opposite end.

At this point, the top and bottom surfaces of the structure and the inside surfaces of the through-hole vias 392, 394 are plated with one or more layers of conductive metal, preferably copper, thereby forming a first set of cross-conductors 396 within each of the first set of vias 392, and a second set of cross-conductors 398 within each of the second set of vias 394. A photo-resist masking and etching process is employed to form one or both of the first and second anchor pads 400, 402 and the optional indicia 390 from the top metallization layer, and to form the planar terminals 386, 388, from the bottom metallization layer. The masking and etching process may be employed either before or after the vias 392, 394 are formed and plated. Each of the first set of cross-conductors 396 establishes physical and electrical contact with the second and third (intermediate) electrodes 374*b*, 374*c* and the first terminal 386, while being electrically isolated from the first (upper) electrode 374*a* and from the fourth (lower) electrode 374*d* by the upper isolation area 376*a* and the lower isolation area 376*b*, respectively. Each of the first cross-conductors 396 also is physically connected to a first anchor pad 400, which serves, along with the first terminal 386, as an anchor point for the first cross-conductor 396. Similarly, each of the second set of cross-conductors 398 establishes physical and electrical contact with the first (upper) electrode 374*a*, the fourth (lower) electrode 374*d*, and the second terminal 388, while being electrically isolated from the second and third (intermediate) electrodes 374*b*, 374*c* by the intermediate isolations area 378*a*, 378*b*. Each of the second cross-conductors 398 also is physically connected to a second anchor pad 402, which serves, along with the second terminal 388, as an anchor point for the second cross-conductor 398. The exposed metal areas, particularly the terminals 386, 388, the cross-conductors 396, 398, and optionally, the anchor pads 400, 402 and the optional indicia 390 (if present) may advantageously be over-plated with one or more solderable metal layers, such as nickel and gold ENIG plating or electroless tin plating. Alternatively, the over-plating may be electroplated nickel and gold, electroplated nickel and tin, or just electroplated tin, applied immediately after the copper plating step.

Figure 10A:
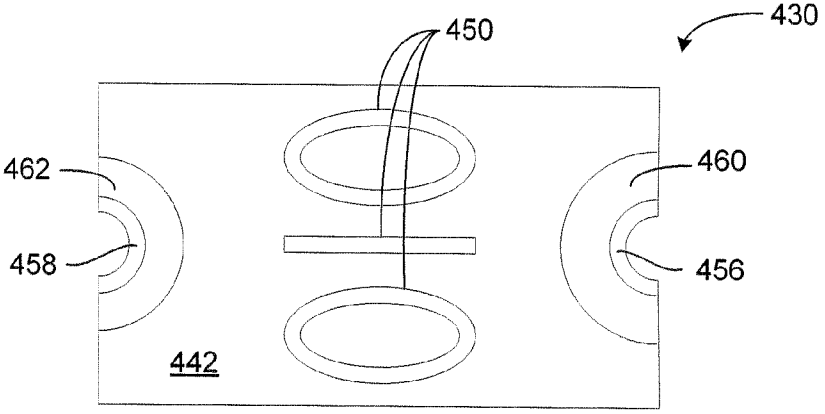
FIGS. 10A, 10B, and 10C are a top plan view, a cross-sectional view, and a bottom plan view, respectively, of a single active layer conductive polymer device in accordance with a fifth embodiment of the present invention.
Figure 10C:
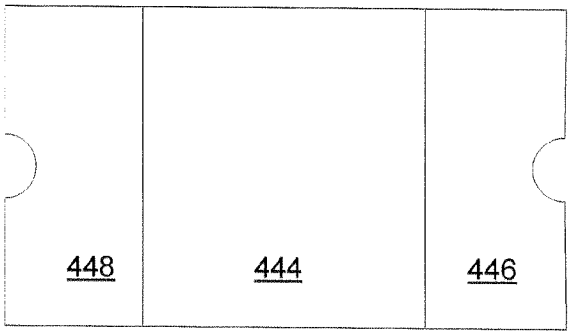
Figure 10B:
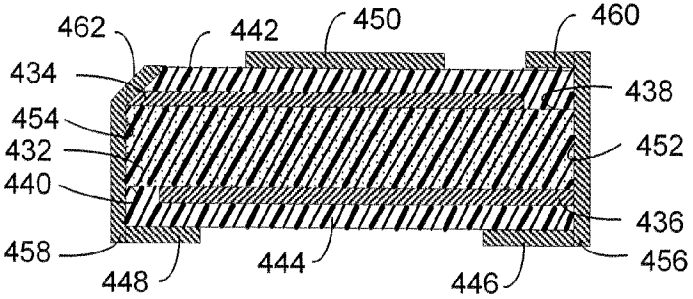

FIGS. 10A, 10B, and 10C illustrate a conductive polymer device 430, in accordance with a fifth embodiment of the present invention. The device 430 includes a single active layer 432 of conductive polymer material, laminated between an upper metal foil electrode 434 and a lower foil electrode 436. In terms of structure, the device 430 includes an arcuate upper isolation area 438 between the upper electrode 434 and a first end of the device 430, adjacent a first through-hole via 452. The device also includes an arcuate lower isolation area 440 between the lower electrode 436 and the opposite end of the device 430, adjacent a second through-hole via 454. A top insulation layer 442 is formed or applied on the exposed surface of the upper electrode 434, filling in the upper isolation area 438, and a bottom insulation layer 444 is similarly formed or applied on the exposed surface of the lower electrode 436, filling in the lower isolation area 440. A bottom metallization layer 22 (FIGS. 1A, 1B), preferably a copper foil, is applied to the exposed surface of the bottom insulation layer to form first and second surface mount terminals 446, 448, as will be described below. Similarly, a top metallization layer 24 (FIGS. 1A and 1B) preferably a copper foil, is applied to the top insulation layer 442 to form an anchor pad 460 and (optionally) identification indicia 450, as also described below. The top metallization layer 18 and the top insulation layer 442 may be pre-formed and applied as a laminate, or they may be applied separately in sequence. Likewise, the bottom metallization layer 20 and the bottom insulation layer 444 may be applied either together as a pre-formed laminate, or separately in sequence. In either case, the result is a laminated structure comprising a single active polymer layer 432, an upper electrode 434, a lower electrode 436, a top insulation layer 442, a bottom insulation layer 444, a bottom metallization layer and a top metallization layer.

A first through-hole via 452 is formed through the entire thickness of the above-described laminated structure (e.g. by mechanical or laser drilling) at each of the first plurality of via locations, and a second through-hole via 454 is similarly (and, preferably, simultaneously) formed through the entire thickness of the laminated structure at each of the second plurality of via locations. Thus, each device 430 has a first through-hole via 452 at a first end, and a second through-hole via 454 at the opposite end. At this point, the top entrance or opening of the second via 454 is chamfered or beveled by any suitable mechanism or process, such as, for example, a drill with a conical drill bit (not shown), to form a chamfered or beveled second entry hole 462 for the second via 454. The chamfered or beveled second entry hole 462 extends through the upper insulation layer 442 to the second via 454 adjacent to or through an end of the upper electrode 434. Although it is preferred to drill the vias 452, 454 first, and then to form the chamfered entry hole 462, the chamfered entry hole 462 may be formed at the pre-defined second via locations before the vias 452, 454 are drilled.

The top and bottom surfaces of the structure and the inside surfaces of the through-hole vias 452, 454, including the chamfered entry hole 462, are plated with one or more layers of conductive metal, preferably copper, thereby forming a first set of cross-conductors 456 within each of the first set of vias 452, and a second set of cross-conductors 458 within each of the second set of vias 454 and their associated chamfered second entry holes 462. A photo-resist masking and etching process is employed to form the anchor pad 460 and the optional indicia 450 from the top metallization layer, and to form one or both of the planar terminals 446, 448 from the bottom metallization layer. The masking and etching process may be employed either before or after the vias 452, 454 are formed and plated. Each of the first set of cross-conductors 456 establishes physical and electrical contact with the lower electrode 436 and the first terminal 446, while being electrically isolated from the upper electrode 434 by the upper isolation area 438. Similarly, each of the second set of cross-conductors 458 establishes physical and electrical contact with the upper electrode 434 and the second terminal 448, while being electrically isolated from the lower electrode 436 by the lower isolation area 440. Thus, the first terminal 446 is in electrical contact with the lower electrode 436 through the first cross-conductor 456, while the second terminal 448 is in electrical contact with the upper electrode 434 through the second cross-conductor 458. The exposed metal areas, particularly the terminals 446, 448, the cross-conductors 456, 458, and optionally the anchor pad 460 and the optional indicia 450 (if present) may advantageously be over-plated with one or more solderable metal layers, such as, for example, nickel and gold ENIG plating, or electroless tin plating. Alternatively, the over-plating may be electroplated nickel and gold, electroplated nickel and tin, or just electroplated tin, applied immediately after the copper plating step.

The upper and lower ends of the first cross-conductor 456 are respectively anchored by their connection to the anchor pad 460 and the first terminal 446. The upper and lower ends of the second cross-conductor 458 are respectively anchored by their connection to the upper electrode 434 and the second terminal 448.

Figure 11A:
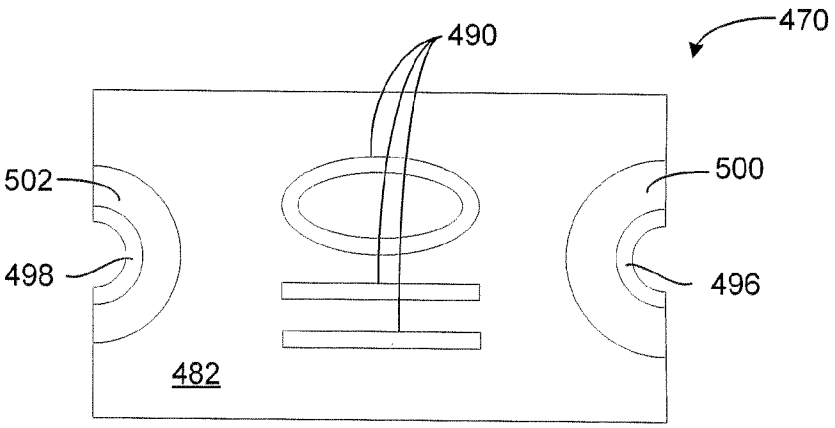
FIGS. 11A, 11B, and 11C are a top plan view, a cross-sectional view, and a bottom plan view, respectively, of a dual active layer conductive polymer device, in accordance with the fifth embodiment of the present invention.
Figure 11C:
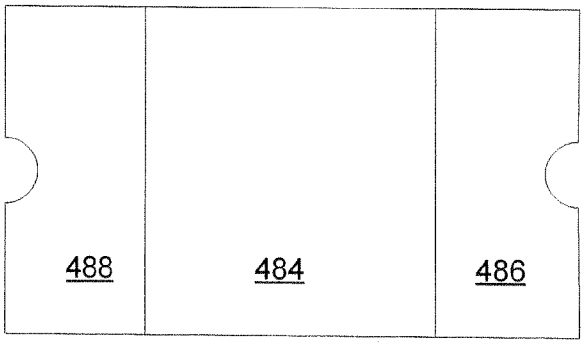
Figure 11B:
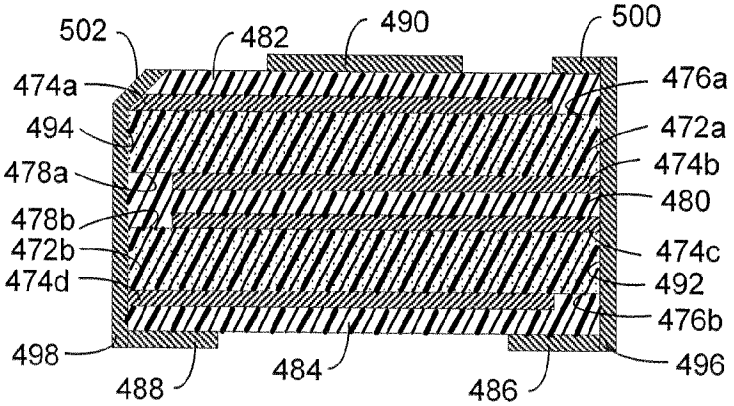

FIGS. 11A, 11B, and 11C illustrate a multiple active layer device 470 that is a variant of the embodiment of FIGS. 10A-10C, wherein the multiple active layer device 470 comprises at least a first active layer 472*a* and a second active layer 472*b*, of conductive polymer material, connected in parallel, and arranged in a vertically-stacked configuration, using only a single pair of surface-mount terminals. The first active layer 472*a* is laminated between first and second metal foil electrodes 474*a*, 474*b* in a first laminated sheet structure, and the second active layer 472*b* is laminated between third and fourth metal foil electrodes 474*c*, 474*d* in a second laminated sheet structure, each of the sheet structures being of the type described above and shown in FIGS. 1A and 1B. The first and second pluralities of via locations are defined as described above. The first or upper electrode 474*a* is formed (by photo-resist masking and etching) with an arcuate upper isolation area 476*a* between the first electrode 474*a* and a first end of the device 470, adjacent a first through-hole via 492. Similarly, the fourth or lower electrode 474*d* is likewise formed with an arcuate lower isolation area 476*b* between the fourth electrode 476*d* and the first end of the device 470. The second and third (intermediate) electrodes 474*b*, 474*c* are similarly formed with intermediate arcuate isolation areas 478*a*, 478*b* between the intermediate electrodes 474*b*, 474*c* and the second end of the device 470. The first and second laminated sheet structures are then laminated together into a multiple active layer laminated structure by an intermediate insulative layer 480 (prepreg, polymer, or epoxy), so that the upper and lower isolation areas 476*a*, 476*b* are aligned at a first end of the structure, and the intermediate isolation areas 478*a*, 478*b* are aligned at the opposite end of the structure. The intermediate isolation areas 478*a*, 478*b* are filled by the intermediate insulative layer 480.

A top insulation layer 482, which may be of prepreg, an insulative polymer, or an epoxy, is applied to the exposed surface of the first electrode 474*a*, and a bottom insulation layer 484, of similar material, is applied to the exposed surface of the fourth electrode 474*d*. The top insulation layer 482 fills the upper isolation area 476*a*, while the bottom insulation layer 484 fills the lower isolation area 476*b*. A bottom metallization layer, preferably a copper foil, is applied to the exposed surface of the bottom insulation layer 484, and it is photo-resist masked and etched to form first and second surface mount terminals 486, 488 separated by an exposed area of the bottom insulation layer 484. Similarly, a top metallization layer, preferably a copper foil, is applied to the top insulation layer 482, and it is photo-resist masked and etched to form an anchor pad 500 and (optionally) identification indicia 490. The photo-resist masking and etching of the top and bottom metallization layers may be performed either before or after the vias 492, 494 are formed and plated, as described below. The top metallization layer and the top insulation layer 482 may be pre-formed and applied as a laminate, or they may be applied separately in sequence. Likewise, the bottom metallization layer and the bottom insulation layer 484 may be applied either together as a pre-formed laminate, or separately in sequence. In either case, the result is a multiple active layer laminated structure comprising first and second active polymer layers 472*a*, 472*b*, a first or upper electrode 474*a*, intermediate second and third electrodes 474*b*, 474*c*, a fourth or lower electrode 474*d*, an intermediate insulation layer 480, a top insulation layer 482, a bottom insulation layer 484, a bottom metallization layer, and a top metallization layer. The top and bottom metallization layers may be formed into the anchor pad 500, the indicia 490, and the terminals 486, 488.

A first through-hole via 492 is formed through the entire thickness of the above-described multiple active layer laminated structure (e.g. by mechanical or laser drilling) at each of the first plurality of via locations, and a second through-hole via 494 is similarly (and, preferably, simultaneously) formed through the entire thickness of the structure at each of the second plurality of via locations. Thus, each device 470 has a first through-hole via 492 at a first end, and a second through-hole via 494 at the opposite end. At this point, the top entrance or opening of the second via 494 is chamfered or beveled by any suitable mechanical or chemical means, such as, for example, a drill with a conical drill bit (not shown), to form a chamfered or beveled entry hole 502 for the second via 494. The chamfered or beveled entry hole 502 extends through the top insulation layer 482 to the second via 494, either adjacent to or through an end of the first or upper electrode 474*a*. Although it is preferred to drill the vias 492, 494 first, and then to form the chamfered or beveled entry hole 502, the chamfered entry hole 502 may be formed at the pre-defined via locations before the second vias 492, 494 are drilled.

The top and bottom surfaces of the structure and the inside surfaces of the through-hole vias 492, 494, including the chamfered or beveled entry hole 502 of each of the second vias 494, are plated with one or more layers of conductive metal, preferably copper, thereby forming a first set of cross-conductors 496 within each of the first set of vias 492, and a second set of cross-conductors 498 within each of the second set of vias 494. A photo-resist masking and etching process is employed to form the anchor pad 500 and the optional indicia 490 from the top metallization layer, and to form the planar terminals 486, 488 from the bottom metallization layer. The masking and etching process may be employed either before or after the vias 492, 494 are formed and plated. Each of the first set of cross-conductors 496 establishes physical and electrical contact with the second and third (intermediate) electrodes 474*b*, 474*c*, the anchor pad 500, and the first planar terminal 486, while being electrically isolated from the first (upper) electrode 474*a* by the upper isolation area 476*a*, and from the fourth (lower) electrode 474*d* by the lower isolation layer 476*b*. Similarly, each of the second set of cross-conductors 498 establishes physical and electrical contact with the first (upper) electrode 474*a*, the fourth (lower) electrode 474*d*, and the second planar terminal 488, while being electrically isolated from the second and third (intermediate) electrodes 474*b*, 474*c* by the intermediate isolation areas 478*a*, 478*b*. The first terminal 486 is in electrical contact with the second and third (intermediate) electrodes 474*b*, 474*c* through the first cross-conductor 496, while the second terminal 488 is in electrical contact with the first (upper) electrode 474*a* and the fourth (lower) electrode 474*d* through the second cross-conductor 498.

The upper and lower ends of the first cross-conductor 496 are respectively anchored by their connection to the anchor pad 500 and the first planar terminal 486. The upper and lower ends of the second cross-conductor 498 are respectively anchored by their connection to the upper electrode 474*a* and the lower second terminal 488. The exposed metal areas, particularly the terminals 486, 488, the cross-conductors 496, 498, and optionally the anchor pad 500 and the optional indicia 490 (if present) may advantageously be over-plated with one or more solderable metal layers, such as, for example, nickel and gold ENIG plating, or electroless tin plating. Alternatively, the over-plating may be electroplated nickel and gold, electroplated nickel and tin, or electroplated tin, applied immediately after the copper plating step.

Figure 12A:
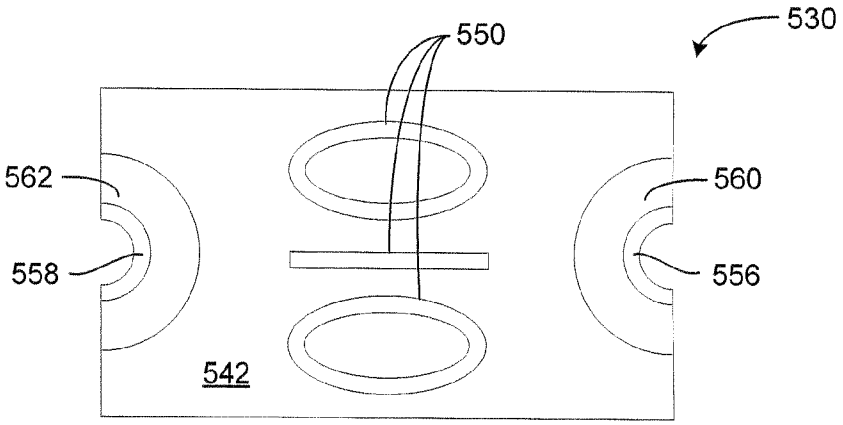
FIGS. 12A, 12B, and 12C are a top plan view, a cross-sectional view, and a bottom plan view, respectively, of a single active layer conductive polymer device in accordance with a sixth embodiment of the present invention.
Figure 12C:
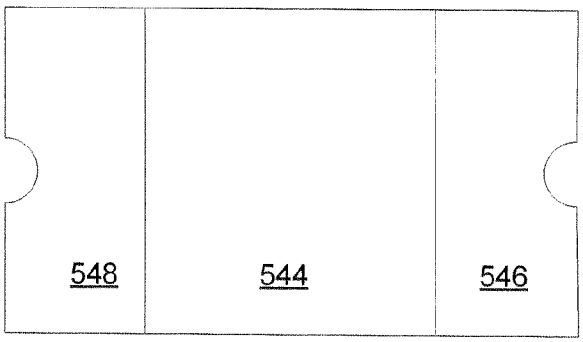
Figure 12B:
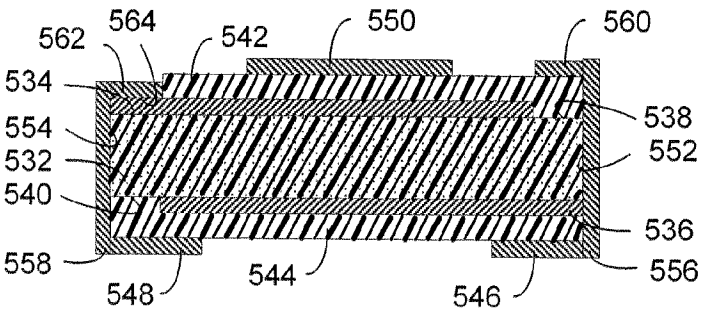

FIGS. 12A, 12B, and 12C illustrate a conductive polymer device 530, in accordance with a sixth embodiment of the present invention. The device 530 includes a single active layer 532 of conductive polymer material, laminated between an upper metal foil electrode 534 and a lower foil electrode 536. This embodiment is similar to the embodiment of FIGS. 10A-10C, except that instead of a chamfered or beveled entry hole for the via at the end of the device opposite the anchor pad, there is provided a plated anchor element, as will be described below, by the removal of part of the top insulation layer.

Specifically, the device 530 includes an arcuate upper isolation area 538 between the upper electrode 534 and a first end of the device 530, adjacent a first through-hole via 552. The device 530 also includes an arcuate lower isolation area 540 between the lower electrode 536 and the opposite end of the device 530, adjacent a second through-hole via 554. A top insulation layer 542 is formed or applied on the exposed surface of the upper electrode 534, filling in the upper isolation area 538, and a bottom insulation layer 544 is similarly formed or applied on the exposed surface of the lower electrode 536, filling in the lower isolation area 540. A bottom metallization layer, preferably a copper foil, is applied to the exposed surface of the bottom insulation layer to form first and second surface mount terminals 546, 548, as will be described below. Similarly, a top metallization layer, preferably a copper foil, is applied to the top insulation layer 542 to form an anchor pad 560 and (optionally) identification indicia 550, as also described below. The top metallization layer and the top insulation layer 542 may be pre-formed and applied as a laminate, or they may be applied separately in sequence. Likewise, the bottom metallization layer and the bottom insulation layer 544 may be applied either together as a pre-formed laminate, or separately in sequence. In either case, the result is a laminated structure comprising a single active polymer layer 532, an upper electrode 534, a lower electrode 536, a top insulation layer 542, a bottom insulation layer 544, a bottom metallization layer, and a top metallization layer.

A first through-hole via 552 is formed through the entire thickness of the above-described laminated structure (e.g. by mechanical or laser drilling) at each of the first plurality of via locations, and a second through-hole via 554 is similarly (and, preferably, simultaneously) formed through the entire thickness of the laminated structure at each of the second plurality of via locations. Thus, each device 530 has a first through-hole via 552 at a first end, and a second through-hole via 554 at the opposite end. An arcuate portion of the top insulation layer 542 adjacent the second via 554 is then removed by any suitable process, such as chemical etching, plasma etching, mechanical drilling or laser drilling, to form an exposed anchor surface 564 on the upper electrode 534, the purpose of which will be discussed below. Although it is preferred to drill the vias 552, 554 first, and then to form the anchor surface 564, the anchor surface 564 may be formed at the pre-defined second via locations before the vias 552, 554 are drilled.

The top and bottom surfaces of the structure and the inside surfaces of the through-hole vias 552, 554, as well as the anchor surface 564, are plated with one or more layers of conductive metal, preferably copper, thereby forming a first set of cross-conductors 556 within each of the first set of vias 552, a second set of cross-conductors 558 within each of the second set of vias 554, and a plated anchor element 562 on the anchor surface 564, wherein the plated anchor element 562 is contiguous with the second cross-conductor 558. A photo-resist masking and etching process is employed to form the anchor pad 560 adjacent the first through-hole via 552 (as well as the optional indicia 550) from the top metallization layer, and to form the planar terminals 546, 548 from the bottom metallization layer. The masking and etching process may be employed either before or after the vias 552, 554 are formed and plated. Each of the first set of cross-conductors 556 establishes physical and electrical contact with the lower electrode 536 and the first terminal 546, while being electrically isolated from the upper electrode 534 by the upper isolation area 538. Similarly, each of the second set of cross-conductors 558 establishes physical and electrical contact with the upper electrode 534 and the second terminal 548, while being electrically isolated from the lower electrode 536 by the lower isolation area 540. Thus, the first terminal 546 is in electrical contact with the lower electrode 536 through the first cross-conductor 556, while the second terminal 548 is in electrical contact with the upper electrode 534 through the second cross-conductor 558. The exposed metal areas, particularly the terminals 546, 548, the cross-conductors 556, 558, the anchor pad 560, and the plated anchor element 562 (and the indicia 550, if present), may advantageously be over-plated with one or more solderable metal layers, such as, for example, nickel and gold ENIG plating ore electroless tin plating. Alternatively, the over-plating may be electroplated nickel and gold, electroplated nickel and tin, or electroplated tin, applied immediately after the copper plating step.

The upper and lower ends of the first cross-conductor 556 are respectively anchored by their connection to the anchor pad 560 and the first terminal 546. The upper end of the second cross-conductor 558 is anchored by its connection to the upper electrode 534 and to the anchor element 562, while the lower end of the second cross-conductor is anchored by its connection to the second terminal 548. The anchor element 562 provides a more intimate and secure connection and contact between the second cross-conductor 558 and the exposed anchor surface 564 on the upper electrode 534 than that established by a cross-conductor formed through a straight via, such as shown in FIGS. 3A-3C, for example. This enhances the structural integrity of the device without unduly restraining the thermal expansion of the polymeric active layer 532.

Figure 13A:
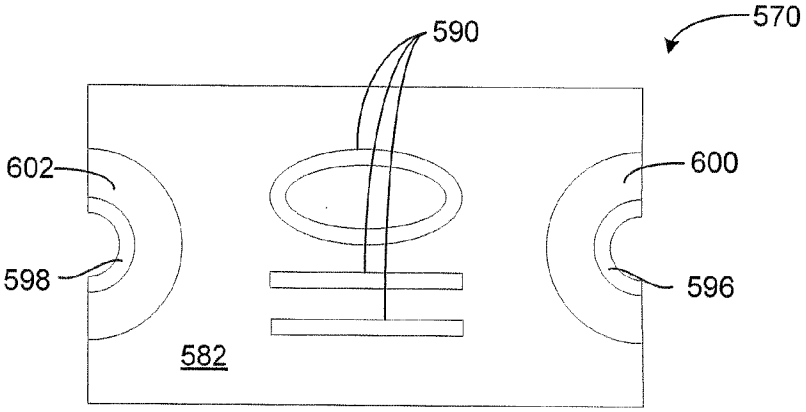
FIGS. 13A, 13B, and 13C are a top plan view, a cross-sectional view, and a bottom plan view, respectively, of a dual active layer conductive polymer device, in accordance with the sixth embodiment of the present invention.
Figure 13C:
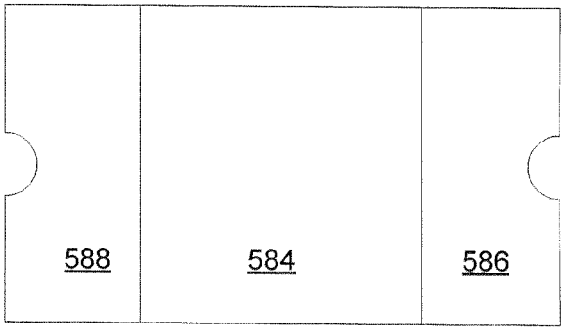
Figure 13B:
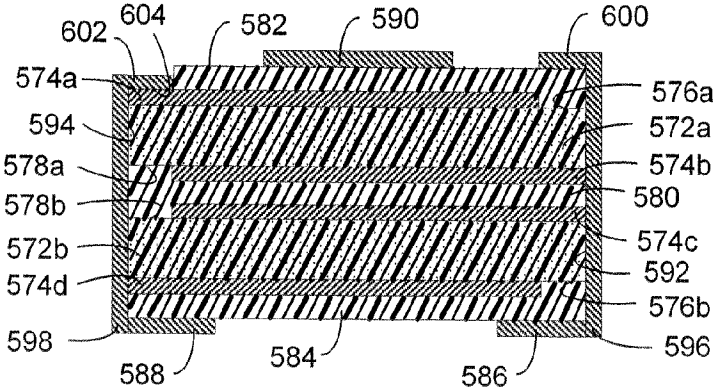

FIGS. 13A, 13B, and 13C illustrate a multiple active layer device 570 that is a variant of the embodiment of FIGS. 12A-12C, wherein the multiple active layer device 570 comprises at least a first active layer 572*a* and a second active layer 572*b*, of conductive polymer material, connected in parallel, and arranged in a vertically-stacked configuration with only a single pair of surface-mount terminals. The first active layer 572*a* is laminated between first and second metal foil electrodes 574*a*, 574*b* in a first laminated sheet structure, and the second active layer 572*b* is laminated between third and fourth metal foil electrodes 574*c*, 574*d* in a second laminated sheet structure, each of the sheet structures being of the type described above and shown in FIGS. 1A and 1B. The first and second pluralities of via locations are defined as described above. The first or upper electrode 574*a* is formed (by photo-resist masking and etching) with an arcuate upper isolation area 576*a* between the first electrode 574*a* and a first end of the device 570, adjacent a first through-hole via 592. Similarly, the fourth or lower electrode 574*d* is likewise formed with an arcuate lower isolation area 576*b* between the fourth electrode 574*d* and the first end of the device 570, adjacent the first through-hole via 592. The second and third (intermediate) electrodes 574*b*, 574*c* are similarly formed with intermediate arcuate isolation areas 578*a*, 578*b* between the intermediate electrodes 574*b*, 574*c* and the second end of the device 570, adjacent a second through-hole via 594. The first and second laminated sheet structures are then laminated together into a multiple active layer laminated structure by an intermediate insulative layer 580 (prepreg, polymer, or epoxy), so that the upper and lower isolation areas 576*a*, 576*b* are aligned at a first end of the structure, and the intermediate isolation areas 578*a*, 578*b* are aligned at the opposite end of the structure. The intermediate isolation areas 578*a*, 578*b* are filled by the intermediate insulative layer 580.

A top insulation layer 582, which may be of prepreg, an insulative polymer, or an epoxy, is applied to the exposed surface of the first electrode 574*a*, and a bottom insulation layer 584, of similar material, is applied to the exposed surface of the fourth electrode 574*d*. The top insulation layer 582 fills the upper isolation area 576*a*, while the bottom insulation layer 584 fills the lower isolation area 576*b*. A bottom metallization layer, preferably a copper foil, is applied to the exposed surface of the bottom insulation layer 584, and it is photo-resist masked and etched to form first and second surface mount terminals 586, 588 separated by an exposed area of the bottom insulation layer 584. Similarly, a top metallization layer, preferably a copper foil, is applied to the top insulation layer 582, and it is photo-resist masked and etched to form an anchor pad 600 and (optionally) identification indicia 590. The photo-resist masking and etching of the top and bottom metallization layers may be performed either before or after the vias 592, 594 are formed and plated, as described below. The top metallization layer and the top insulation layer 582 may be pre-formed and applied as a laminate, or they may be applied separately in sequence. Likewise, the bottom metallization layer and the bottom insulation layer 584 may be applied either together as a pre-formed laminate, or separately in sequence. In either case, the result is a multiple active layer laminated structure comprising first and second active polymer layers 572*a*, 572*b*, a first or upper electrode 574*a*, intermediate second and third electrodes 574*b*, 574*c*, a fourth or lower electrode 574*d*, an intermediate insulation layer 580, a top insulation layer 582, a bottom insulation layer 584, a bottom metallization layer, and a top metallization layer. The top metallization layer is formed into the anchor pad 600 and the optional indicia 590, and the bottom metallization layer is formed into the planar terminals 586, 588, by any conventional process, such as photo-resist masking and etching, which may be performed either before or after the formation and plating of the vias, as described below.

A first through-hole via 592 is formed through the entire thickness of the above-described multiple active layer laminated structure (e.g. by mechanical or laser drilling) at each of the first plurality of via locations, and a second through-hole via 594 is similarly (and, preferably, simultaneously) formed through the entire thickness of the structure at each of the second plurality of via locations. Thus, each device 570 has a first through-hole via 592 at a first end, and a second through-hole via 594 at the opposite end. An arcuate portion of the top insulation layer 582 adjacent the second via 594 is then removed by any suitable process, such as chemical etching, plasma etching, mechanical drilling or laser drilling, to form an exposed anchor surface 604 on the upper electrode 574*a*, the purpose of which will be discussed below. Although it is preferred to drill the vias 592, 594 first, and then to form the anchor surface 604, the anchor surface 604 may be formed at the pre-defined second via locations before the vias 592, 594 are drilled.

The top and bottom surfaces of the structure and the inside surfaces of the through-hole vias 592, 594, as well as the anchor surface 604, are plated with one or more layers of conductive metal, preferably copper, thereby forming a first set of cross-conductors 596 within each of the first set of vias 592, a second set of cross-conductors 598 within each of the second set of vias 594, and a plated anchor element 602 on the anchor surface 604, wherein the plated anchor element 602 is contiguous with the second cross-conductor 598. At this point, a photo-resist masking and etching process is employed to form the anchor pad 600 adjacent the first through-hole via 592 (as well as the optional indicia 590) from the top metallization layer, and to form the planar terminal pads 586, 588 from the bottom metallization layer. The masking and etching process may be performed either before or after the vias 592, 594 are formed and plated. Each of the first set of cross-conductors 596 establishes physical and electrical contact with the second and third (intermediate) electrodes 574*b*, 574*c*, the anchor pad 600, and the first planar terminal 586, while being electrically isolated from the first (upper) electrode 574*a* by the upper isolation area 576*a*, and from the fourth (lower) electrode 574*d* by the lower isolation layer 576*b*. Similarly, each of the second set of cross-conductors 598 establishes physical and electrical contact with the first (upper) electrode 574*a*, the fourth (lower) electrode 574*d*, and the second planar terminal 588, while being electrically isolated from the second and third (intermediate) electrodes 574*b*, 574*c* by the intermediate isolation areas 578*a*, 578*b*. The first terminal 586 is in electrical contact with the second and third (intermediate) electrodes 574*b*, 574*c* through the first cross-conductor 596, while the second terminal 588 is in electrical contact with the first (upper) electrode 574*a* and the fourth (lower) electrode 574*d* through the second cross-conductor 598.

The upper and lower ends of the first cross-conductor 596 are respectively anchored by their connection to the anchor pad 600 and the first planar terminal 586. The upper end of the second cross-conductor 598 is anchored by its connection to the upper electrode 574*a* and to the anchor element 602, while the lower end of the second cross-conductor is anchored by its connection to the lower second terminal 588. The exposed metal areas, particularly the terminals 586, 588, the cross-conductors 596, 598, the anchor pad 600, and the plated anchor element 602 (and the indicia 590, if present), may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 14A:
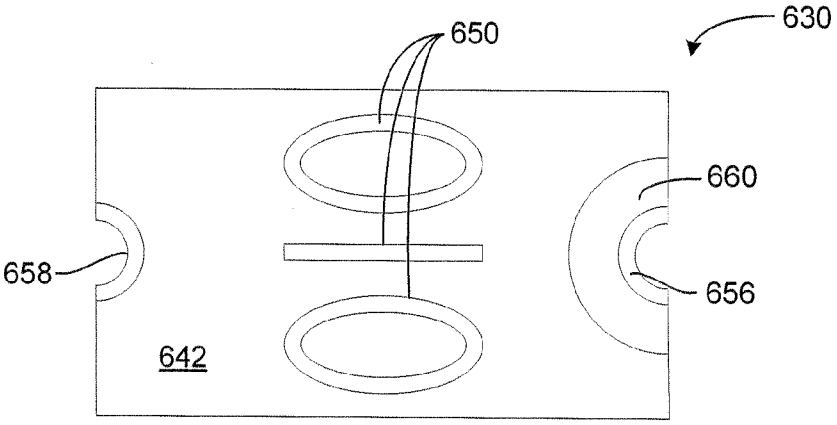
FIGS. 14A, 14B, and 14C are a top plan view, a cross-sectional view, and a bottom plan view, respectively, of a single active layer conductive polymer device in accordance with a seventh embodiment of the present invention.
Figure 14C:
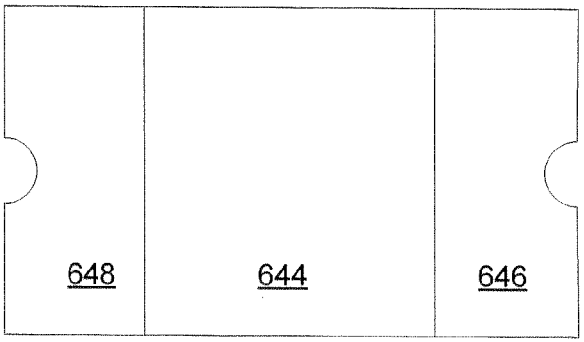
Figure 14B:
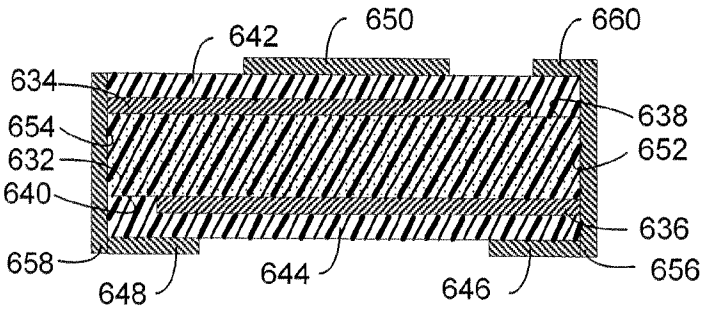

FIGS. 14A, 14B, and 14C illustrate a conductive polymer device 630, in accordance with a seventh embodiment of the present invention. The device 630 differs from the above-described embodiment of FIGS. 8A-8C in that it has only one anchor pad on a top insulation layer. The device 630 includes a single active layer 632 of conductive polymer material, laminated between an upper metal foil electrode 634 and a lower foil electrode 636. First and second pluralities of through-hole via locations are defined in the sheet structure 10 (FIG. 1A). Each via location in the first plurality is separated from a corresponding via location in the second plurality by a pre-defined distance that corresponds to the length of a single device 630. An arcuate area of the upper electrode 634 adjacent each of the first via locations is removed (e.g., by conventional photo-resist masking and etching) to create an upper isolation area 638 at a first end of the upper electrode 634. Similarly, an arcuate area of the lower electrode 636 adjacent each of the second via locations is removed to create a lower isolation area 640 at the opposite end of the second electrode 636.

A top insulation layer 642, which may be of prepreg, an insulative polymer, or an epoxy, is applied to the exposed surface of the upper electrode 634, and a bottom insulation layer 644, of similar material, is applied to the exposed surface of the lower electrode 636. The top insulation layer 642 fills the upper isolation area 638, while the bottom insulation layer 644 fills the lower isolation area 640. A bottom metallization layer, preferably a copper foil, is applied to the exposed surface of the bottom insulation layer to form first and second surface mount terminals 646, 648, as will be described below. Similarly, a top metallization layer, preferably a copper foil, is applied to the top insulation layer 642 to form an anchor pad 660, and (optionally) identification indicia 650, as discussed below. The top metallization layer and the top insulation layer 642 may be pre-formed and applied as a laminate, or they may be applied separately in sequence. Likewise, the bottom metallization layer and the bottom insulation layer 644 may be applied either together as a pre-formed laminate, or separately in sequence. In either case, the result is a laminated structure comprising a single active polymer layer 632, an upper electrode 634, a lower electrode 636, a top insulation layer 642, a bottom insulation layer 644, a bottom metallization layer, and a top metallization layer.

A first through-hole via 652 is formed through the entire thickness of the above-described laminated structure (e.g. by mechanical or laser drilling) at each of the first plurality of via locations, and a second through-hole via 654 is similarly (and, preferably, simultaneously) formed through the entire thickness of the laminated structure at each of the second plurality of via locations. Thus, each device 630 has a first through-hole via 652 at a first end, and a second through-hole via 654 at the opposite end.

At this point, the top and bottom surfaces of the structure and the inside surfaces of the through-hole vias 652, 654 are plated with one or more layers of conductive metal, preferably copper, thereby forming a first set of cross-conductors 656 within each of the first set of vias 652, and a second set of cross-conductors 658 within each of the second set of vias 654. A photo-resist masking and etching process is employed to form anchor pad 660, and the optional indicia 650 from the top metallization layer, and to form the planar terminals 646, 648, from the bottom metallization layer. The masking and etching process may be employed either before or after the vias 652, 654 are formed and plated. Each of the first set of cross-conductors 656 establishes physical and electrical contact with the lower electrode 636 and the first terminal 646, while being electrically isolated from the upper electrode 634 by the upper isolation area 638. Each of the first cross-conductors 656 also is physically connected to a first anchor pad 660, which serves, along with the first terminal 646, as an anchor point for the first cross-conductor 656. Similarly, each of the second set of cross-conductors 658 establishes physical and electrical contact with the upper electrode 634 and the second terminal 648, while being electrically isolated from the lower electrode 636 by the lower isolation area 640. The exposed metal areas, particularly the terminals 646, 648, the cross-conductors 656, 658, and optionally, the anchor pad 660 (and the optional indicia 650, if present), may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin applied immediately after the copper plating step.

Figure 15A:
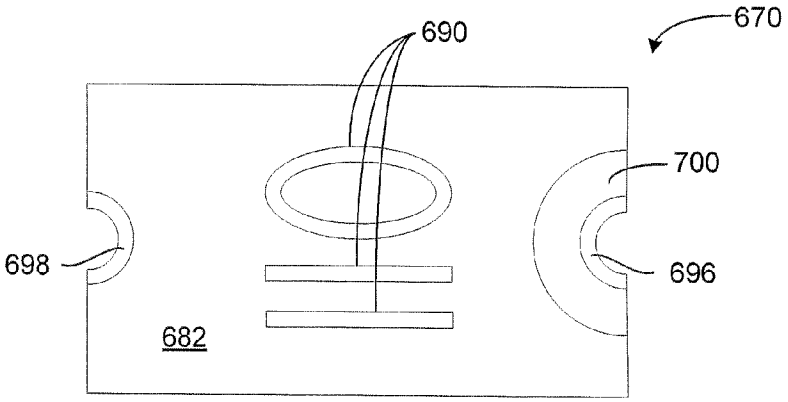
FIGS. 15A, 15B, and 15C are a top plan view, a cross-sectional view, and a bottom plan view, respectively, of a dual active layer conductive polymer device in accordance with the seventh embodiment of the present invention.
Figure 15C:
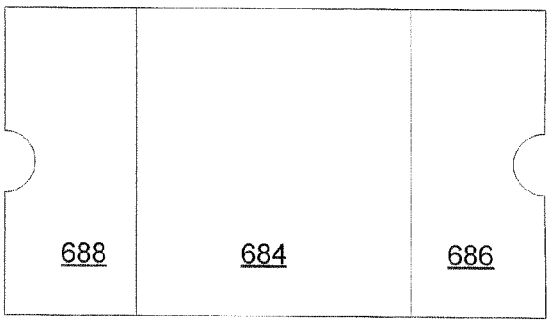
Figure 15B:
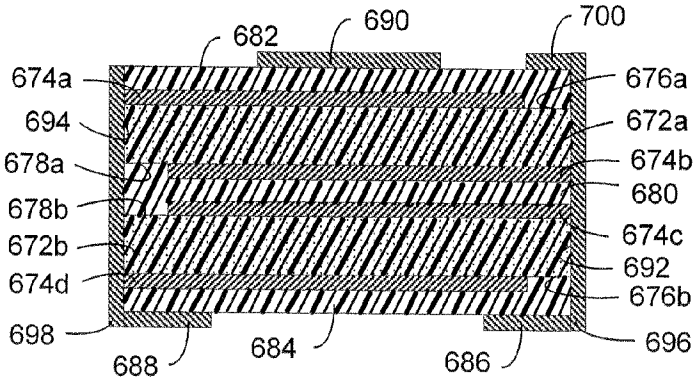

FIGS. 15A, 15B, and 15C illustrate a multiple active layer device 670 that is a variant of the embodiment of FIGS. 14A-14C, wherein the multiple active layer device 670 comprises at least a first active layer 672*a* and a second active layer 672*b*, of conductive polymer material, connected in parallel, and arranged in a vertically-stacked configuration with only a single pair of surface-mount terminals. The first active layer 672*a* is laminated between first and second metal foil electrodes 674*a*, 674*b* in a first laminated sheet structure, and the second active layer 672*b* is laminated between third and fourth metal foil electrodes 674*c*, 674*d* in a second laminated sheet structure, each of the sheet structures being of the type described above and shown in FIGS. 1A and 1B. The first and second pluralities of via locations are defined as described above. An arcuate area of the first and fourth electrode 674*a*, 674*d* adjacent each of the first via locations is removed (e.g., by conventional photo-resist masking and etching) to create an upper isolation area 676*a* and a lower isolation area 676*b* at a first end of the first and fourth electrodes 674*a*, 674*d*. Similarly, an arcuate area of the second and third electrodes 674*b*, 674*c* adjacent each of the second via locations is removed to create intermediate isolation areas 678*a*, 678*b* at the opposite ends of the second and third electrodes 674*b*, 674*c*. The first and second laminated sheet structures are then laminated together into a multiple active layer laminated structure by an intermediate insulative layer 680 (prepreg, polymer, or epoxy), so that the upper and lower isolation areas 676*a*, 676*b* are aligned at a first end of the structure, and the intermediate isolation areas 678*a*, 678*b* are aligned at the opposite end of the structure. The intermediate isolation areas 678*a*, 678*b* are filled by the intermediate insulative layer 680.

A top insulation layer 682, which may be of prepreg, an insulative polymer, or an epoxy, is applied to the exposed surface of the first electrode 674*a*, and a bottom insulation layer 684, of similar material, is applied to the exposed surface of the fourth electrode 674*d*. The top insulation layer 682 fills the upper isolation area 676*a*, while the bottom insulation layer 684 fills the lower isolation area 676*b*. A bottom metallization layer, preferably a copper foil, is applied to the exposed surface of the bottom insulation layer to form first and second surface mount terminals 686, 688, as will be described below. Similarly, a top metallization layer, preferably a copper foil, is applied to the top insulation layer 682 to form an anchor pad 700 and (optionally) identification indicia 690, as also described below. The top metallization layer and the top insulation layer 682 may be pre-formed and applied as a laminate, or they may be applied separately in sequence. Likewise, the bottom metallization layer and the bottom insulation layer 684 may be applied either together as a pre-formed laminate, or separately in sequence. In either case, the result is a multiple active layer laminated structure comprising first and second active polymer layers 672*a*, 672*b*, a first or upper electrode 674*a*, intermediate second and third electrodes 674*b*, 674*c*, a fourth or lower electrode 674*d*, an intermediate insulation layer 680, a top insulation layer 682, a bottom insulation layer 684, a bottom metallization layer, and a top metallization layer.

A first through-hole via 692 is formed through the entire thickness of the above-described multiple active layer laminated structure (e.g. by mechanical or laser drilling) at each of the first plurality of via locations, and a second through-hole via 694 is similarly (and, preferably, simultaneously) formed through the entire thickness of the structure at each of the second plurality of via locations. Thus, each device 670 has a first through-hole via 692 at a first end, and a second through-hole via 694 at the opposite end.

At this point, the top and bottom surfaces of the structure and the inside surfaces of the through-hole vias 692, 694 are plated with one or more layers of conductive metal, preferably copper, thereby forming a first set of cross-conductors 696 within each of the first set of vias 692, and a second set of cross-conductors 698 within each of the second set of vias 694. A photo-resist masking and etching process is employed to form anchor pad 700 and the optional indicia 690 from the top metallization layer, and to form the planar terminals 686, 688, from the bottom metallization layer. The masking and etching process may be employed either before or after the vias 692, 694 are formed and plated. Each of the first set of cross-conductors 696 establishes physical and electrical contact with the second and third (intermediate) electrodes 674*b*, 674*c* and the first terminal 686, while being electrically isolated from the first (upper) electrode 674*a* and from the fourth (lower) electrode 674*d* by the upper isolation area 676*a* and the lower isolation area 676*b*, respectively. The first cross-conductors 696 also is physically connected to a first anchor pad 700, which serves, along with the first terminal 686, as an anchor point for the first cross-conductor 696. Similarly, each of the second set of cross-conductors 698 establishes physical and electrical contact with the first (upper) electrode 674*a*, the fourth (lower) electrode 674*d*, and the second terminal 688, while being electrically isolated from the second and third (intermediate) electrodes 674*b*, 674*c* by the intermediate isolations area 678*a*, 678*b*. The exposed metal areas, particularly the terminals 686, 688, the cross-conductors 696, 698, and optionally, the anchor pad 700 (and the indicia 690, if present), may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating.

Figure 16A:
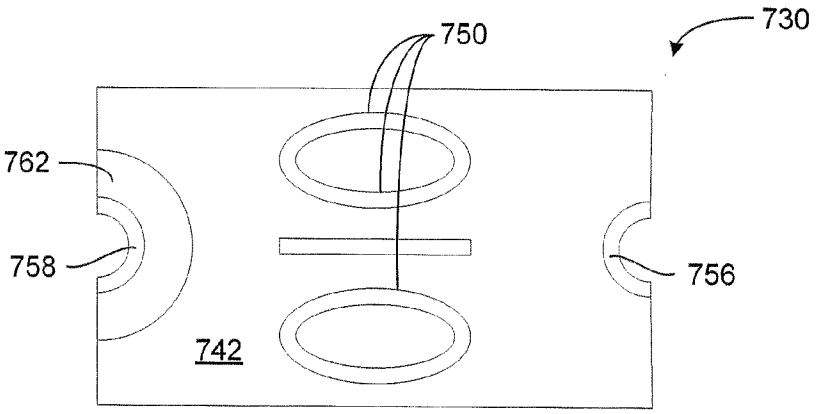
FIGS. 16A, 16B, and 16C are a top plan view, a cross-sectional view, and a bottom plan view, respectively, of a single active layer conductive polymer device in accordance with an eighth embodiment of the present invention.
Figure 16C:
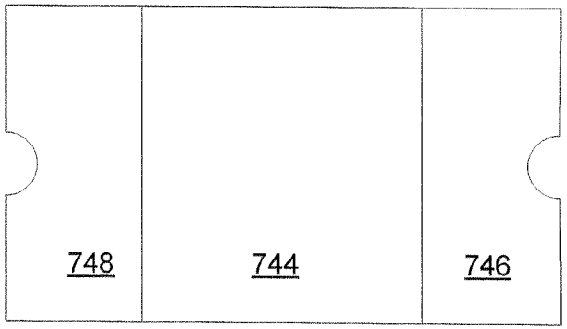
Figure 16B:
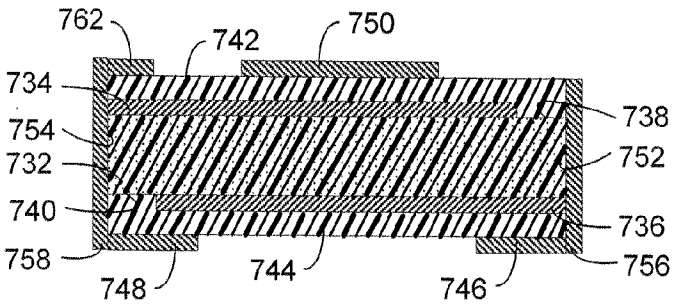

FIGS. 16A, 16B, and 16C illustrate a conductive polymer device 730, in accordance with an eighth embodiment of the present invention. This embodiment is similar to the embodiment of FIGS. 14A-14C, except that it has its anchor pad on other end of a top insulation layer. The device 730 includes a single active layer 732 of conductive polymer material, laminated between an upper metal foil electrode 734 and a lower foil electrode 736. First and second pluralities of through-hole via locations are defined in the sheet structure 10 (FIG. 1A). Each via location in the first plurality is separated from a corresponding via location in the second plurality by a pre-defined distance that corresponds to the length of a single device 730. An arcuate area of the upper electrode 734 adjacent each of the first via locations is removed (e.g., by conventional photo-resist masking and etching) to create an upper isolation area 738 at a first end of the upper electrode 734. Similarly, an arcuate area of the lower electrode 736 adjacent each of the second via locations is removed to create a lower isolation area 740 at the opposite end of the second electrode 736.

A top insulation layer 742, which may be of prepreg, an insulative polymer, or an epoxy, is applied to the exposed surface of the upper electrode 734, and a bottom insulation layer 744, of similar material, is applied to the exposed surface of the lower electrode 736. The top insulation layer 742 fills the upper isolation area 738, while the bottom insulation layer 744 fills the lower isolation area 740. A bottom metallization layer, preferably a copper foil, is applied to the exposed surface of the bottom insulation layer to form first and second surface mount terminals 746, 748, as will be described below. Similarly, a top metallization layer, preferably a copper foil, is applied to the top insulation layer 742 to form an anchor pad 762, and (optionally) identification indicia 750, as discussed below. The top metallization layer and the top insulation layer 742 may be pre-formed and applied as a laminate, or they may be applied separately in sequence. Likewise, the bottom metallization layer and the bottom insulation layer 744 may be applied either together as a pre-formed laminate, or separately in sequence. In either case, the result is a laminated structure comprising a single active polymer layer 732, an upper electrode 734, a lower electrode 736, a top insulation layer 742, a bottom insulation layer 744, a bottom metallization layer, and a top metallization layer.

A first through-hole via 752 is formed through the entire thickness of the above-described laminated structure (e.g. by mechanical or laser drilling) at each of the first plurality of via locations, and a second through-hole via 754 is similarly (and, preferably, simultaneously) formed through the entire thickness of the laminated structure at each of the second plurality of via locations. Thus, each device 730 has a first through-hole via 752 at a first end, and a second through-hole via 754 at the opposite end.

At this point, the top and bottom surfaces of the structure and the inside surfaces of the through-hole vias 752, 754 are plated with one or more layers of conductive metal, preferably copper, thereby forming a first set of cross-conductors 756 within each of the first set of vias 752, and a second set of cross-conductors 758 within each of the second set of vias 754. A photo-resist masking and etching process is employed to form the anchor pad 762, and the optional indicia 750 from the top metallization layer, and to form the planar terminals 746, 748, from the bottom metallization layer. The masking and etching process may be employed either before or after the vias 752, 754 are formed and plated. Each of the first set of cross-conductors 756 establishes physical and electrical contact with the lower electrode 736 and the first terminal 746, while being electrically isolated from the upper electrode 734 by the upper isolation area 738. Each of the first cross-conductors 756 also is physically connected to the anchor pad 762, which serves, along with the first terminal 746, as an anchor point for the first cross-conductor 756. Similarly, each of the second set of cross-conductors 758 establishes physical and electrical contact with the upper electrode 734 and the second terminal 748, while being electrically isolated from the lower electrode 736 by the lower isolation area 740. The exposed metal areas, particularly the terminals 746, 748, the cross-conductors 756, 758, and optionally, the anchor pad 762 (and the indicia 750, if present), may advantageously be over-plated with one or more additional metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 17A:
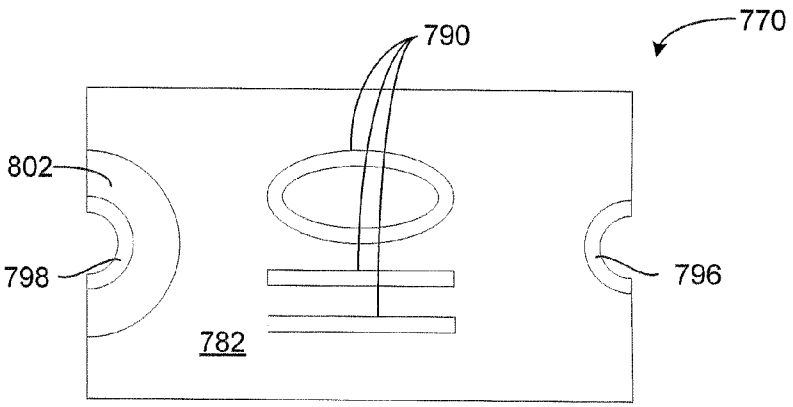
FIGS. 17A, 17*b*, and 17C are a top plan view, a cross-sectional view, and a bottom plan view, respectively, of a dual active layer conductive polymer device in accordance with the eighth embodiment of the present invention.
Figure 17C:
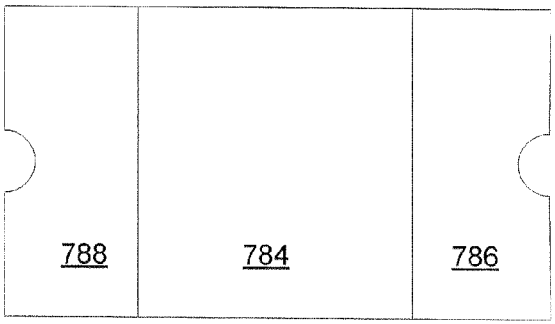
Figure 17B:
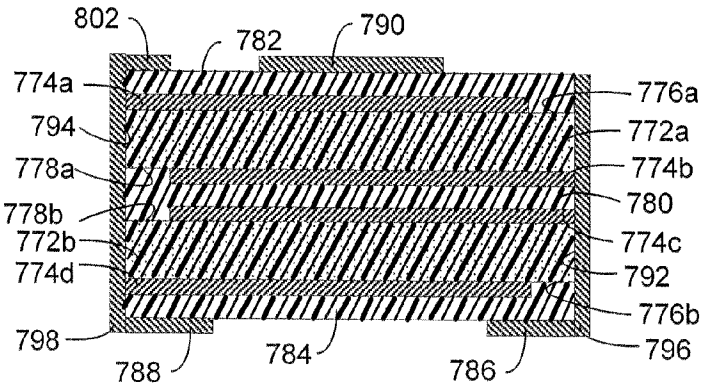

FIGS. 17A, 17B, and 17C illustrate a multiple active layer device 770 that is a variant of the embodiment of FIGS. 16A-16C, wherein the multiple active layer device 770 comprises at least a first active layer 772*a* and a second active layer 772*b*, of conductive polymer material, connected in parallel and arranged in a vertically-stacked configuration, using a single pair of surface-mount terminals. The first active layer 772*a* is laminated between first and second metal foil electrodes 774*a*, 774*b* in a first laminated sheet structure, and the second active layer 772*b* is laminated between third and fourth metal foil electrodes 774*c*, 774*d* in a second laminated sheet structure, each of the sheet structures being of the type described above and shown in FIGS. 1A and 1B. The first and second pluralities of via locations are defined as described above. An arcuate area of the first and fourth electrode 774*a*, 774*d* adjacent each of the first via locations is removed (e.g., by conventional photoresist masking and etching) to create an upper isolation area 776*a* and a lower isolation area 776*b* at a first end of the first and fourth electrodes 774*a*, 774*d*. Similarly, an arcuate area of the second and third electrodes 774*b*, 774*c* adjacent each of the second via locations is removed to create intermediate isolation areas 778*a*, 778*b* at the opposite ends of the second and third electrodes 774*b*, 774*c*. The first and second laminated sheet structures are then laminated together into a multiple active layer laminated structure by an intermediate insulative layer 780 (prepreg, polymer, or epoxy), so that the upper and lower isolation areas 776*a*, 776*b* are aligned at a first end of the structure, and the intermediate isolation areas 778*a*, 778*b* are aligned at the opposite end of the structure. The intermediate isolation areas 778*a*, 778*b* are filled by the intermediate insulative layer 780.

A top insulation layer 782, which may be of prepreg, an insulative polymer, or an epoxy, is applied to the exposed surface of the first electrode 774*a*, and a bottom insulation layer 784, of similar material, is applied to the exposed surface of the fourth electrode 774*d*. The top insulation layer 782 fills the upper isolation area 776*a*, while the bottom insulation layer 784 fills the lower isolation area 776*b*. A bottom metallization layer, preferably a copper foil, is applied to the exposed surface of the bottom insulation layer to form first and second surface mount terminals 786, 788, as will be described below. Similarly, a top metallization layer, preferably a copper foil, is applied to the top insulation layer 782 to form an anchor pad 802 and (optionally) identification indicia 790, as also described below. The top metallization layer and the top insulation layer 782 may be pre-formed and applied as a laminate, or they may be applied separately in sequence. Likewise, the bottom metallization layer and the bottom insulation layer 784 may be applied either together as a pre-formed laminate, or separately in sequence. In either case, the result is a multiple active layer laminated structure comprising first and second active polymer layers 772*a*, 772*b*, a first or upper electrode 774*a*, intermediate second and third electrodes 774*b*, 774*c*, a fourth or lower electrode 774*d*, an intermediate insulation layer 780, a top insulation layer 782, a bottom insulation layer 784, a bottom metallization layer, and a top metallization layer.

A first through-hole via 792 is formed through the entire thickness of the above-described multiple active layer laminated structure (e.g. by mechanical or laser drilling) at each of the first plurality of via locations, and a second through-hole via 794 is similarly (and, preferably, simultaneously) formed through the entire thickness of the structure at each of the second plurality of via locations. Thus, each device 770 has a first through-hole via 792 at a first end, and a second through-hole via 794 at the opposite end.

At this point, the top and bottom surfaces of the structure and the inside surfaces of the through-hole vias 792, 794 are plated with one or more layers of conductive metal, preferably copper, thereby forming a first set of cross-conductors 796 within each of the first set of vias 792, and a second set of cross-conductors 798 within each of the second set of vias 794. A photo-resist masking and etching process is employed to form anchor pad 802 and the optional indicia 790 from the top metallization layer, and to form the planar terminals 786, 788, from the bottom metallization layer. The masking and etching process may be employed either before or after the vias 792, 794 are formed and plated. Each of the first set of cross-conductors 796 establishes physical and electrical contact with the second and third (intermediate) electrodes 774*b*, 774*c* and the first terminal 786, while being electrically isolated from the first (upper) electrode 774*a* and from the fourth (lower) electrode 774*d* by the upper isolation area 776*a* and the lower isolation area 776*b*, respectively. Similarly, each of the second set of cross-conductors 798 establishes physical and electrical contact with the first (upper) electrode 774*a*, the fourth (lower) electrode 774*d*, and the second terminal 788, while being electrically isolated from the second and third (intermediate) electrodes 774*b*, 774*c* by the intermediate isolations area 778*a*, 778*b*. The second cross-conductors 798 also is physically connected to an anchor pad 802, which serves, along with the second terminal 788, as an anchor point for the second cross-conductor 796. The exposed metal areas, particularly the terminals 786, 788, the cross-conductors 796, 798, and optionally, the anchor pad 802 (and the indicia 790, if present), may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 18A:
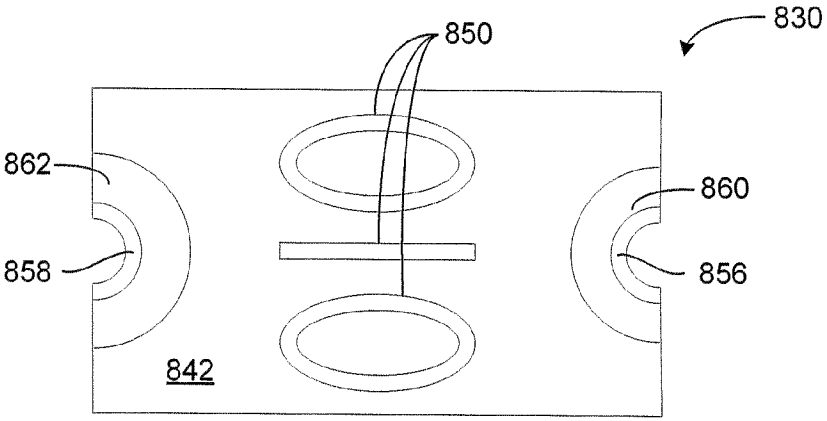
FIGS. 18A, 18B, and 18C are a top plan view, a cross-sectional view, and a bottom plan view, respectively, of a single active layer conductive polymer device in accordance with a ninth embodiment of the present invention.
Figure 18C:
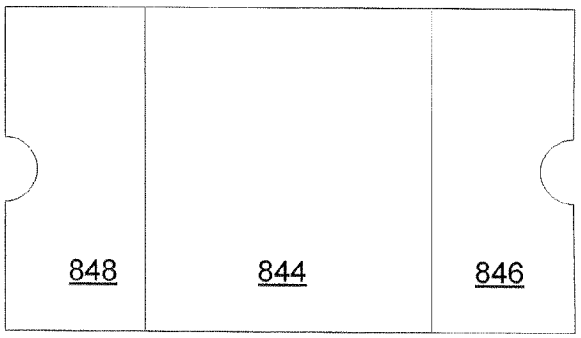
Figure 18B:
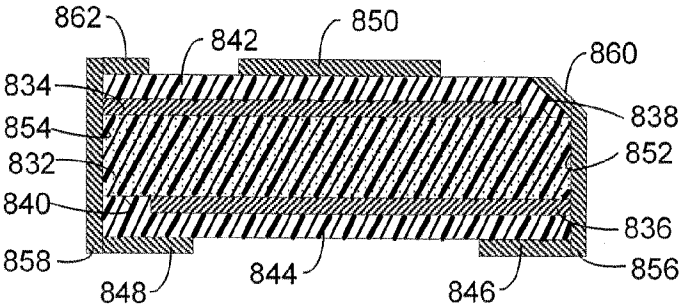

FIGS. 18A, 18B, and 18C illustrate a conductive polymer device 830, in accordance with a ninth embodiment of the present invention. This embodiment is similar to the embodiment of FIGS. 10A-10C, except that a chamfered entry hole for the via location and an anchor pad location are switched around (from one end to another). The device 830 includes a single active layer 832 of conductive polymer material, laminated between an upper metal foil electrode 834 and a lower foil electrode 836. In terms of structure, the device 830 includes an arcuate upper isolation area 838 between the upper electrode 834 and a first end of the device 830, adjacent a first through-hole via 852. The device also includes an arcuate lower isolation area 840 between the lower electrode 836 and the opposite end of the device 830, adjacent a second through-hole via 854. A top insulation layer 842 is formed or applied on the exposed surface of the upper electrode 834, filling in the upper isolation area 838, and a bottom insulation layer 844 is similarly formed or applied on the exposed surface of the lower electrode 836, filling in the lower isolation area 840. A bottom metallization layer 20 (FIGS. 1A, 1B), preferably a copper foil, is applied to the exposed surface of the bottom insulation layer to form first and second surface mount terminals 846, 848, as will be described below. Similarly, a top metallization layer 18 (FIGS. 1A, 1B), preferably a copper foil, is applied to the top insulation layer 842 to form an anchor pad 862 and (optionally) identification indicia 850, as also described below. The top metallization layer and the top insulation layer 842 may be pre-formed and applied as a laminate, or they may be applied separately in sequence. Likewise, the bottom metallization layer and the bottom insulation layer 844 may be applied either together as a pre-formed laminate, or separately in sequence. In either case, the result is a laminated structure comprising a single active polymer layer 832, an upper electrode 834, a lower electrode 836, a top insulation layer 842, a bottom insulation layer 844, a bottom metallization layer, and a top metallization layer.

A first through-hole via 852 is formed through the entire thickness of the above-described laminated structure (e.g. by mechanical or laser drilling) at each of the first plurality of via locations, and a second through-hole via 854 is similarly (and, preferably, simultaneously) formed through the entire thickness of the laminated structure at each of the second plurality of via locations. Thus, each device 830 has a first through-hole via 852 at a first end, and a second through-hole via 854 at the opposite end. At this point, the top entrance or opening of the first via 852 is chamfered or beveled by any suitable mechanism or process, such as, for example, a drill with a conical drill bit (not shown), to form a chamfered or beveled entry hole 860 for the first via 852. Although it is preferred to drill the vias 852, 854 first, and then to form the chamfered entry hole 860, the chamfered entry hole 860 may be formed at the pre-defined first via locations before the vias 852, 854 are drilled. The entry hole 860 extends through the upper insulation layer 842 and the upper isolation area 838.

The top and bottom surfaces of the structure and the inside surfaces of the through-hole vias 852, 854, including the chamfered entry 860, are plated with one or more layers of conductive metal, preferably copper, thereby forming a first set of cross-conductors 856 within each of the first set of vias 852, and a second set of cross-conductors 858 within each of the second set of vias 854. A photo-resist masking and etching process is employed to form the anchor pad 862 and the optional indicia 850 from the top metallization layer, and to form one or both of the planar terminals 846, 848 from the bottom metallization layer. The masking and etching process may be employed either before or after the vias 852, 854 are formed and plated. Each of the first set of cross-conductors 856 establishes physical and electrical contact with the lower electrode 836 and the first terminal 846, while being electrically isolated from the upper electrode 834 by the upper isolation area 838. Similarly, each of the second set of cross-conductors 858 establishes physical and electrical contact with anchor pad 862, the upper electrode 834 and the second terminal 848, while being electrically isolated from the lower electrode 836 by the lower isolation area 840. Thus, the first terminal 846 is in electrical contact with the lower electrode 836 through the first cross-conductor 856, while the second terminal 848 is in electrical contact with the upper electrode 834 through the second cross-conductor 858. The exposed metal areas, particularly the terminals 846, 848 and the cross-conductors 856, 858, the anchor pad 862, and optionally, the indicia 850 (if present) may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

The upper and lower ends of the second cross-conductor 858 are respectively anchored by their connection to the anchor pad 862 and the second terminal 848. The upper and lower ends of the first cross-conductor 856 are respectively anchored by their connection to the chamfered via entry hole 860 and the first terminal 846.

Figure 19A:
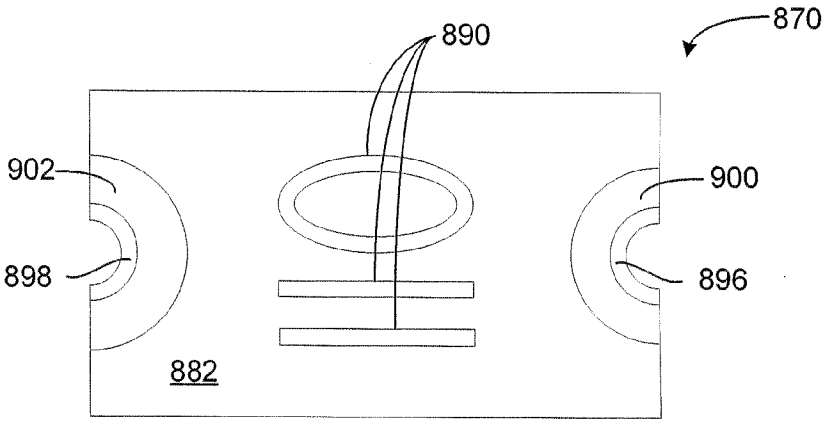
FIGS. 19A, 19*b*, and 19C are a top plan view, a cross-sectional view, and a bottom plan view, respectively, of a dual active layer conductive polymer device in accordance with the ninth embodiment of the present invention.
Figure 19C:
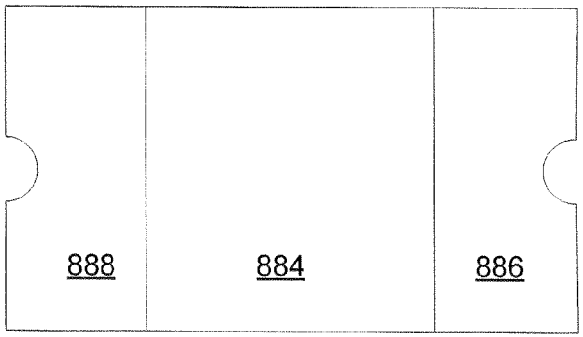
Figure 19B:
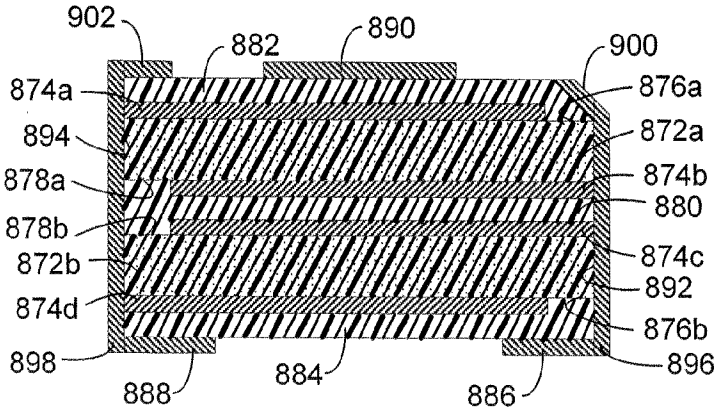

FIGS. 19A, 19B, and 19C illustrate a multiple active layer device 870 that is a variant of the embodiment of FIGS. 18A-18C, wherein the multiple active layer device 870 comprises at least a first active layer 872*a* and a second active layer 872*b*, of conductive polymer material, connected in parallel, and arranged in a vertically-stacked configuration using only a single pair of surface-mount terminals. The device 870 includes first and second active layers 872*a*, 872*b* of conductive polymer material. The first active layer 872*a* is laminated between first and second metal foil electrodes 874*a*, 874*b* in a first laminated sheet structure, and the second active layer 872*b* is laminated between third and fourth metal foil electrodes 874*c*, 874*d* in a second laminated sheet structure, each of the sheet structures being of the type described above and shown in FIGS. 1A and 1B. The first and second pluralities of via locations are defined as described above. The first or upper electrode 874*a* is formed (by photo-resist masking and etching) with an arcuate upper isolation area 876*a* between the first electrode 874*a* and a first end of the device 870, adjacent a first through-hole via 892. Similarly, the fourth or lower electrode 874*d* is likewise formed with an arcuate lower isolation area 876*b* between the fourth electrode 876*d* and the first end of the device 870. The second and third (intermediate) electrodes 874*b*, 874*c* are similarly formed with intermediate arcuate isolation areas 878*a*, 878*b* between the intermediate electrodes 874*b*, 874*c* and the second end of the device 870. The first and second laminated sheet structures are then laminated together into a multiple active layer laminated structure by an intermediate insulative layer 880 (prepreg, polymer, or epoxy), so that the upper and lower isolation areas 876*a*, 876*b* are aligned at a first end of the structure, and the intermediate isolation areas 878*a*, 878*b* are aligned at the opposite end of the structure. The intermediate isolation areas 878*a*, 878*b* are filled by the intermediate insulative layer 880.

A top insulation layer 882, which may be of prepreg, an insulative polymer, or an epoxy, is applied to the exposed surface of the first electrode 874*a*, and a bottom insulation layer 884, of similar material, is applied to the exposed surface of the fourth electrode 874*d*. The top insulation layer 882 fills the upper isolation area 876*a*, while the bottom insulation layer 884 fills the lower isolation area 876*b*. A bottom metallization layer, preferably a copper foil, is applied to the exposed surface of the bottom insulation layer 884, and it is photo-masked and etched to form first and second surface mount terminals 886, 888 separated by an exposed area of the bottom insulation layer 884. Similarly, a top metallization layer, preferably a copper foil, is applied to the top insulation layer 882, and it is photo-masked and etched to form an anchor pad 902 and (optionally) identification indicia 890. The photo-resist masking and etching of the top and bottom metallization layers may be performed either before or after the vias 892, 894 are formed and plated, as described below. The top metallization layer and the top insulation layer 882 may be pre-formed and applied as a laminate, or they may be applied separately in sequence. Likewise, the bottom metallization layer and the bottom insulation layer 884 may be applied either together as a pre-formed laminate, or separately in sequence. In either case, the result is a multiple active layer laminated structure comprising first and second active polymer layers 872*a*, 872*b*, a first or upper electrode 874*a*, intermediate second and third electrodes 874*b*, 874*c*, a fourth or lower electrode 874*d*, an intermediate insulation layer 880, a top insulation layer 882, a bottom insulation layer 884, a bottom metallization layer, and a top metallization layer. The top and bottom metallization layers may be formed into the anchor pad 902, the indicia 890, and the terminals 886, 888.

A first through-hole via 892 is formed through the entire thickness of the above-described multiple active layer laminated structure (e.g. by mechanical or laser drilling) at each of the first plurality of via locations, and a second through-hole via 894 is similarly (and, preferably, simultaneously) formed through the entire thickness of the structure at each of the second plurality of via locations. Thus, each device 870 has a first through-hole via 892 at a first end, and a second through-hole via 894 at the opposite end. At this point, the top entrance or opening of the first via 892 is chamfered by any suitable mechanical or chemical means, such as, for example, a drill with a conical drill bit (not shown), to form a chamfered or beveled entry hole 900 for the first via 892. Although it is preferred to drill the vias 892, 894 first, and then to form the chamfered entry hole 900, the chamfered entry hole 900 may be formed at the pre-defined via locations before the second vias 892, 894 are drilled. The entry hole 900 extends through the upper insulation layer 842 and the upper isolation area 876*a*.

The top and bottom surfaces of the structure and the inside surfaces of the through-hole vias 892, 894, including the chamfered entry hole 900 of each of the first vias 892, are plated with one or more layers of conductive metal, preferably copper, thereby forming a first set of cross-conductors 896 within each of the first set of vias 892, and a second set of cross-conductors 898 within each of the second set of vias 894. A photo-resist masking and etching process is employed to form the anchor pad 902 and the optional indicia 890 from the top metallization layer, and to form the planar terminals 886, 888 from the bottom metallization layer. The masking and etching process may be employed either before or after the vias 892, 894 are formed and plated. Each of the first set of cross-conductors 896 establishes physical and electrical contact with the second and third (intermediate) electrodes 874*b*, 874*c* and the first planar terminal 886, while being electrically isolated from the first (upper) electrode 874*a* by the upper isolation area 876*a*, and from the fourth (lower) electrode 874*d* by the lower isolation layer 876*b*. Similarly, each of the second set of cross-conductors 898 establishes physical and electrical contact with the first (upper) electrode 874*a*, the fourth (lower) electrode 874*d*, the anchor pad 902 and the second planar terminal 888, while being electrically isolated from the second and third (intermediate) electrodes 874*b*, 874*c* by the intermediate isolation areas 878*a*, 878*b*. The first terminal 886 is in electrical contact with the second and third (intermediate) electrodes 874*b*, 874*c* through the first cross-conductor 896, while the second terminal 888 is in electrical contact with the first (upper) electrode 874*a* and the fourth (lower) electrode 874*d* through the second cross-conductor 898.

The upper and lower ends of the first cross-conductor 896 are respectively anchored by their connection to the chamfered entry hole 900 and the first planar terminal 886. The upper and lower ends of the second cross-conductor 898 are respectively anchored by their connection to the anchor pad 902 and the lower second terminal 888. The exposed metal areas, particularly the terminals 886, 888, the cross-conductors 896, 898, and the anchor pad 902 (and the indicia 890, if present) may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 20A:
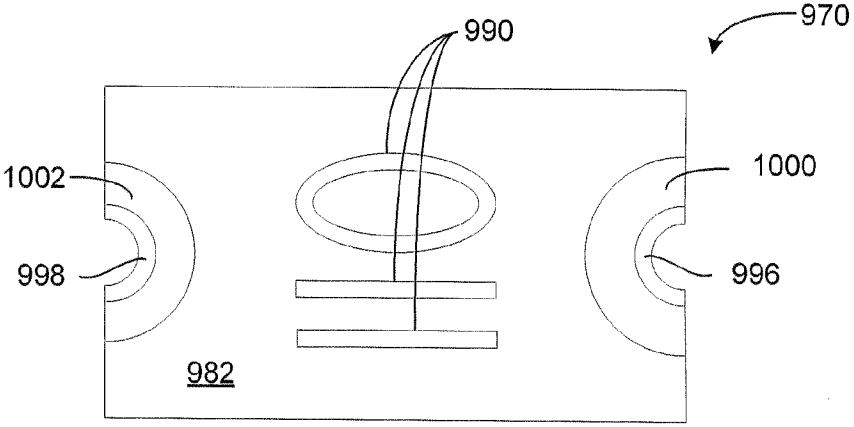
FIGS. 20A, 20B, and 20C are a top plan view, a cross-sectional view, and a bottom plan view, respectively, of a dual active layer conductive polymer device in accordance with a tenth embodiment of the present invention.
Figure 20C:
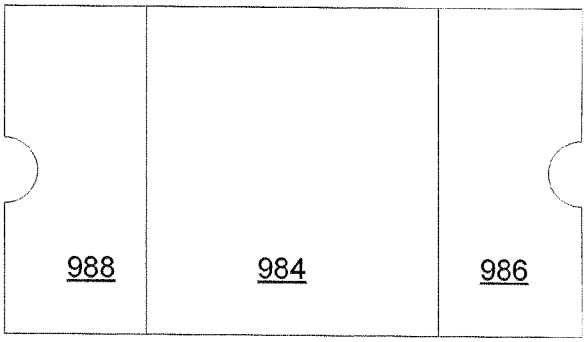
Figure 20B:
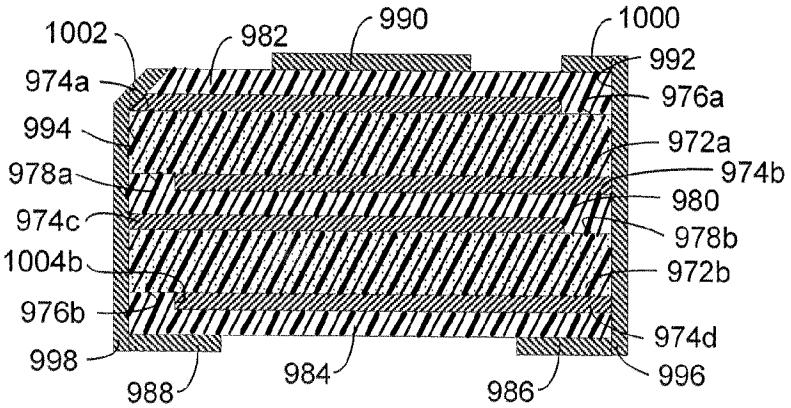

FIGS. 20A, 20B, and 20C illustrate a multiple active layer device 970, in accordance with a tenth embodiment of the present invention. The multiple active layer device 970 comprises at least a first active layer 972*a* and a second active layer 972*b*, of conductive polymer material, connected in parallel, and arranged in a vertically-stacked configuration using only a single pair of surface-mount terminals. The device 970 differs from the above-described devices principally in the arrangement of the electrodes with respect to the cross-conductors formed in the through-hole vias. The device 970 includes first and second active layers 972*a*, 972*b* of conductive polymer material. The first active layer 972*a* is laminated between first and second metal foil electrodes 974*a*, 974*b* in a first laminated sheet structure, and the second active layer 972*b* is laminated between third and fourth metal foil electrodes 974*c*, 974*d* in a second laminated sheet structure, each of the sheet structures being of the type described above and shown in conjunction of FIGS. 1A and 1B. The first and second pluralities of via locations are defined as described above. The foil layers forming the first or upper electrode 974*a* and the third electrode 974*c* are etched (e.g., by photo-resist masking and etching) to form arcuate an upper isolation area 976*a* and a first intermediate isolation area 978*a* respectively between each of the first and third electrodes 974*a*, 974*c* and a first end of the device 970, adjacent the location of a first through-hole via 992. Similarly, the foils forming the second electrode 974*b* and the fourth (lower) electrode 974*d* are provided with a second intermediate arcuate isolation area 978*b*, and a lower arcuate isolation area 976*b* respectively between the each of the second and fourth electrodes 974*b*, 974*d*, and the second end of the device 970, adjacent the location of a second through-hole via 994. The first and second laminated sheet structures are then laminated together into a multiple active layer laminated structure by an intermediate insulative layer 980 (prepreg, polymer, or epoxy), so that the upper and first intermediate isolation areas 976*a*, 978*a* are aligned at a first end of the structure, while the lower and second isolation areas 976*b*, 978*b* are aligned at the opposite end of the structure. The intermediate isolation areas 978*a*, 978*b* are filled by the intermediate insulative layer 980.

A top insulation layer 982, which may be of prepreg, an insulative polymer, or an epoxy, is applied to the exposed surface of the first electrode 974*a*, and a bottom insulation layer 984, of similar material, is applied to the exposed surface of the fourth electrode 974*d*. The top insulation layer 982 fills the upper isolation area 976*a*, while the bottom insulation layer 984 fills the lower isolation area 976*b*. A bottom metallization layer, preferably a copper foil, is applied to the exposed surface of the bottom insulation layer 984, and it is photo-resist masked and etched to form first and second surface mount terminals 986, 988 separated by an exposed area of the bottom insulation layer 984. Similarly, a top metallization layer, preferably a copper foil, is applied to the top insulation layer 982, and it is photo-resist masked and etched to form an anchor pad 1000 and (optionally) identification indicia 990. The photo-resist masking and etching of the top and bottom metallization layers may be performed either before or after the vias 992, 994 are formed and plated, as described below. The top metallization layer and the top insulation layer 982 may be pre-formed and applied as a laminate, or they may be applied separately in sequence. Likewise, the bottom metallization layer and the bottom insulation layer 984 may be applied either together as a pre-formed laminate, or separately in sequence. In either case, the result is a multiple active layer laminated structure comprising first and second active polymer layers 972*a*, 972*b*, a first or upper electrode 974*a*, intermediate second and third electrodes 974*b*, 974*c*, a fourth or lower electrode 974*d*, an intermediate insulation layer 980, a top insulation layer 982, a bottom insulation layer 984, a bottom metallization layer, and a top metallization layer. The top and bottom metallization layers may be formed into the anchor pad 1000, the indicia 990, and the terminals 986, 988.

A first through-hole via 992 is formed through the entire thickness of the above-described multiple active layer laminated structure (e.g. by mechanical or laser drilling) at each of the first plurality of via locations, and a second through-hole via 994 is similarly (and, preferably, simultaneously) formed through the entire thickness of the structure at each of the second plurality of via locations. Thus, each device 970 has a first through-hole via 992 at a first end, and a second through-hole via 994 at the opposite end. At this point, the top entrance or opening of the second via 994 is chamfered by any suitable mechanical or chemical means, such as, for example, a drill with a conical drill bit (not shown), to form a chamfered or beveled entry hole 1002 for the second via 994. The chamfered entry hole 1002 extends to the second via 994, either adjacent to or through an end of the first or upper electrode 974*a*. Although it is preferred to drill the vias 992, 994 first, and then to form the chamfered entry hole 1002, the chamfered entry hole 1002 may be formed at the pre-defined via locations before the second vias 992, 994 are drilled. The entry hole 1002 extends through the upper insulation layer 982 to the second via 994, either adjacent to or through the adjacent end of the first or upper electrode 974*a*.

The top and bottom surfaces of the structure and the inside surfaces of the through-hole vias 992, 994, including the chamfered entry hole 1002 of each of the second vias 994, are plated with one or more layers of conductive metal, preferably copper, thereby forming a first set of cross-conductors 996 within each of the first set of vias 992, and a second set of cross-conductors 998 within each of the second set of vias 994. A photo-resist masking and etching process is employed to form the anchor pad 1000 and the optional indicia 990 from the top metallization layer, and to form the planar terminals 986, 988 from the bottom metallization layer. The masking and etching process may be employed either before or after the vias 992, 994 are formed and plated. Each of the first set of cross-conductors 996 establishes physical and electrical contact with the second and fourth electrodes 974*b*, 974*d*, the anchor pad 1000, and the first planar terminal 986, while being electrically isolated from the first (upper) electrode 974*a* by the upper isolation area 976*a*, and from the third (intermediate) electrode 974*c* by the first intermediate isolation layer 978*a*. Similarly, each of the second set of cross-conductors 998 establishes physical and electrical contact with the first (upper) electrode 974*a*, the third (intermediate) electrode 974*c*, and the second planar terminal 988, while being electrically isolated from the second and fourth electrodes 974*b*, 974*d* by the second intermediate isolation area 978*a* and the lower isolation area 976*b*, respectively. The first terminal 986 is in electrical contact with the second and fourth electrodes 974*b*, 974*d* through the first cross-conductor 996, while the second terminal 988 is in electrical contact with the first (upper) electrode 974*a* and the third electrode 974*c* through the second cross-conductor 998.

The upper and lower ends of the first cross-conductor 996 are respectively anchored by their connection to the anchor pad 1000 and the first planar terminal 986. The upper and lower ends of the second cross-conductor 998 are respectively anchored by their connection to the upper electrode 974*a* and the lower second terminal 988. The exposed metal areas, particularly the terminals 986, 988, the cross-conductors 996, 998, and the anchor pad 1000 may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 21A:
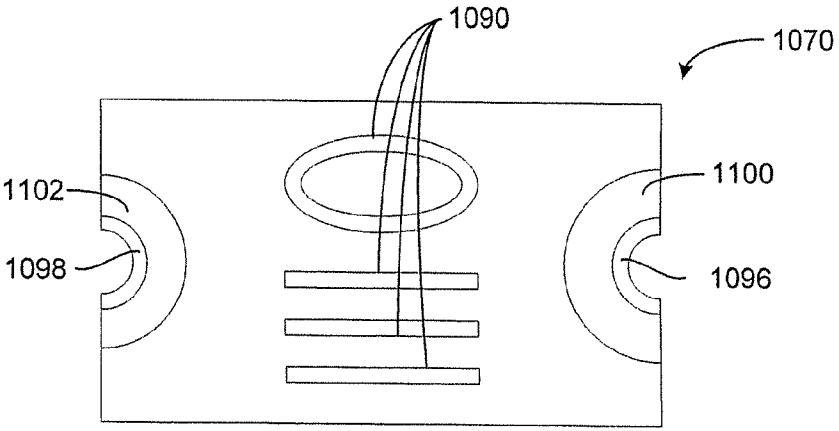
FIGS. 21A, 21B, and 21C are a top plan view, a cross-sectional view, and a bottom plan view, respectively, of a triple active layer conductive polymer device in accordance with the tenth embodiment of the present invention.
Figure 21C:
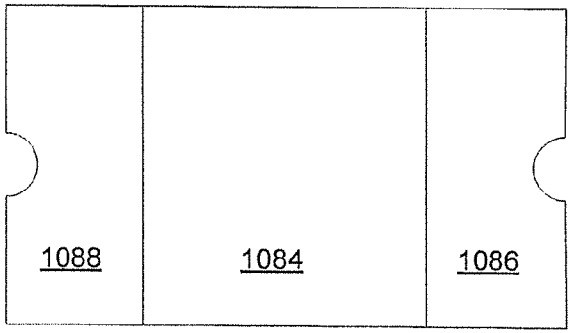
Figure 21B:
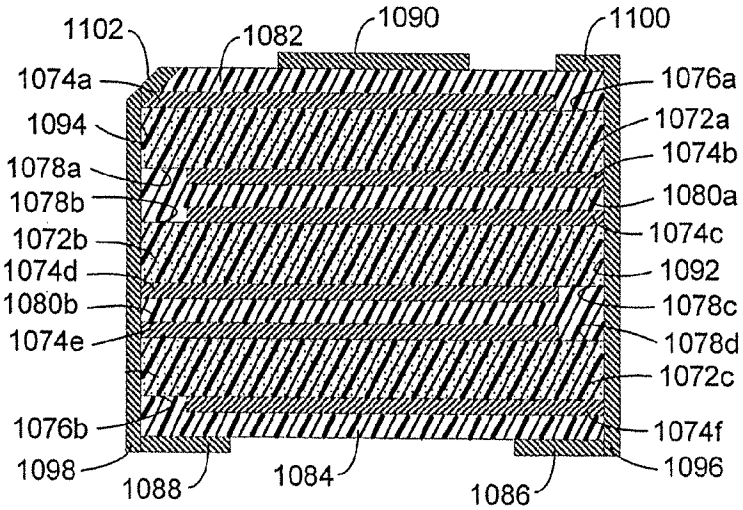

FIGS. 21A, 21B, and 21C illustrate a multiple active layer device 1070 that is a variant of the embodiment of FIGS. 20A-20C, wherein three laminated sheet structures are utilized to form a device with three active layers. The multiple active layer device 1070 comprises at least a first active layer 1072*a*, a second active layer 1072*b*, and a third active layer 1072*c*, of conductive polymer material, connected in parallel, and arranged in a vertically-stacked configuration using only a single pair of surface-mount terminals. It will be appreciated that four or more laminated sheet structures may be utilized to form a device with four or more active layers. The device 1070 includes first, second and third active layers 1072*a*, 1072*b*, 1072*c* of conductive polymer material. The first active layer 1072*a* is laminated between first and second metal foil electrodes 1074*a*, 1074*b* in a first laminated sheet structure; the second active layer 1072*b* is laminated between third and fourth metal foil electrodes 1074*c*, 1074*d* in a second laminated sheet structure; and the third active layer 1072*c* is laminated between fifth and sixth metal foil electrodes 1074*e*, 1074*f* in a third laminated sheet structure, each of the sheet structures being of the type described above and shown in FIGS. 1A and 1B. The first and second pluralities of via locations are defined as described above. The first or upper electrode 1074*a* is formed (by photo-resist masking and etching) with an arcuate upper isolation area 1076*a* between the first electrode 1074*a* and a first end of the device 1070, adjacent a first through-hole via 1092. Similarly, the sixth or lower electrode 1074*f* is likewise formed with an arcuate lower isolation area 1076*b* between the sixth electrode 1074*f* and the first end of the device 1070. The second and third (intermediate) electrodes 1074*b*, 1074*c* are similarly formed with intermediate arcuate isolation areas 1078*a*, 1078*b* between the intermediate electrodes 1074*b*, 1074*c* and the second end of the device 1070. The fourth and fifth (intermediate) electrodes 1074*d*, 1074*e* are similarly formed with intermediate arcuate isolation areas 1078*c*, 1078*d* between the intermediate electrodes 1074*d*, 1074*e* and the first end of the device 1070. The first, second and third laminated sheet structures are then laminated together into a multiple active layer laminated structure by intermediate insulative layers 1080*a*, 1080*b* (prepreg, polymer, or epoxy), so that the isolation areas 1076*a*, 1078*c*, 1078*d* are aligned at a first end of the structure, and the intermediate isolation areas 1078*a*, 1078*b*, 1076*b* are aligned at the opposite end of the structure. The intermediate isolation areas 1078*a*, 1078*b* are filled by the intermediate insulative layer 1080*a*, while the intermediate isolation areas 1078*c*, 1078*d* are filled by the intermediate insulative layer 1080*b*

A top insulation layer 1082, which may be of prepreg, an insulative polymer, or an epoxy, is applied to the exposed surface of the first electrode 1074*a*, and a bottom insulation layer 1084, of similar material, is applied to the exposed surface of the sixth electrode 1074*f*. The top insulation layer 1082 fills the upper isolation area 1076*a*, while the bottom insulation layer 1084 fills the lower isolation area 1076*b*. A bottom metallization layer, preferably a copper foil, is applied to the exposed surface of the bottom insulation layer 1084, and it is photo-resist masked and etched to form first and second surface mount terminals 1086, 1088 separated by an exposed area of the bottom insulation layer 1084. Similarly, a top metallization layer, preferably a copper foil, is applied to the top insulation layer 1082, and it is photo-resist masked and etched to form an anchor pad 1100 and (optionally) identification indicia 1090. The photo-resist masking and etching of the top and bottom metallization layers may be performed either before or after the vias 1092, 1094 are formed and plated, as described below. The top metallization layer and the top insulation layer 1082 may be pre-formed and applied as a laminate, or they may be applied separately in sequence. Likewise, the bottom metallization layer and the bottom insulation layer 1084 may be applied either together as a pre-formed laminate, or separately in sequence. In either case, the result is a multiple active layer laminated structure comprising first second and third active polymer layers 1072*a*, 1072*b*, 1072*c* a first or upper electrode 1074*a*, intermediate second, third, fourth and fifth electrodes 1074*b*, 1074*c*, 1074*d*, 1074*e* a sixth or lower electrode 1074*f*, intermediate insulation layers 1080*a*, 1080*b*, a top insulation layer 1082, a bottom insulation layer 1084, a bottom metallization layer, and a top metallization layer. The top and bottom metallization layers may be formed into the anchor pad 1100, the indicia 1090, and the terminals 1086, 1088.

A first through-hole via 1092 is formed through the entire thickness of the above-described multiple active layer laminated structure (e.g. by mechanical or laser drilling) at each of the first plurality of via locations, and a second through-hole via 1094 is similarly (and, preferably, simultaneously) formed through the entire thickness of the structure at each of the second plurality of via locations. Thus, each device 1070 has a first through-hole via 1092 at a first end, and a second through-hole via 1094 at the opposite end. At this point, the top entrance or opening of the second via 1094 is chamfered or beveled by any suitable mechanical or chemical means, such as, for example, a drill with a conical drill bit (not shown), to form a chamfered or beveled entry hole 1102 for the second via 1094. The chamfered entry hole 1102 extends to the second via 1094, either adjacent to or through an end of the first or upper electrode 1074*a*. Although it is preferred to drill the vias 1092, 1094 first, and then to form the chamfered entry hole 1102, the chamfered entry hole 1102 may be formed at the pre-defined via locations before the second vias 1092, 1094 are drilled.

The top and bottom surfaces of the structure and the inside surfaces of the through-hole vias 1092, 1094, including the chamfered entry hole 1102 of each of the second vias 1094, are plated with one or more layers of conductive metal, preferably copper, thereby forming a first set of cross-conductors 1096 within each of the first set of vias 1092, and a second set of cross-conductors 1098 within each of the second set of vias 1094. A photo-resist masking and etching process is employed to form the anchor pad 1100 and the optional indicia 1090 from the top metallization layer, and to form the planar terminals 1086, 1088 from the bottom metallization layer. The masking and etching process may be employed either before or after the vias 1092, 1094 are formed and plated. Each of the first set of cross-conductors 1096 establishes physical and electrical contact with the second, third and sixth electrodes 1074*b*, 1074*c*, 1074*f* the anchor pad 1100, and the first planar terminal 1086, while being electrically isolated from the first (upper) electrode 1074*a* by the upper isolation area 1076*a*, from the fourth electrode 1074*d* by the isolation layer 1078*c* and from the fifth electrode 1074*e* by the isolation layer 1078*d*. Similarly, each of the second set of cross-conductors 1098 establishes physical and electrical contact with the first (upper) electrode 1074*a*, fourth, and fifth electrodes 1074*d*, 1074*e* and the second planar terminal 1088, while being electrically isolated from the second and third (intermediate) electrodes 1074*b*, 1074*c* by the intermediate isolation areas 1078*a*, 1078*b* and from the sixth (lower) electrode 1074*f* by the isolation layer 1076*b*. The first terminal 1086 is in electrical contact with the second, third and sixth electrodes 1074*b*, 1074*c*, 1074*f* through the first cross-conductor 1096, while the second terminal 1088 is in electrical contact with the first (upper) electrode 1074*a*, the fourth and fifth (intermediate) electrodes 1074*d*, 1074*e* through the second cross-conductor 1098.

The upper and lower ends of the first cross-conductor 1096 are respectively anchored by their connection to the anchor pad 1100 and the first planar terminal 1086. The upper and lower ends of the second cross-conductor 1098 are respectively anchored by their connection to the upper electrode 1074*a* and the lower second terminal 1088. The exposed metal areas, particularly the terminals 1086, 1088, the cross-conductors 1096, 1098, and the anchor pad 1100 may advantageously be over-plated with one or more solderable metal layers, such as, for example, nickel and gold ENIG plating or electroless tin plating. Alternatively, the over-plating may be electroplated nickel and gold, electroplated nickel and tin, or electroplated tin, applied immediately after the copper plating step.

Figure 22:
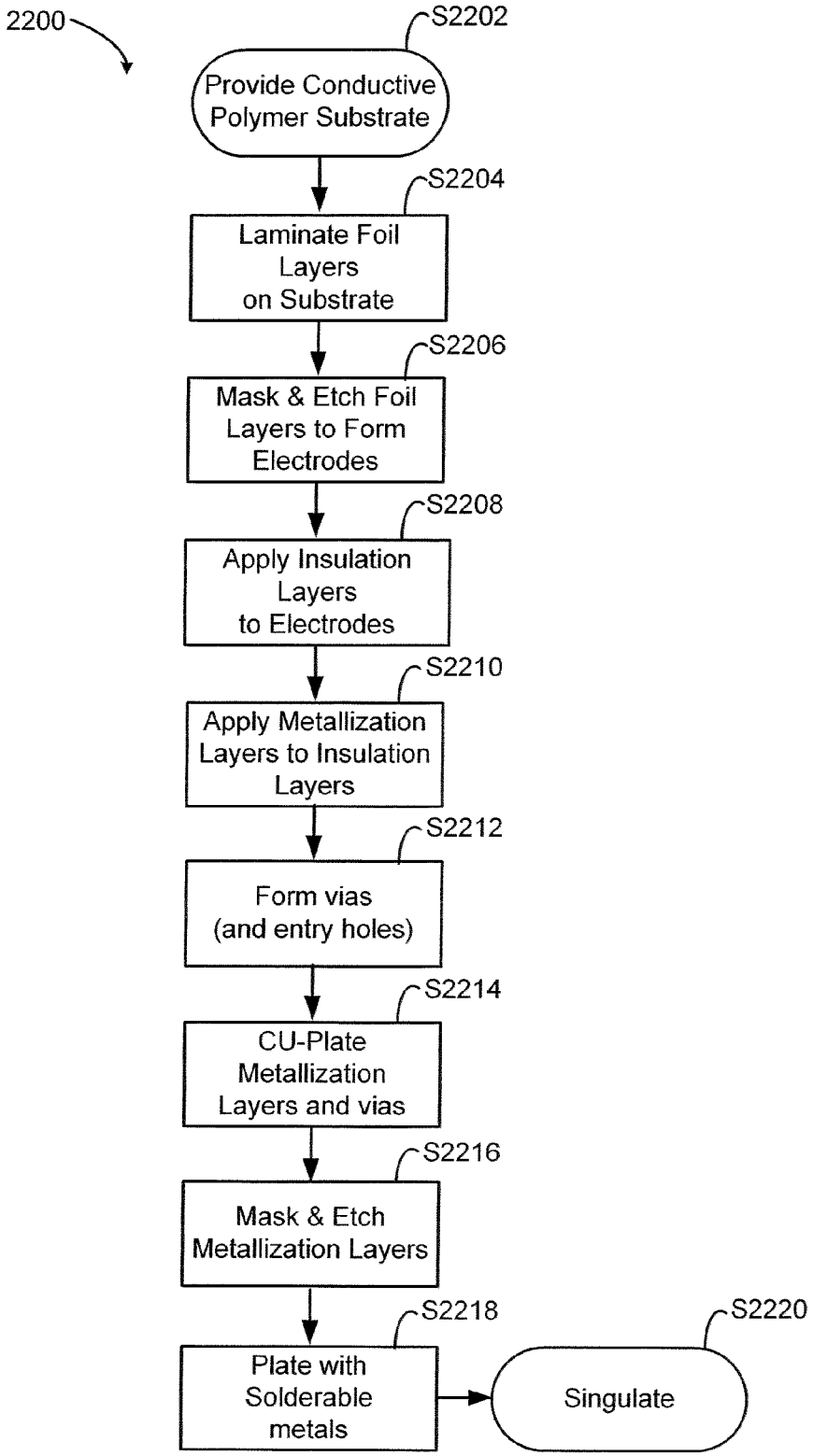
FIG. 22 is a flowchart showing a first preferred method of manufacturing conductive polymer devices in accordance with the present invention.

FIG. 22 is a flowchart illustrating a method 2200 for the production of polymeric devices (such as, for example, the device 430 illustrated in FIGS. 10A-10C), according to one aspect of the present invention. With reference, then, to FIG. 22 and to FIGS. 1A, 1B, 10A, 10B, and 10C, the process starts in step S2202, where a conductive polymer substrate 16 (FIGS. 1A and 1B) is provided. In step S2204, the polymer substrate 16 is laminated between upper and lower metal layers 12 and 14 (FIGS. 1A and 1B). In step S2206, the metal layers 12 and 14 are masked and etched to form the upper and lower electrodes 434, 436 (FIG. 10B). In step S2208, the upper and lower insulation layers 442, 444 are formed on the upper and lower electrodes 434, 436, respectively. In step S2210, the bottom metallization layer 22, and the top metallization layer 24 (FIGS. 1A, 1B) are applied to the lower and upper insulation layers 444, 442, respectively. In step S2212, the through-hole vias 452, 454 and the beveled entry hole 462 (FIG. 10B) are formed. Those of ordinary skill in the art will appreciate that in certain embodiments the vias 452, 454 may not include beveled entry holes. In step S2214, the top and bottom metallization layers and vias 452, 454 (including the beveled entry hole 462) are electroplated with copper (preferably about 25 microns in thickness) to provide the cross-conductors 456, 458 (FIGS. 10A, 10B). In step S2216, the lower metallization layer is masked and etched to form the planar surface-mount terminal pads 446, 448 (FIGS. 10B, 10C) and the upper metallization layer is masked and etched to form the anchor pad 462 and the optional indicia 450 (FIGS. 10A, 10B). In this step, the masking is applied to the portions of the lower metallization layer where the terminal pads will be formed, the portions of the upper metallization layer where the anchor pad 462 and the optional indicia 450 will be formed, and the plated internal surfaces of the vias (i.e., the cross-conductors 456, 458). After etching, the masking is removed, and in step S2218 the exposed metal areas (the terminal pads 446, 448; the cross-conductors 456, 458; the anchor pad 462; and the indicia 450) are over-plated with one or more solderable metals. In a first example embodiment, the over-plating is nickel and gold ENIG plating, with a nickel layer of about 3.4 microns and a gold layer of about 0.1 micron. Alternatively, tin may be electrolessly plated to a thickness of about 3.5 to 6 microns. Finally, in step S2220, the devices 430 are singulated from the laminated structure 10 along the grid lines 26 (FIG. 1B).

Figure 23:
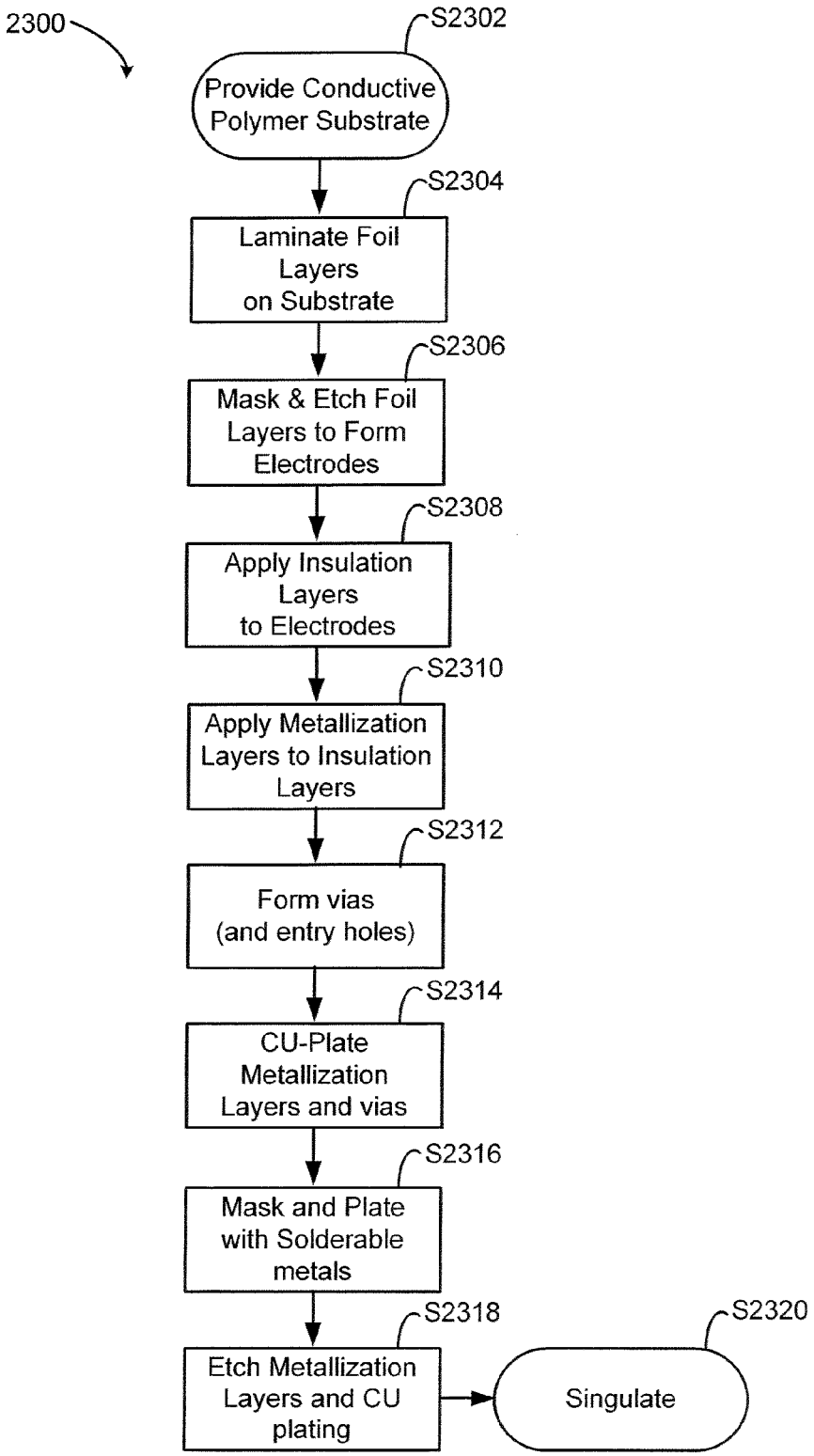
FIG. 23 is a flowchart showing a second preferred method of manufacturing conductive polymer devices in accordance with the present invention.

FIG. 23 is a flowchart of an alternative method of making a device according to the present invention, such as, for example, the device 430 of FIGS. 10A-10C. With reference, then, to FIG. 23 and to FIGS. 1A, 1B, 10A, 10B, and 10C, the process starts in step S2302, where a conductive polymer substrate 16 (FIGS. 1A and 1B) is provided. In step S2304, the polymer substrate 16 is laminated between upper and lower metal layers 12 and 14 (FIGS. 1A and 1B). In step S2306, the metal layers 12 and 14 are masked and etched to form the upper and lower electrodes 434, 436 (FIG. 10B). In step S2308, the upper and lower insulation layers 442, 444 are formed on the upper and lower electrodes 434, 436, respectively. In step S2310, the bottom metallization layer 22, and the top metallization layer 24 (FIGS. 1A, 1B) are applied to the lower and upper insulation layers 444, 442, respectively. In step S2312, the through-hole vias 452, 454 and the beveled entry hole 462 (FIG. 10B) are formed. Those of ordinary skill in the art will appreciate that in certain embodiments the vias 452, 454 may not include beveled entry holes. In step S2314, the top and bottom metallization layers and vias 452, 454 (including the beveled entry hole 462) are electroplated with copper (preferably about 25 microns in thickness) to provide the cross-conductors 456, 458 (FIGS. 10A, 10B). In step S2316, the copper-plated top and bottom metallization layers are photo-resist masked for the electroplate deposition of the over-plate layer or layers of solderable metal in those areas where the terminals 446, 448, the anchor pad 462, and the optional indicia 450 are to be formed. The over-plating of solderable metal(s) is applied to the unmasked areas, including the copper-plated internal surfaces of the vias (i.e., the cross-conductors 456, 458). If the plating is electroplated nickel then gold, the nickel layer may be, for example, about 3.4 microns in thickness, with the gold about 0.1 microns in thickness. If the electroplating is nickel then tin, the nickel layer thickness may be about 3.5 microns and the tin layer thickness about 2.5 microns. If the electroplating is tin alone, the tin layer may be about 3.5 to 6.0 microns in thickness. In step S2318, the photo-resist mask is removed from the copper-plated areas (where no over-plating has occurred), and the bare copper areas are etched down through the metallization layers to the insulation layers 442, 444 to form the terminals 446, 448 (FIGS. 10B, 10C), the anchor pad 462, and the optional indicia 450 (FIGS. 10A, 10B). Finally, in step S2320, the devices 430 are singulated from the laminated structure 10 along the grid lines 26 (FIG. 1B).

While several example embodiments of the invention have been described herein, these embodiments are not exclusive. It is therefore understood that the scope of the invention disclosed and claimed herein will encompass other embodiments, variations, and modifications as equivalent to the specific embodiments described in this specification.

The flowcharts provided herein illustrate example embodiments of the present methods. In some alternative embodiments, the steps shown in these figures may occur out of the order presented. For example, in some cases two steps shown in succession may be executed substantially concurrently, or the steps may sometimes be executed in the reverse order. Those of ordinary skill in the art will also appreciate that the scope of the present methods is defined only by the claims provided below, and therefore some embodiments may not include all of the steps shown in the provided figures.

What is claimed is:

1. A surface-mountable electronic device (230), comprising:

a conductive polymer layer (232) between a first electrode (234) and a second electrode (236);

a first insulation layer (242) on the first electrode and a second insulation layer (244) on the second electrode;

first and second planar conductive terminals (246, 248) spaced apart from each other on the second insulation layer (244) adjacent first and second ends, respectively, of the second insulation layer;

a first cross-conductor (256) connecting the second electrode (236) and the first terminal (246), and separated from the first electrode (234) by a portion (238) of the first insulation layer (242); and a second cross-conductor (258) connecting the first electrode (234) and the second terminal (248), and separated from the second electrode (236) by a portion (240) of the second insulation layer (244);

and wherein at least one of the first and second cross-conductors (256, 258) includes a metallized beveled or chamfered portion (260, 262) extending through the first insulation layer (242).

2. A surface-mountable electronic device (430), comprising:

a conductive polymer layer (432) between a first electrode (434) and a second electrode (436);

a first insulation layer (442) on the first electrode and a second insulation layer (444) on the second electrode;

first and second planar conductive terminals (446, 448) spaced apart from each other on the second insulation layer (444) adjacent first and second ends, respectively, of the second insulation layer;

a first cross-conductor (456) connecting the second electrode (436) and the first terminal (446), and separated from the first electrode (434) by a portion (438) of the first insulation layer (442); and a second cross-conductor (458) connecting the first electrode (434) and the second terminal (448), and separated from the second electrode (436) by a portion (440) of the second insulation layer (444);

and wherein the first cross-conductor (456) is in physical contact with a metallized anchor pad (460) on the first insulation layer (442), and the second cross-conductor (458) includes a metallized beveled or chamfered portion (462) extending through the first insulation layer (442).

3. A surface-mountable electronic device (330), comprising:

a conductive polymer layer (332) between a first electrode (334) and a second electrode (336);

a first insulation layer (342) on the first electrode (334) and a second insulation layer (344) on the second electrode (336);

first and second planar conductive terminals (346, 348) spaced apart from each other on the second insulation layer (344) adjacent first and second ends, respectively, of the second insulation layer, each of the first and second planar conductive terminals having a first area;

a first cross-conductor (356) formed as a first metallized via connecting the second electrode (336) and the first terminal (346), and separated from the first electrode (334) by a portion (338) of the first insulation layer (342); and a second cross-conductor (358) formed as a second metallized via connecting the first electrode (334) and the second terminal (348), and separated from the second electrode (336) by a portion (340) of the second insulation layer (344);

wherein the first cross-conductor (356) is in physical contact with a first anchor pad (360) formed as a first arcuate metallized area on the first insulation layer (342) adjacent the first metallized via, and the second cross-conductor (358) is in physical contact with a second anchor pad (362) formed as a second arcuate metallized area on the first insulation layer (342) adjacent the second metallized via;

wherein the area of each of the first and second anchor pads has a second area less than the first area.

4. A surface-mountable electronic device (130), comprising:

a conductive polymer layer (132) between a first electrode (134) and a second electrode (136);

a first insulation layer (142) on the first electrode and a second insulation layer (144) on the second electrode;

first and second planar conductive terminals (146, 148) spaced apart from each other on the second insulation layer (144) adjacent first and second ends, respectively, of the second insulation layer;

a first cross-conductor (156) connecting the second electrode (136) and the first terminal (146), and separated from the first electrode (134) by a portion (138) of the first insulation layer (142); and a second cross-conductor (158) connecting the first electrode (134) and the second terminal (148), and separated from the second electrode (136) by a portion (140) of the second insulation layer (144);

wherein the portion (138) of the first insulation layer separating the first cross-conductor from the first electrode comprises a first isolation area, and the portion (140) of the second insulation layer separating the second cross-conductor from the second electrode comprises a second isolation area; and wherein the first isolation area is configured as a first lateral band spaced from the first cross-conductor by an upper metal area (139), and the second isolation area is configured as a second lateral band spaced from the second cross-conductor by a lower metal area (141).

5. A surface-mountable electronic device (270), comprising:

a first conductive polymer layer (272*a*) between a first electrode (274*a*) and a second electrode (274*b*);

a second conductive polymer layer (272*b*) between a third electrode (274*c*) and a fourth electrode (274*d*);

a first insulation layer (280) between the second and third electrodes (274*b*, 274*c*);

a second insulation layer (282) on the first electrode (274*a*) and a third insulation layer (284) on the fourth electrode (274*d*);

first and second planar conductive terminals (286, 288) spaced apart from each other on the third insulation layer (284) adjacent first and second ends, respectively, of the third insulation layer;

a first cross-conductor (296) connecting the second electrode (274*b*), the third electrode (274*c*), and the first terminal (286), and separated from the first electrode by a portion (276*a*) of the second insulation layer (282) and separated from the fourth electrode by a portion (276*b*) of the third insulation layer (284); and a second cross-conductor (298) connecting the first electrode (274*a*), the fourth electrode (274*d*), and the second terminal (288), and separated from the second and third electrodes by portions (278*a*, 278*b*) of the first insulation layer (280);

and wherein at least one of the first and second cross-conductors (296, 298) includes a metallized beveled or chamfered portion (300, 302) extending through the second insulation layer (282).

6. A surface-mountable electronic device (470), comprising:

a first conductive polymer layer (472*a*) between a first electrode (474*a*) and a second electrode (474*b*);

a second conductive polymer layer (472*b*) between a third electrode (474*c*) and a fourth electrode (474*d*);

a first insulation layer (480) between the second and third electrodes (474*b*, 474*c*);

a second insulation layer (482) on the first electrode (474*a*) and a third insulation layer (484) on the fourth electrode (474*d*);

first and second planar conductive terminals (486, 488) spaced apart from each other on the third insulation layer (484) adjacent first and second ends, respectively, of the third insulation layer;

a first cross-conductor (496) connecting the second electrode (474*b*), the third electrode (474*c*), and the first terminal (486), and separated from the first electrode by a portion (476*a*) of the second insulation layer (482) and separated from the fourth electrode by a portion (476*b*) of the third insulation layer (484); and a second cross-conductor (498) connecting the first electrode (474*a*), the fourth electrode (474*d*), and the second terminal (488), and separated from the second and third electrodes by portions (478*a*, 478*b*) of the first insulation layer (480);

and wherein the first cross-conductor (496) is in physical contact with a metallized anchor pad (500) on the second insulation layer (482), and the second cross-conductor (498) includes a metallized beveled or chamfered portion (502) extending through the second insulation layer (482).

7. A surface-mountable electronic device (970), comprising:

a first conductive polymer layer (972*a*) between a first electrode (974*a*) and a second electrode (974*b*);

a second conductive polymer layer (972*b*) between a third electrode (974*c*) and a fourth electrode (974*d*);

a first insulation layer (980) abutting a surface of each of the second and third electrodes (974*b*, 974*c*);

a second insulation layer (982) on the first electrode (974*a*), and a third insulation layer (984) on the fourth electrode (974*d*);

first and second planar conductive terminals (986, 988) spaced apart from each other on the third insulation layer (984) adjacent first and second ends, respectively, of the third insulation layer;

a first cross-conductor (996) connecting the second and fourth electrodes (974*b*, 974*d*) and the first terminal (986), wherein a portion (976*a*) of the second insulation layer (982) separates the first cross-conductor from the first electrode (974*a*), and wherein a portion (978*b*) of the first insulation layer (980) separates the first cross-conductor from the third electrode (974*c*); and a second cross-conductor (998) connecting the first and third electrodes (974*a*, 974*c*) and the second terminal (988), wherein a portion (978*a*) of the first insulation layer (980) separates the second cross-conductor from the second electrode (974*b*), and wherein a portion (976*b*) of the third insulation layer (984) separates the second cross-conductor from the fourth electrode (974*d*);

wherein the first cross-conductor (996) is in physical contact with a metallized anchor pad (1000) on the second insulation layer (982), and the second cross-conductor (998) includes a metallized beveled or chamfered portion (1002) extending through the second insulation layer (982).

8. A surface-mountable electronic device (370), comprising:

a first conductive polymer layer (372*a*) between a first electrode (374*a*) and a second electrode (374*b*);

a second conductive polymer layer (372*b*) between a third electrode (374*c*) and a fourth electrode (374*d*);

a first insulation layer (380) abutting a surface of each of the second and third electrodes (374*b*, 374*c*);

a second insulation layer (382) on the first electrode (374*a*) and a third insulation layer (384) on the fourth electrode (374*d*);

first and second planar conductive terminals (386, 388) spaced apart from each other on the third insulation layer (384) adjacent first and second ends, respectively, of the third insulation layer, each of the first and second planar conductive terminals having a first area;

a first cross-conductor (396) formed as a first metallized via connecting the second electrode (374*b*), the third electrode (374*c*), and the first terminal (386), and separated from the first electrode by a portion (376*a*) of the second insulation layer (382) and separated from the fourth electrode by a portion (376*b*) of the third insulation layer (384); and a second cross-conductor (398) formed as a second metallized via connecting the first electrode (374*a*), the fourth electrode (374*d*), and the second terminal (388), and separated from the second and third electrodes by portions (378*a*, 378*b*) of the first insulation layer (380);

wherein the first cross-conductor (396) is in physical contact with a first anchor pad (400) formed as a first arcuate metallized area on the second insulation layer (382) adjacent the first metallized via and the second cross-conductor (398) is in physical contact with a second anchor pad (402) formed as a second arcuate metallized area on the second insulation layer (382) adjacent the second metallized via;

wherein each of the first and second anchor pads has a second area less than the first area.

9. A surface-mountable electronic device (170), comprising:

a first active conductive polymer layer (172*a*) between a first electrode (174*a*) and a second electrode (174*b*);

a second active conductive polymer layer (172*b*) between a third electrode (174*c*) and a fourth electrode (174*d*);

a first insulation layer (180) between the second and third electrodes (174*b*, 174*c*);

a second insulation layer (182) on the first electrode (174*a*) and a third insulation layer (184) on the fourth electrode (174*d*);

first and second planar conductive terminals (186, 188) spaced apart from each other on the third insulation layer (184) adjacent first and second ends, respectively, of the third insulation layer;

a first cross-conductor (196) connecting the second electrode (174*b*), the third electrode (174*c*), and the first terminal (186), and separated from the first electrode by a portion (176*a*) of the second insulation layer (182)

and separated from the fourth electrode by a portion (176*b*) of the third insulation layer (184); and a second cross-conductor (198) connecting the first electrode (174*a*), the fourth electrode (174*d*), and the second terminal (188), and separated from the second and third electrodes by portions (178*a*, 178*b*) of the first insulation layer (180);

wherein the portion (176*a*) of the second insulation layer separating the first cross-conductor from the first electrode comprises a first isolation area, the portion (176*b*) of the third insulation layer separating the first cross-conductor from the fourth electrode comprises a third isolation area, and the portions (178*a*, 178*b*) of the first insulation layer separating the second cross-conductor from the second and third electrodes comprise second isolation areas; and wherein each of the first and third isolation areas is configured as a lateral band spaced from the first cross-conductor, and each of the second isolation areas is configured as a lateral band spaced from the second cross-conductor.

10. A surface-mountable electronic device (1070), comprising:

a first conductive polymer layer (1072*a*) between a first electrode (1074*a*) and a second electrode (1074*b*);

a second conductive polymer layer (1072*b*) between a third electrode (1074*c*) and a fourth electrode (1074*d*);

a third conductive polymer layer (1072*c*) between a fifth electrode (1074*e*) and a sixth electrode (10740;

a first insulation layer (1080*a*) between the second and third electrodes (1074*b*, 1074*c*);

a second insulation layer (1080*b*) between the fourth and fifth electrodes (1074*d*, 1074*e*);

a third insulation layer (1082) on the first electrode (1074*a*) and a fourth insulation layer (1084) on the sixth electrode (10740;

first and second planar conductive terminals (1086, 1088) spaced apart from each other on the fourth insulation layer (1084), adjacent first and second ends, respectively, of the fourth insulation layer;

a first cross-conductor (1096) connecting the second electrode (1074*b*), the third electrode (1074*c*), the sixth electrode (10740, and the first terminal (1086), and separated from the first electrode (1074*a*) by a portion (1076*a*) of the third insulation layer (1082) and separated from the fourth electrode (1074*d*) and the fifth electrode (1074*e*) by portions (1078*c*, 1078*d*) of the second insulation layer (1080*b*); and a second cross-conductor (1098) connecting the first electrode (1074*a*), the fourth electrode (1074*d*), the fifth electrode (1074*e*) and the second terminal (1088), and separated from the second electrode (1074*b*) and the third electrode (1074*c*) by portions (1078*a*, 1078*b*) of the first insulation layer (1080*a*), and separated from the sixth electrode (10740 by a portion (1076*b*) of the fourth insulation layer (1084);

wherein the first cross-conductor (1096) is in physical contact with a metallized anchor pad (1100) on the third insulation layer (1082), and the second cross-conductor (1098) includes a metallized beveled or chamfered portion (1102) extending through the third insulation layer (1082).

11. A method of manufacturing a surface-mountable electronic device (230), comprising:

(a) forming a matrix of surface-mountable electronic devices by:

(i) laminating a conductive polymer substrate (232) between first and second metal foil layers;

(ii) removing a portion of the first foil layer to form an array of first electrodes (234) and removing a portion of the second foil layer to form an array of second electrodes (236);

(iii) applying a first insulation layer (242) on the array of first electrodes (234), and applying a second insulation layer (244) on the array of second electrodes (236);

(iv) applying first and second metallization layers on the first and second insulation layers (242, 244), respectively;

(v) forming a first array of metallized vias (252), each having metallization connecting one of the second electrodes (236) to the first and second metallization layers, each of the first array of metallized vias being isolated from one of the first electrodes (234) by a portion (238) of the first insulation layer (242); and a second array of metallized vias (254), each having metallization connecting one of the first electrodes (234) to the first and second metallization layers, each of the second array of metallized vias being isolated from one of the second electrodes (236) by a portion (240) of the second insulation layer (244), at least one of the first and second metallized via arrays defining an array of metallized beveled or chamfered entry holes (260, 262) extending through the first insulation layer (242);

(vi) removing a portion of the second metallization layer to form an array of first surface mount terminals (246), each physically connected to one of the first array of metallized vias (252), and an array of second surface mount terminals (248), each physically connected to one of the second array of metallized vias (254), each of the first and second surface mount terminals being electrically connected by one of the metallized vias to one of the first and second electrodes and electrically isolated by a portion (238, 240) of one of the insulation layers from the other of the first and second electrodes; and (vii) removing a portion of the first metallization layer adjacent each of the metallized beveled or chamfered entry holes; and (b) singulating the matrix into a plurality of individual surface-mountable electronic devices (230), each of the devices including a first cross-conductor (256) defined by one of the metallized vias (252), in the first array of metallized vias, a second cross-conductor (258) defined by one of the metallized vias (254) in the second array of metallized vias, a first surface mount terminal (246) in physical contact with the first cross-conductor (256), and a second surface mount terminal (248) in physical contact with the second cross-conductor (258), wherein each of the first cross-conductors (256) is in physical contact with one of the second electrodes (236) and is isolated from one of the first electrodes (234) by the portion (238) of the first insulation layer, wherein each of the second cross-conductors (258) is in physical contact with one of the first electrodes (234) and is isolated from one of the second electrodes (236) by the portion (240) of the second insulation layer (244), and wherein at least one of the first and second cross-conductors (256, 258) includes a metallized beveled or chamfered portion (260, 262) extending through the first insulation layer (242).

12. A method of manufacturing a surface-mountable electronic device (430), comprising:

(a) forming a matrix of surface-mountable electronic devices by:

(i) laminating a conductive polymer substrate (432) between first and second metal foil layers;

(ii) removing a portion of the first foil layer to form an array of first electrodes (434), and removing a portion of the second foil layer to form an array of second electrodes (436);

(iii) applying a first insulation layer (442) on the array of first electrodes (434), and applying a second insulation layer (444) on the array of second electrodes (436);

(iv) applying first and second metallization layers on the first and second insulation layers (442, 444), respectively;

(v) forming a first array of metallized vias (452), each having metallization connecting one of the second electrodes (436) to the first and second metallization layers, each of the first array of metallized vias being isolated from one of the first electrodes (434) by a portion (438) of the first insulation layer (442); and a second array of metallized vias (454), each having metallization connecting one of the first electrodes (434) to the first and second metallization layers, each of the second array of metallized vias being isolated from one of the second electrodes (436) by a portion (440) of the second insulation layer (444), the second metallized via array defining an array of metallized beveled or chamfered entry holes (462) extending through the first insulation layer (442);

(vi) removing a portion of the second metallization layer to form an array of first surface mount terminals (446), each physically connected to one of the first array of metallized vias (452), and an array of second surface mount terminals (448), each physically connected to one of the second array of metallized vias (454), each of the first and second surface mount terminals being electrically connected by one of the metallized vias to one of the first and second electrodes and electrically isolated by a portion (438, 440) of one of the insulation layers from the other of the first and second electrodes; and (vii) removing a portion of the first metallization layer so as to leave an array of metallized anchor pads (460) on the first insulation layer (442), each of anchor pads (460) being spaced from the metallized beveled or chamfered entry holes and in physical contact with one of the first array of metallized vias (452); and (b) singulating the matrix into a plurality of individual surface-mountable electronic devices (430), each of the devices including a first cross-conductor (456) defined by one of the metallized vias (452) in the first array of metallized vias, a second cross-conductor (458) defined by one of the metallized vias (454) in the second array of metallized vias, a first surface mount terminal (446) in physical contact with the first cross-conductor (456), and a second surface mount terminal (448) in physical contact the second cross-conductor (458);

wherein each of the first cross-conductors (456) is in physical contact with one of the anchor pads (460) and with one of the second electrodes (436) and is isolated from one of the first electrodes (434) by the portion (438) of the first insulation layer, wherein each of the second cross-conductors (458) is in physical contact with one of the first electrodes (434) and is isolated from one of the second electrodes (436) by the portion (440) of the second insulation layer (444), and wherein the second cross-conductor (458) includes a metallized beveled or chamfered portion (462) extending through the first insulation layer (442).

13. A method of manufacturing a mountable electronic device (330), comprising:

(a) forming a matrix of surface-mountable electronic devices by:

(i) laminating a conductive polymer substrate (332) between first and second metal foil layers;

(ii) removing a portion of the first foil layer to form an array of first electrodes (334), and removing a portion of the second foil layer to form an array of second electrodes (336);

(iii) applying a first insulation layer (342) on the array of first electrodes (334), and applying a second insulation layer (344) on the array of second electrodes (336);

(iv) applying first and second metallization layers on the first and second insulation layers (342, 344), respectively;

(v) forming a first array of metallized vias (352), each having metallization connecting one of the second electrodes (336) to the first and second metallization layers, each of the first array of metallized vias being isolated from one of the first electrodes (334) by a portion (338) of the first insulation layer (342); and a second array of metallized vias (354), each having metallization connecting one of the first electrodes (334) to the first and second metallization layers, each of the second array of metallized vias being isolated from one of the second electrodes (336) by a portion (340) of the second insulation layer (344);

(vi) removing a portion of the second metallization layer to form an array of first surface mount terminals (346), each physically connected to one of the first array of metallized vias (352), and an array of second surface mount terminals (348), each physically connected to one of the second array of metallized vias (354), each of the first and second surface mount terminals being electrically connected by one of the metallized vias to one of the first and second electrodes and electrically isolated by a portion (338, 340) of one of the insulation layers from the other of the first and second electrodes, each of the first and second surface mount terminals having a first area; and (vii) removing a portion of the first metallization layer so as to leave an array of first metallized anchor pads (360) and an array of second metallized anchor pads (362) on the first insulation layer (342), each of the first metallized anchor pads (360) being formed as an arcuate metallized area in physical contact with one of the first array of metallized vias (352), and each of the second metallized anchor pads (362) being in the form of an arcuate metallized area in physical contact with one of the second array of metallized vias (354), wherein each of the first and second anchor pads has a second area less than the first area; and (b) singulating the matrix into a plurality of individual surface-mountable electronic devices (330), each of the devices including a first cross-conductor (356) defined by one of the metallized vias (352) in the first array of metallized vias, a second cross-conductor (358) defined by one of the metallized vias (354) in the second array of metallized vias, a first surface mount terminal (346) in physical contact with the first cross-conductor (356), and a second surface mount terminal (348) in physical contact the second cross-conductor (358);

wherein each of the first cross-conductors (356) is in physical contact with one of the first array of metallized anchor pads (360) and one of the second electrodes (336) and is isolated from one of the first electrodes (334) by the portion (338) of the first insulation layer, and wherein each of the second cross-conductors (358) is in physical contact with one of the second array of metallized anchor pads (362) and with one of the first electrodes (334) and is isolated from one of the second electrodes (336) by the portion (340) of the second insulation layer (344).

14. A method of manufacturing a surface-mountable electronic device (270), comprising:

(a) forming a matrix of surface-mountable electronic devices by:

(i) laminating a first conductive polymer substrate (272*a*) between first and second metal foil layers;

(ii) removing a portion of the first foil layer to form an array of first electrodes (274*a*), and removing a portion of the second metal foil layer to form an array of second electrodes (274*b*), thereby forming a first laminated sheet structure;

(iii) laminating a second conductive polymer substrate (272*b*) between third and fourth metal foil layers;

(iv) removing a portion of the third metal foil layer to form an array of third electrodes (274*c*), and removing a portion of the fourth metal foil layer to form an array of fourth electrodes (274*d*), thereby forming a second laminated sheet structure;

(v) laminating the first and second laminated sheet structures together with a first insulation layer (280) to form a multiple layer laminated structure;

(vi) applying a second insulation layer (282) on the array of first electrodes (274*a*), and applying a third insulation layer (284) on the array of fourth electrodes (274*d*);

(vii) applying first and second metallization layers on the second and third insulation layers (282, 284), respectively;

(viii) forming a first array of metallized vias (292), each having metallization connecting one of the second electrodes (274*b*) and one of the third electrodes (274*c*) to the first and second metallization layers, each of the first array of metallized vias being isolated from one of the first electrodes (274*a*) by a portion (276*a*) of the second insulation layer (282) and isolated from one of the fourth electrodes (274*d*) by a portion (276*b*) of the third insulation layer (284); and a second array of metallized vias (294), each having metallization connecting one of the first electrodes (274*a*) and one of the fourth electrodes (274*d*) to the first and second metallization layers, each of the second array of metallized vias being isolated from one of the second electrodes (274*b*) by a first portion (278*a*) of the first insulation layer (280) and isolated from one of the third electrodes (274*c*) by a second portion (278*b*) of the first insulation layer (280), at least one of the first and second metallized via arrays defining an array of metallized beveled or chamfered entry holes (300, 302) extending through the second insulation layer (282);

(ix) removing a portion of the second metallization layer to form an array of first surface mount terminals (286), each physically connected to one of the first array of metallized vias (292), and an array of second surface mount terminals (288), each physically connected to one of the second array of metallized vias (294), each of the first surface mount terminals (286) being electrically connected by one of the first array of metallized vias (292) to the second and third electrodes (274*b*, 274*c*) and isolated by the portions (276*a*, 276*b*) of the second and third insulation layers (282, 284) from the first and fourth electrodes (274*a*, 274*d*), each of the second surface mount terminals (288) being electrically connected by one of the second array of metallized vias (294) to the first and fourth electrodes (274*a*, 274*d*) and isolated by the portions (278*a*, 278*b*) of the first insulation layer (280) from the second and third electrodes (274*b*, 274*c*); and (x) removing a portion of the first metallization layer adjacent each of the metallized beveled or chamfered entry holes; and (b) singulating the matrix into a plurality of individual surface-mountable electronic devices (270), each of the devices including a first cross-conductor (296) defined by one of the metallized vias (292) in the first array of metallized vias, a second cross-conductor (298) defined by one of the metallized vias (294) in the second array of metallized vias, a first surface mount terminal (286) in physical contact with the first cross-conductor (296), and a second surface mount terminal (288) in physical contact with the second cross-conductor (298);

wherein each of the first cross-conductors (296) is in physical contact with one of the second electrodes (274*b*) and one of the third electrodes (274*c*), and is isolated from one of the first electrodes (274*a*) by the portion (276*a*) of the second insulation layer (282) and from one of the fourth electrodes (274*d*) by the portion (276*b*) of the third insulation layer (284), wherein each of the second cross-conductors (298) is in physical contact with one of the first electrodes (274*a*) and one of the fourth electrodes (274*d*), and is isolated from one of the second electrodes (274*b*) and one of the third electrodes (274*c*) by the first and second portions (278*a*, 278*b*) of the first insulation layer (280), and wherein at least one of the first and second cross-conductors (296, 298) includes a metallized beveled or chamfered portion (300, 302) extending through the second insulation layer (282).

15. A method of manufacturing a surface-mountable electronic device (470), comprising:

(a) forming a matrix of surface-mountable electronic devices by:

(i) laminating a first conductive polymer substrate (472*a*) between first and second metal foil layers;

(ii) removing a portion of the first metal foil layer to form an array of first electrodes (474*a*), and removing a portion of the second metal foil layer to form an array of second electrodes (474*b*), thereby forming a first laminated sheet structure;

(iii) laminating a second conductive polymer substrate (472*b*) between third and fourth metal foil layers;

(iv) removing a portion of the third metal foil layer to form an array of third electrodes (474*c*), and removing a portion of the fourth metal foil layer to form an array of fourth electrodes (474*d*), thereby forming a second laminated sheet structure;

(v) laminating the first and second laminated sheet structures together with a first insulation layer (480) to form a multiple layer laminated structure;

(vi) applying a second insulation layer (482) on the array of first electrodes (474*a*), and applying a third insulation layer (484) on the array of fourth electrodes (474*d*);

(vii) applying first and second metallization layers on second and third insulation layers (482, 484), respectively;

(viii) forming a first array of metallized vias (492), each having metallization connecting one of the second electrodes (474*b*) and one of the third electrodes (474*c*) to the first and second metallization layers, each of the first array of metallized vias being isolated from one of the first electrodes (474*a*) by a portion (476*a*) of the second insulation layer (482) and isolated from one of the fourth electrodes (474*d*) by a portion (476*b*) of the third insulation layer (484); and a second array of metallized vias (494), each having metallization connecting one of the first electrodes (474*a*) and one of the fourth electrodes (474*d*) to the first and second metallization layers, each of the second array of metallized vias being isolated from one of the second electrodes (474*b*) by a first portion (478*a*) of the first insulation layer (480) and isolated from one of the third electrodes (474*c*) by a second portion (478*b*) of the first insulation layer (480), the second metallized via array defining an array of metallized beveled or chamfered entry holes (502) extending through the second insulation layer (482);

(ix) removing a portion of the second metallization layer to form an array of first surface mount terminals (486), each physically connected to one of the first array of metallized vias (492), and an array of second surface mount terminals (488), each physically connected to one of the second array of metallized vias (494), each of the first surface mount terminals (486) being electrically connected by one of the first array of metallized vias (492) to the second and third electrodes (474*b*, 474*c*) and isolated by the portions (476*a*, 476*b*) of the second and third insulation layers (482, 484) from the first and fourth electrodes (474*a*, 474*d*), each of the second surface mount terminals (488) being electrically connected by one of the second array of metallized vias (494) to the first and fourth electrodes (474*a*, 474*d*) and isolated by the portions (478*a*, 478*b*) of the first insulation layer (480) from the second and third electrodes (474*b*, 474*c*); and (x) removing a portion of the first metallization layer so as to leave an array of metallized anchor pads (500) on the second insulation layer (482), each of anchor pads (500) being spaced from the metallized beveled or chamfered entry holes and in physical contact with one of the first array of metallized vias (492); and (b) singulating the matrix into a plurality of individual surface-mountable electronic devices (470), each of the devices including a first cross-conductor (496) defined by one of the metallized vias (492) in the first array of metallized vias, a second cross-conductor (498) defined by one of the metallized vias (494) in the second array of metallized vias, a first surface mount terminal (486) in physical contact with the first cross-conductor (496), and a second surface mount terminal (488) in physical contact with the second cross-conductor (498);

wherein each of the first cross-conductors (496) is in physical contact with one of the array of anchor pads (500), with one of the second electrodes (474*b*), and with one of the third electrodes (474*c*), and is isolated from one of the first electrodes (474*a*) by the portion (476*a*) of the second insulation layer (482) and from one of the fourth electrodes (474*d*) by the portion (476*b*) of the third insulation layer (484), wherein each of the second cross-conductors (498) is in physical contact with one of the first electrodes (474*a*) and one of the fourth electrodes (474*d*), and is isolated from one of the second electrodes (474*b*) and one of the third electrodes (474*c*) by the first and second portions (478*a*, 478*b*) of the first insulation layer (480), and wherein the second cross-conductor (498) includes a metallized beveled or chamfered portion (502) extending through the second insulation layer (482).

16. A method of manufacturing a surface-mountable electronic device (370), comprising:

(a) forming a matrix of surface-mountable electronic devices by:

(i) laminating a first conductive polymer substrate (372*a*) between first and second metal foil layers;

(ii) removing a portion of the first metal foil layer to form an array of first electrodes (374*a*), and removing a portion of the second metal foil layer to form an array of second electrodes (374*b*), thereby forming a first laminated sheet structure;

(iii) laminating a second conductive polymer substrate (372*b*) between the third and fourth metal foil layers;

(iv) removing a portion of the third metal foil layer to form an array of third electrodes (374*c*), and removing a portion of the fourth metal foil layer to form an array of fourth electrodes (374*d*), thereby forming a second laminated sheet structure;

(v) laminating the first and second laminated sheet structures together with a first insulation layer (380) to form a multiple layer laminated structure;

(vi) applying a second insulation layer (382) on the array of first electrodes (374*a*), and applying a third insulation layer (384) on the array of fourth electrodes (374*d*);

(vii) applying first and second metallization layers on the second and third insulation layers (382, 384), respectively;

(viii) forming a first array of metallized vias (392), each having metallization connecting one of the second electrodes (374*b*) and one of the third electrodes (374*c*) to the first and second metallization layers, each of the first array of metallized vias being isolated from one of the first electrodes (374*a*) by a portion (376*a*) of the second insulation layer (382) and isolated from one of the fourth electrodes (374*d*) by a portion (376*b*) of the third insulation layer (384); and a second array of metallized vias (394), each having metallization connecting one of the first electrodes (374*a*) and one of the fourth electrodes (374*d*) to the first and second metallization layers, each of the second array of metallized vias being isolated from one of the second electrodes (374*b*) by a first portion (378*a*) of the first insulation layer (380) and isolated from one of the third electrodes (374*c*) by a second portion (378*b*) of the first insulation layer (380);

(ix) removing a portion of the second metallization layer to form an array of first surface mount terminals (386), each physically connected to one of the first array of metallized vias (392), and an array of second surface mount terminals (388), each physically connected to one of the second array of metallized vias (394), each of the first surface mount terminals (386) being electrically connected by one of the first array of metallized vias (392) to the second and third electrodes (374*b*, 374*c*) and isolated by the portions (376*a*, 376*b*) of the second and third insulation layers (382, 384) from the first and fourth electrodes (374*a*, 374*d*), each of the second surface mount terminals (388) being electrically connected by one of the second array of metallized vias (394) to the first and fourth electrodes (374*a*, 374*d*) and isolated by the portions (378*a*, 378*b*) of the first insulation layer (380) from the second and third electrodes (374*b*, 374*c*), each of the first and second surface mount terminals having a first area; and (x) removing a portion of the first metallization layer so as to leave a first array of metallized anchor pads (400) and a second array of anchor pads (402) spaced apart from each other on the second insulation layer (382), each of the first array of anchor pads (400) being formed as an arcuate metallized area in physical contact with one of the first array of metallized vias (392), and each of the second array of anchor pads (402) being formed as an arcuate metallized area in physical contact with one of the second array of metallized vias (394), each of the first and second anchor pads having a second area less than the first area; and (b) singulating the matrix into a plurality of individual surface-mountable electronic devices (370), each of the devices including a first cross-conductor (396) defined by one of the metallized vias (392) in the first array of metallized vias, a second cross-conductor (398) defined by one of the metallized vias (394) in the second array of metallized vias, a first surface mount terminal (386) and a first anchor pad (400) in physical contact with the first cross-conductor (396), and a second surface mount terminal (388) and a second anchor pad (402) in physical contact with the second cross-conductor (398);

wherein each of the first cross-conductors (396) is in physical contact with one of the second electrodes (374*b*) and with one of the third electrodes (374*c*), and is isolated from one of the first electrodes (374*a*) by the portion (376*a*) of the second insulation layer (382) and from one of the fourth electrodes (374*d*) by the portion (376*b*) of the third insulation layer (384), and wherein each of the second cross-conductors (398) is in physical contact with one of the first electrodes (374*a*) and one of the fourth electrodes (374*d*), and is isolated from one of the second electrodes (374*b*) and one of the third electrodes (374*c*) by the first and second portions (378*a*, 378*b*) of the first insulation layer (380).

* * * * *